US006674982B2

(12) United States Patent
Saitoh et al.

(10) Patent No.: US 6,674,982 B2
(45) Date of Patent: Jan. 6, 2004

(54) IMAGE FORMING APPARATUS INCLUDING COMPONENTS MOUNTED AND/OR DISMOUNTED IN SELECTED ORDER

(75) Inventors: Masanori Saitoh, Komae (JP); Nekka Matsuura, Yokohama (JP); Nobuyuki Yanagawa, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/962,580

(22) Filed: Sep. 26, 2001

(65) Prior Publication Data

US 2002/0037178 A1 Mar. 28, 2002

(30) Foreign Application Priority Data

Sep. 26, 2000 (JP) ..... 2000-292335
Sep. 29, 2000 (JP) ..... 2000-298271
Sep. 29, 2000 (JP) ..... 2000-298315

(51) Int. Cl.[7] ..... G03G 15/00; G03G 21/16
(52) U.S. Cl. ..... 399/110; 399/117
(58) Field of Search ..... 399/110, 111, 399/112, 113, 117, 125, 115, 116, 119, 121; 347/138, 152; 29/426.1, 428, 469

(56) References Cited

U.S. PATENT DOCUMENTS 4,647,961 A 3/1987 Kammoto et al.
4,821,063 A 4/1989 Kaneshige
4,841,358 A 6/1989 Kammoto et al.
4,954,849 A 9/1990 Koike et al.
4,968,997 A 11/1990 Saitoh et al.
4,975,749 A 12/1990 Tsunoda et al.
4,979,727 A 12/1990 Koike et al.
4,987,446 A * 1/1991 Mochimaru et al. ..... 399/113
5,014,091 A 5/1991 Koike et al.
5,194,959 A 3/1993 Kaneko et al.
5,266,998 A * 11/1993 Lee ..... 399/113
5,369,479 A * 11/1994 Tsuyuki ..... 399/113
5,404,206 A 4/1995 Andoh et al.
5,752,133 A * 5/1998 Nagase et al. ..... 399/112
5,758,243 A * 5/1998 Haneda et al. ..... 399/111
6,088,555 A 7/2000 Mizuno
6,122,468 A 9/2000 Sakamoto et al.
6,157,797 A 12/2000 Saito et al.
6,215,974 B1 4/2001 Katoh et al.
6,249,304 B1 6/2001 Sawayama et al.
6,256,461 B1 7/2001 Takeyama et al.
6,292,641 B1 9/2001 Takeyama et al.
6,308,027 B1 10/2001 Obu et al.
6,347,204 B1 * 2/2002 Kurosawa ..... 399/113

FOREIGN PATENT DOCUMENTS

EP 0 411 825 2/1991
JP 08050441 A * 2/1996

OTHER PUBLICATIONS

Patent Abstracts of Japan, JP 04–356062, Dec. 9, 1992.
Patent Abstracts of Japan, JP 62–017761, Jan. 26, 1987.

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An image forming apparatus of the present invention includes a plurality of components that form image forming means and should be mounted or dismounted in a preselected order. Following one of the components with respect to the preselected order cannot be dismounted from the apparatus until preceding one of the same has been dismounted. The components are mounted to the apparatus in the reverse order. The components unremovable from the apparatus and positioned above the removable components in a preselected dismounting direction are retractable.

196 Claims, 49 Drawing Sheets

REAR
RIGHT-AND-LEFT
FRONT
1500
1540
1540a
1510
4000'
3000'
124
129
1310
1300
1100
1110
1140a
140
116W
126W
250
252
255
257
253
254
256
110
125
316
914
324a
318
324b
913a
912
911
913b
910
913c
900
324c
414
4000e
3000a
3000b

IMAGE FORMING APPARATUS INCLUDING COMPONENTS MOUNTED AND/OR DISMOUNTED IN SELECTED ORDER

BACKGROUND OF THE INVENTION

1. Field of the Invention

The present invention relates to a copier, printer, facsimile apparatus or similar image forming apparatus.

2. Description of the Background Art

It has been customary with an image forming apparatus to entrust a serviceman with maintenance. Today, however, many ordinary users own image forming apparatuses because of the decreasing size and cost of the apparatuses. The spread of image forming apparatuses forces a single serviceman to deal with a prohibitive number of apparatuses, increasing the interval between a user's call for a serviceman and the arrival of the serviceman at the user's station. It is therefore difficult for a serviceman to maintain image forming apparatuses situated at users' stations one by one.

On the other hand, the expansion of international transport means and trade has accelerated overseas production and export of image forming apparatuses. A service system relating to image forming apparatuses greatly depends on the country. This, coupled with the fact that the interval between a user's call for a serviceman and the arrival of the serviceman depends on the distance, obstructs a timely service.

Under the above circumstances, maintenance by users will become predominant over maintenance by servicemen in the future. At the same time, replacement of defective parts will replace repair of defective parts, so even unskilled users can maintain image forming apparatuses by themselves. In this sense, there is an increasing demand for technologies that allow users to easily maintain the expected operations of image forming apparatuses.

Japanese Patent Laid-Open Publication No. 2000-75733, for example, discloses a process cartridge including a photoconductive element or image carrier, a charger, a cleaning device and so forth therein. The process cartridge is removably mounted to the body of an image forming apparatus and should only be bodily replaced in the event of a trouble or at the time of replacement. This can be done even by an ordinary user.

More specifically, the process cartridge, a photoconductive element and the case of a cleaning device, which rotatably supports the element, are constructed integrally with each other. The cleaning case is loaded with process means for executing image formation with the photoconductive element. The process means include a charge roller for uniformly charging the photoconductive element and a cleaning blade and a cleaning roller that cooperate to scrape off toner left on the element after image transfer to a paper sheet or similar recording medium. Such process means are arranged around the photoconductive element.

Japanese Patent Laid-Open Publication Nos. 10-177286 and 11-295952 each disclose a recording system including two image stations. At each image station, a developing device, a writing device and drive means are supported by an apparatus body via positioning members and accurately positioned relative to each other thereby. Because the developing device is positioned relative to the apparatus body, it constitutes a reference position for the entire process devices. In this case, a photoconductive element (or photoconductive element unit) is not mounted to the apparatus body, but is mounted to the developing device. The photoconductive element is therefore positioned relative only to the developing device. The photoconductive element is removable from the developing device while the developing device is removable from the apparatus body. Further, the photoconductive element and cleaning means are constructed integrally with each other.

However, the problem with the process cartridge is that when only part of the cartridge, e.g., the photoconductive element or any one of image forming members fails, the cartridge must be bodily replaced. Discarding even usable members increases the running cost of the apparatus and is apt to obstruct the spread of image forming apparatuses.

In parallel with the increasing demand for an advanced image forming apparatus, loads on an image forming device are increasing. We conducted a series of researches to find that the demand increasing on the market aggravated loads on a photoconductive element, among others. This is generally ascribable to three different causes, which will be described hereinafter.

A first cause is a decrease in the diameter of a photoconductive drum, which is a specific form of a photoconductive element, essential for the miniaturization of an image forming apparatus. Specifically, when a photoconductive drum is reduced in diameter, the exhaustion of the drum for a single sheet is accelerated for preselected image forming conditions. For example, when the drum diameter is reduced from 120 mm to 40 mm, the drum must make three times greater number of rotations for a given image size. Consequently, the electrical exhaustion ascribable to, e.g., discharge and mechanical exhaustion ascribable to a cleaning blade are tripled. Miniaturization has proceeded with, e.g., the image forming means of a developing device to a certain degree, but not with a photoconductive drum from the above-described exhaustion standpoint.

A second cause is a decrease in the thickness of a photoconductor film essential for high image quality. Today, image quality is approaching one achievable with a silver halide sensitive type of film in order to cope with photographic images and graphic documents. A typical implementation for realizing such high image quality is increasing resolution. However, when it comes to an electrophotographic system, high resolution is not attainable without resorting to a thin photoconductor film. For example, in the case of a photoconductor chargeable to negative polarity, a carrier generated in a CGL (Charge Carrier Generation Layer) by exposure is transported to the surface of the photoconductor via a CTL (Charge Carrier Transport Layer) to thereby form a latent image. If the CTL is thick, then the distance of migration of the carrier increases and causes the carrier to part due to electric repulsion. This prevents a latent image from being accurately formed in accordance with a signal and results in an image whose dots are dislocated.

The problem discussed above arises not only when electrophotographic resolution is increased from 600 dpi (dots per inch) to 1200 dpi, but also when it is desire to enhance image quality while maintaining the resolution of 600 dip in order to meet the current demand for high image quality. To solve the above problem, it is necessary to reduce the thickness of the photoconductor film and therefore the distance of migration of the carrier. However, the photoconductor film is shaved or otherwise exhausted every time an image is formed thereon. A thinner semiconductor film therefore is shorter in life, i.e., it withstands only a smaller number of times of image formation. Moreover, assume that the photoconductor film is scratched or otherwise damaged at the time of removal of a jamming sheet or due to a stapler left on a document. Then, the drum must be immediately replaced in order to maintain expected image equality.

A third cause is an increase in loads on the photoconductive drum ascribable to the trend toward color image formation. Today, color images are increasingly used because information printed thereon are easy to understand. A color image differs from a black-and-white image in that a photographic image or a graphic image occupying a broad area on a sheet is often output. In addition, a color image often includes a solid background area. As a result, an image area increases for one time of image formation and aggravates the exhaustion of the image forming means including the photoconductive drum.

An image forming apparatus with a revolver type developing device is conventional. This type of developing device includes a plurality of developing chambers that selectively face a photoconductive drum. The image forming apparatus with the revolver is extensively used because it forms a color image at relatively low cost with a small number of parts. However, a photoconductive element included in this type of apparatus exhausts several times more than each developing chamber because it is subject to a plurality of developing chambers.

The three causes described above will reduce the life of a photoconductive drum relative to the life of the other image forming means. While various studies are under way to enhance the durability and life of a photoconductive element, studies are also under way to enhance the durability and life of the other image forming means. There is a tendency that the life of a photoconductive element decreases relative to the life of the other image forming means. This tendency disturbs the balance between the photoconductive drum and the other image forming means in the process cartridge as to life. The problem with the process cartridge heretofore pointed out is that the cartridge must be replaced with priority given to image forming means having the shortest life. The problem becomes more serious with a decrease in the life of the photoconductive drum; even image forming means still usable must be discarded together with the photoconductive element. This increases the user's expenses, wastes the manufacturer's labor necessary for collection, and brings about environmental pollution.

Particularly, various technologies for extending the life of a developer have recently been reported in the imaging art in order to reduce toner filming and carrier exhaustion. This makes the life of the photoconductive element and that of the developing device unbalanced.

In light of the above, each image forming means included in an image forming apparatus should preferably be removable from the apparatus independently of the other image forming means. However, considering the future trend toward user-oriented maintenance, how simply the user can replace each image forming means is the problem. Further, the different image forming means should be mounted to or dismounted from each other at the time of replacement. It follows that the replacement must be accurate enough to protect image formation from adverse influence before and after replacement.

To solve the problems particular to a process cartridge, Japanese Patent Laid-Open Publication No. 62-17761 discloses a copier including an image carrier and a developing device removable from a copier body independently of each other. This configuration is directed toward user-oriented maintenance available with a low running cost. Such a means-by-means removal scheme, however, cannot clearly show the user unaccustomed to an image forming apparatus which part of the apparatus should be dismounted alone. Further, when one of the developing device and image carrier is dismounted from the copier body, it is likely that the other of them is dislocated. It is difficult for the user to accurately position the developing device and image carrier relative to each other. It is true that the developing device and image carrier are mounted to the copier body independently of each other, and therefore each means is positioned relative to the copier body. However, the relative position between the developing device and the image carrier is apt to vary before and after replacement and effect image quality. Relative position between the developing device and the image carrier is a decisive factor in the image quality aspect.

It is necessary with the copier taught in the above Laid-Open Publication No. 62-17761 to provide the individual part with accuracy high enough to insure accurate relative position between the developing device and the image carrier. This results in an increase in cost. This is also true with technologies proposed in Japanese Patent Laid-Open Publication No. 61-273559 and similar to the technology of the above document.

As stated above, conventional technologies are not user friendly and are apt to vary image quality before and after replacement.

SUMMARY OF THE INVENTION

It is therefore an object of the present invention to provide an image forming apparatus capable of reducing loads on users, manufacturers and environment by giving priority to image forming means having the shortest life with respect to replacement.

It is another object of the present invention to provide an image forming apparatus allowing the user of the apparatus to accurately replace the individual image forming means without effecting image quality.

In accordance with the present invention, in an image forming apparatus including at least an image carrier, a charger, an exposing unit and a developing device, at least one of them is inhibited from being unlocked from the apparatus when the image carrier is present on the apparatus or is allowed to be unlocked from the apparatus when the image carrier is absent on the apparatus.

Also, in accordance with the present invention, a method of dismounting an image carrier and a developing device from an image forming apparatus includes the steps of dismounting the image carrier from the image forming apparatus to thereby unlock the developing device from the image forming apparatus, and dismounting the developing device from the image forming apparatus.

Further, in accordance with the present invention, in the body of an image forming section removably mounted to an image forming apparatus and including at least one of a charger, a developing device, a discharger and a cleaning device adjoining an image carrier, the image carrier is removable.

Moreover, in accordance with the present invention, in an image carrier for forming a latent image thereon, an image forming section includes at least one of a charger, an exposing unit and a developing device is removably mounted to an image forming apparatus. The image carrier is allowed to be mounted to or dismounted from the image forming section after the image forming section has been locked to the image forming apparatus.

BRIEF DESCRIPTION OF THE DRAWINGS

The above and other objects, features and advantages of the present invention will become more apparent from the following detailed description taken with the accompanying drawings in which:

FIG. 4A-1 is a view showing the internal arrangement of the body as seen from the rear;

FIG. 4A-2 is a plan view showing the internal arrangement of the body;

FIG. 4A-3 is a view showing the internal arrangement of the body as seen from the front;

FIG. 4B-1 is a plan view showing a rear side wall included in the body;

FIG. 4B-2 is a partly sectioned plan view showing the side wall;

FIG. 4B-3 is a front view showing a front side wall also included in the body;

FIG. 6A-1 is a front view showing the rear side wall of the body mounted on the apparatus;

FIG. 6A-2 is a plan view of the rear side wall and a front side wall also included in the body;

FIG. 6A-3 is a front view of the front side wall;

FIG. 6B-1 is a front view showing the rear side wall of the body with a handle being operated;

FIG. 6B-2 is a plan view showing the side walls of the body with the handle being operated;

FIG. 6B-3 is a front view showing the front side wall of the body with the handle being operated;

FIG. 9A-1 is a front view showing the screw connecting member connecting screws;

FIG. 9A-2 is an isometric view of the screw connecting member connecting the screws;

FIG. 9B-1 is a front view of the screw connecting member disconnecting the screws;

FIG. 9B-2 is an isometric view of the screw connecting member disconnecting the screws;

DESCRIPTION OF THE PREFERRED EMBODIMENTS

Figure 1:
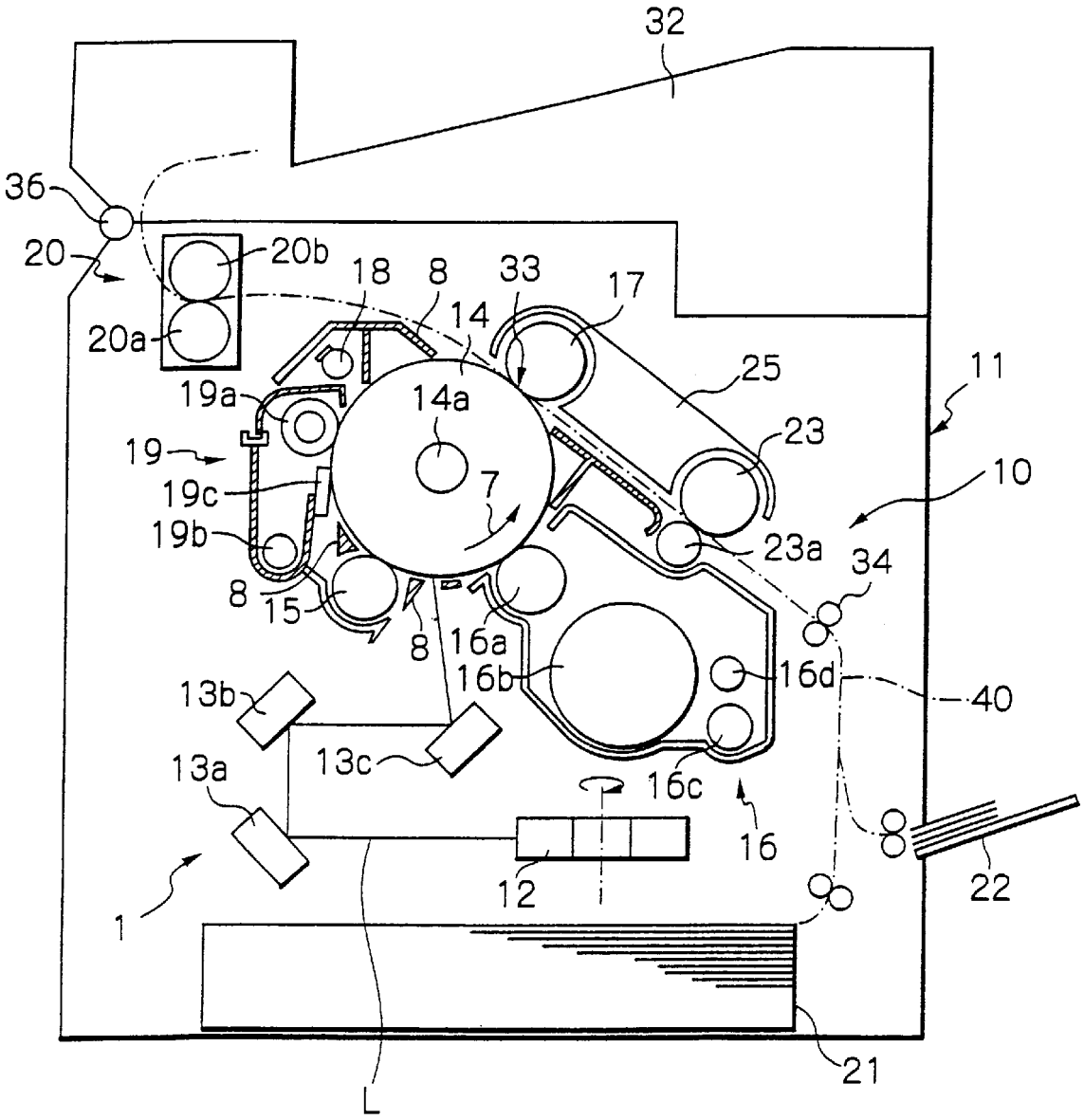
FIG. 1 is a view showing the general construction of an image forming apparatus embodying the present invention.
Figure 2:
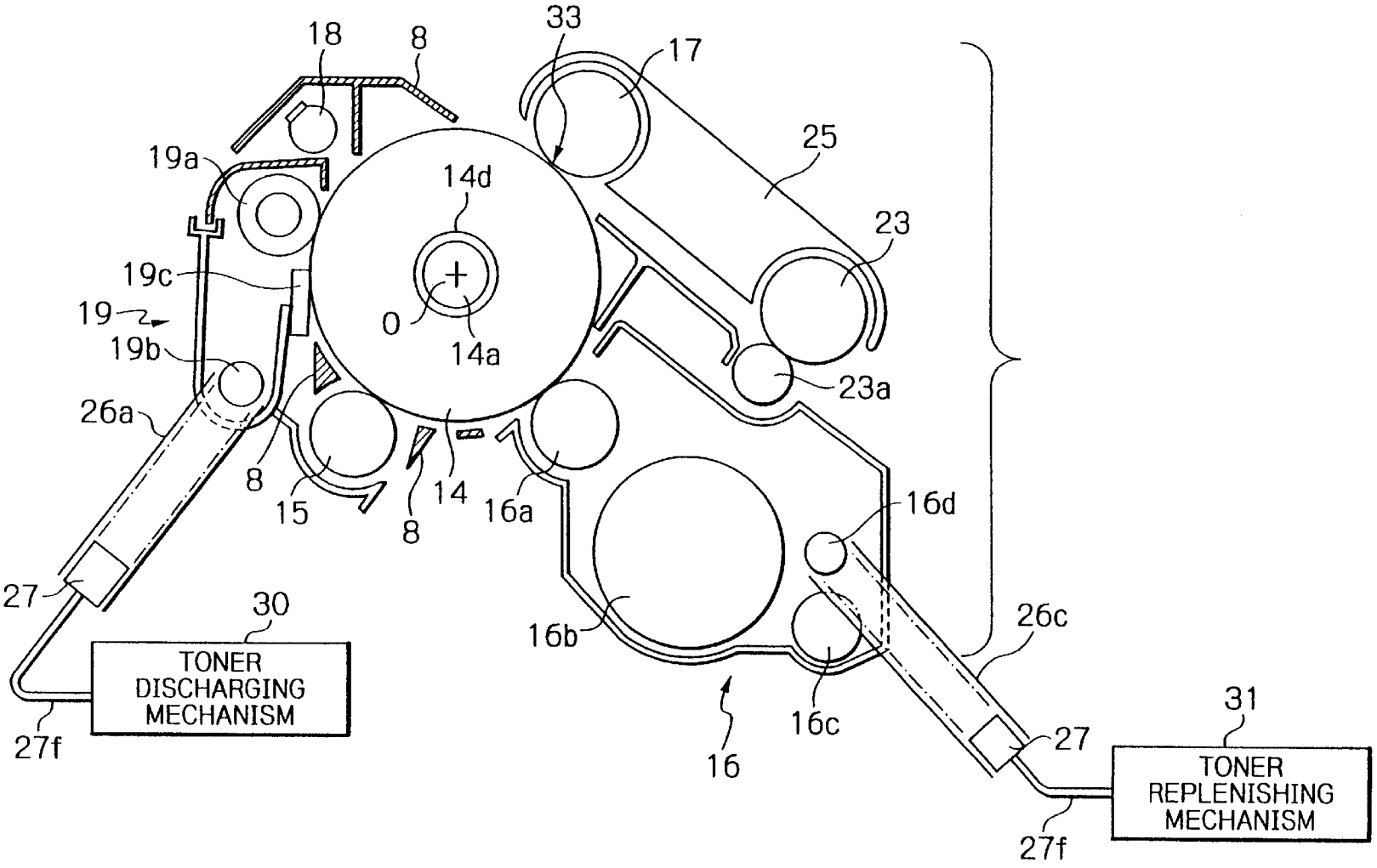
FIG. 2 is a view showing an image forming section included in the illustrative embodiment.

Referring to FIGS. 1 and 2, an image forming apparatus embodying the present invention is shown and implemented as a laser beam printer by way of example. As shown, the image forming apparatus, generally 11, includes an optical writing section or exposing means 1 including a light source, not shown, a polygonal mirror 12, and mirrors 13*a*, 13*b* and 13*c*. An image forming section 10 includes a photoconductive drum or image carrier 14, a charger or charging means 15, a developing device 16, an image transferring device 17, a quenching lamp or discharging means 18, and a cleaning device 19. A fixing device 20 includes a heat roller 20*b* and a press roller 20*a* pressed against the heat roller 20*b*.

A sheet tray 21 is positioned on the bottom of the apparatus 11 and loaded with a stack of paper sheets or similar recording media. The paper sheets are sequentially fed from the tray 21 one by one. A manual feed tray 22 is mounted on one side of the apparatus 11 for allowing the operator of the apparatus 11 to feed relatively thick sheets, OHP (OverHead Projector) films or similar special recording media by hand. A recording medium (sheet hereinafter) is fed from either one of the trays 21 and 22 to a registration roller pair 34. The registration roller pair 34 once stops the sheet and then drives it toward an image transfer position 33, which will be described later, at a preselected timing.

The image transfer position 33 is located obliquely above the drum 14 at the right-hand side of the drum 14. A sheet path 40 is arranged above the drum 14 at the side opposite to the side where the image forming means (charger 15, developing device 16, cleaning device 19, writing section 1 and so forth) is arranged. The sheet path 40 therefore allows the operator to easily remove a sheet jamming the path 40. The sheet path 40 may be arranged at any other position so long as it does not extend below the drum 14.

FIG. 2 shows the image forming section 10 in detail. As shown, the drum 14 is configured integrally with a shaft 14*a* that is rotatably supported by bearings 14*d* (only one is visible). The developing device 16 stores, e.g., a toner and carrier mixture, i.e., a two-ingredient type developer therein. A first and a second screw 16*b* and 16*c* and a developing roller 16*a* are positioned in the developing device 16. The screws 16*b* and 16*c* agitate the developer while the developing roller 16*a* conveys the developer to a developing position where the drum 14 and developing device 16 face each other.

The cleaning device 19 includes a cleaning blade 19*c*, a seal roller 19*a*, and a screw 19*b*. The cleaning blade 19*c* is held in contact with the drum 14 for removing toner left on the drum 14 after image transfer. The seal roller 19*a* prevents toner, which flies about due to a shock imparted from the cleaning blade 19*c* to the drum 14, from flying out of the cleaning device 19. The screw 19*b* returns the toner collected by the cleaning device 19 to the developing device 16 as recycled toner.

In operation, the drum 14 is rotated in a direction indicated by an arrow 7 in FIG. 1. The charger 15 uniformly charges the surface of the drum 14 in rotation. The light source, not shown, emits a light beam L in accordance with image data. The light beam L is incident to the charged surface of the drum 14 via a collimator lens, not shown, the polygonal mirror 12, and mirrors 13*a* through 13*c*. As a result, a latent image is electrostatically formed on the drum 14.

The developing device 16 develops the latent image conveyed thereto by the drum 14 to thereby form a corresponding toner image. More specifically, the first and second screws 16*b* and 16*c* agitate the developer to thereby charge the carrier and toner to positive polarity and negative polarity, respectively. A magnet roller, not shown, disposed in the developing roller 16*a* scoops up the charged developer to the developing roller 16*a*. A magnetic pole for development, which is included in the magnet roller, causes the developer deposited on the developing roller 16*a* to form a magnet brush at the developing position between the roller 16*a* and the drum 14. A bias for development causes the toner to deposit on the latent image formed on the drum 14 and form a toner image.

A sheet is fed from the sheet tray 21 or the manual feed tray 22 along the sheet path 40 in synchronism with the rotation of the drum 14. At the image transfer position 33, the image transferring device 17 transfers the toner image from the drum 14 to the sheet. In the illustrative embodiment, the image transferring device 17 is implemented as a roller having a charging function. The fixing device 20 fixes the toner image on the sheet. The sheet with the fixed toner image is driven out of the apparatus along a path indicated by a dash-and-dot line in FIG. 1.

After the image transfer, the quenching lamp 18 discharges the surface of the drum 14. Subsequently, the cleaning device 19 collects the toner left on the drum 14. More specifically, the cleaning blade 19*c* scrapes off the toner left on the drum 14. The toner caused to fly about by a shock ascribable to the contact of the cleaning blade 19*c* with the drum 14 deposits on the seal roller 19*a* and therefore does not fly out of the cleaning device 19. The screw 19*b* conveys the toner collected from the drum 14 to the outside of the cleaning device 19.

The image forming section 10 includes at least the drum 14 (or a drum cassette 6 to be described later), charger 15, developing device 16, image transferring device 17, discharging means 18 and cleaning device 19, as stated earlier. The drum 14, developing device 16, image transferring device 17 and cleaning device 19 each entirely or partly belong to any one of units that are removable from the apparatus 11 independently of each other. In the illustrative embodiment, the image forming section 10 except for the drum 14 is constructed into a unit, which will be referred to as the body 5 of the image forming section 10 (see FIG. 3). The charger 15, developing device 16, discharging means 18, cleaning device 19 and so forth each are removably mounted on the body 5.

The body 5 including the charger 15, developing device 16, discharging means 18 and cleaning device 19 is bodily removable from the apparatus 11, promoting the easy maintenance of the individual component. The drum 14 is removably mounted to the body 5, completing the image forming section 10.

In the illustrative embodiment, although the body 5 can be mounted and dismounted from the apparatus 11, the former cannot be mounted to or dismounted from the latter when the drum 14 exists in the body 5. Specifically, the drum 14 can be mounted to the body 5 only after the body 5 has been mounted to the apparatus 11. Stated another way, the body 5 exists in the apparatus 11 when the drum 14 is mounted to the body 5. Therefore, mounting the drum 14 to the body 5 is equivalent to mounting the drum 14 to the apparatus 11.

Also, the body 5 including the developing device 16 can be dismounted from the apparatus 11 only after the drum 14 has been dismounted from the body 5. Stated another way, the body 5 still exists in the apparatus 11 when the drum 14 is dismounted from the body 5. Therefore, dismounting the drum 14 from the body 5 is equivalent to dismounting the drum 14 from the apparatus 11.

The mounting order and dismounting order described above allow the user of the apparatus 11 to easily mount and dismount the units without mishandling. Further, not all of the various image forming means for forming an image on the drum 14 are replaced together. The user can therefore easily replace the drum 14, among the others, whose service life is short. In addition, the drum 14 can be dismounted earlier than the developing device whose life is longer than at least the life of the drum 14.

The drum 14 may be implemented as a single unit together with its shaft and bearings supporting the shaft. A framework 8 for protecting the drum 14 may be added to the above unit, constituting a drum cassette or image carrier cassette 6 (see FIG. 3C). The drum cassette 6 is separate from the unit including the charger 15, writing section 1, developing device 16 and so forth. The following description will concentrate on the drum cassette 6 removably mounted on the body 5 by way of example.

Figure 3A:
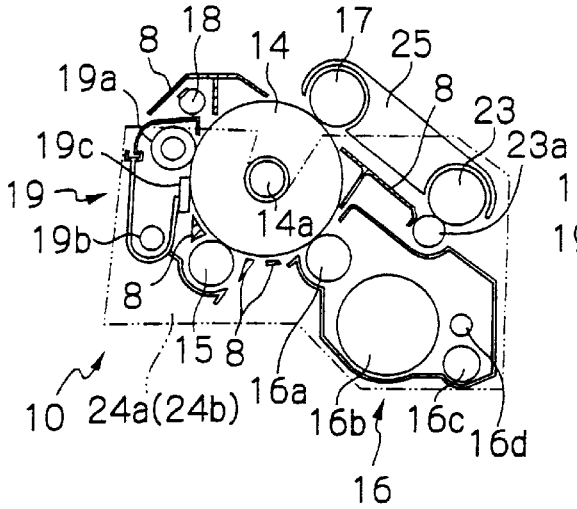
FIG. 3A is a front view showing the body of the image forming section with a support member thereof being closed.

How the drum 14 is removed from the image forming means 9 will be described with reference to FIGS. 3A through 3C. As shown in FIG. 3A, the image forming section 10 has its charger 15, developing device 16, discharging means 18, cleaning device 19 and other process members supported by a pair of plastic, side walls 24*a* and 24*b* (only 24*a* is visible). The image transferring device 17 is another process unit that transfers a toner image from the drum 14 to a sheet.

Figure 3B:
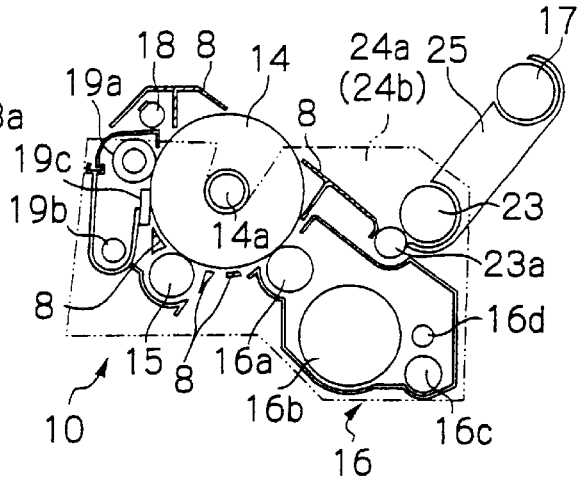
FIG. 3B is a front view similar to FIG. 3A showing the body with the support member being opened.

Specifically, as shown in FIGS. 3A and 3B, a sheet feed roller 23 included a shaft, not shown, journalled to the upper portions of the side walls 24*a* and 24*b*. A roller 23*a* is held in contact with the sheet feed roller 23. A support member 25 is angularly movably mounted on the shaft of the sheet feed roller 23 at one end thereof. The image transferring device (image transfer roller hereinafter) 17 is rotatably supported by the other end of the support member 25 and held in contact with the drum 14. In this configuration, the support member 25 is angularly movable about the shaft of the sheet feed roller 23, selectively moving the image transfer drum 17 into or out of contact with the drum 14.

As shown in FIG. 3B, to remove the drum 14 from the image forming section 10, the support member 25 with the image transfer roller 17 is angularly moved about the shaft of the sheet feed roller 23 away from the drum 14. In this condition, the drum cassette 6 can be dismounted without interfering with the image transfer drum 17. Subsequently, as shown in FIG. 3C, the drum cassette 6 is removed from the body 5 upward. In the illustrative embodiment, as shown in FIG. 3, the drum cassette 6 includes the drum 14, bearings 14*d* supporting the drum 14, and framework 8 supporting the drum 14 via the bearings 14*d*. The drum 14 is therefore mounted and dismounted from the body 5 as part of the drum cassette 6.

Figure 3C:
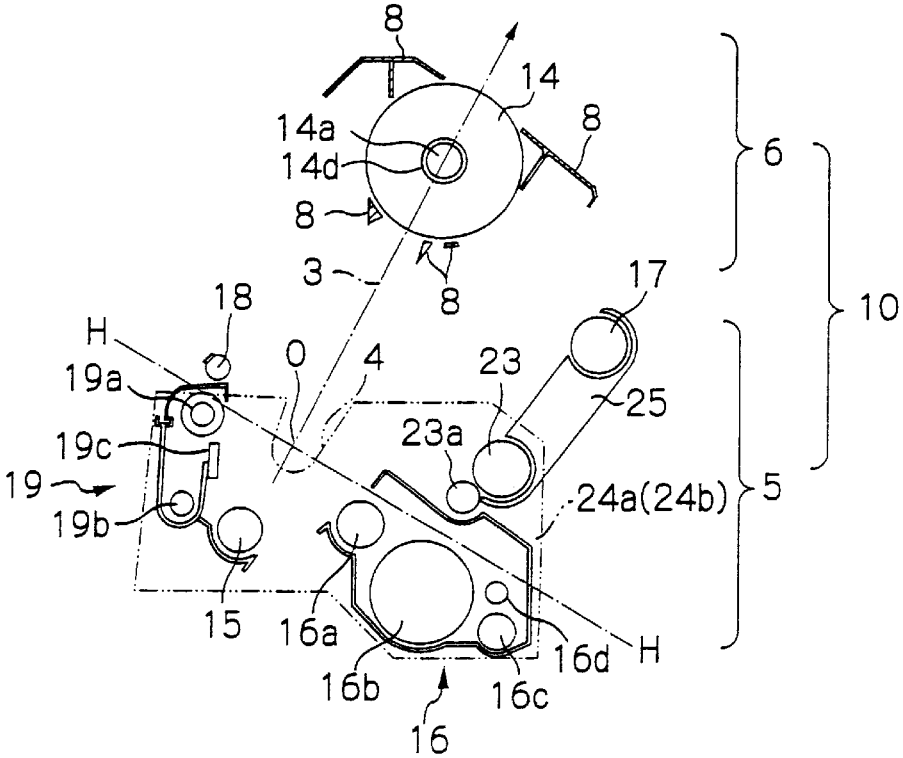
FIG. 3C is a front view showing the body with a drum cassette being dismounted.

As shown in FIG. 3C, the drum cassette 6 is removed from the body 5 in such a direction that it moves away from the axis O' of the shaft 14*a* of the drum 14 set in a preselected operative position. This particular direction allows the drum 14 to be pulled out of the image forming means, which are arranged around the axis O', without interfering with the side walls 24*a* and 24*b*. More specifically, the side walls 24*a* and 24*d* each are formed with a notch 4 for receiving the shaft 14*a* of the drum 14. The notch 4 extends obliquely upward, i.e., in a direction 3 in which the drum 14 is removed. It follows that the drum 14 can be easily mounted and dismounted from the body 5 without any image forming means being moved.

Figures 1, 4A:
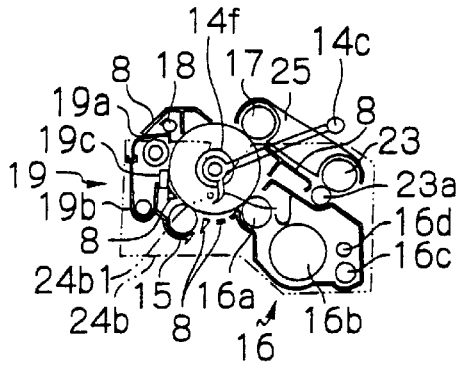
Figures 1, 4B:
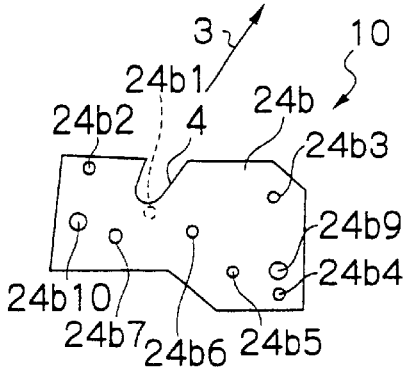
Figures 2, 4A:
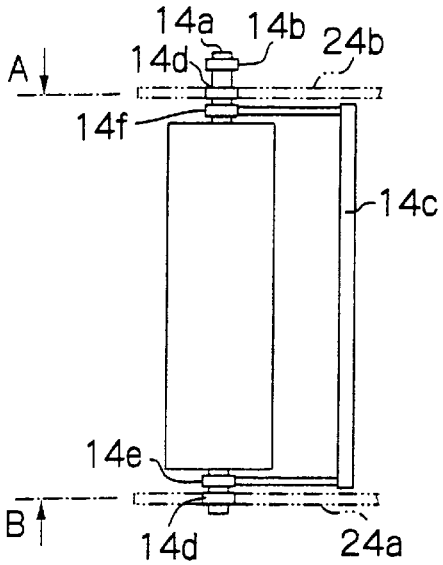
Figures 2, 4B:
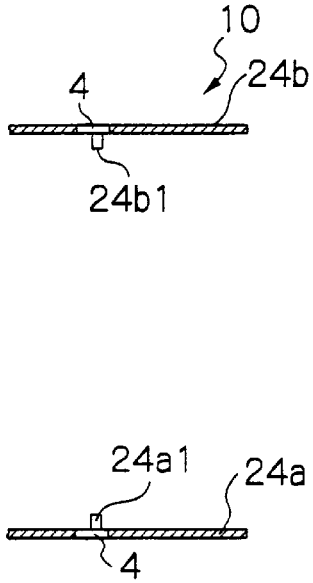
Figures 3, 4A:
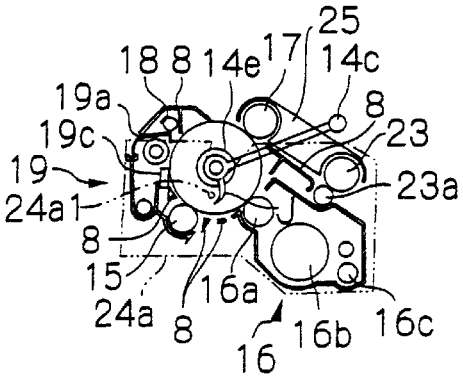
Figures 3, 4B:
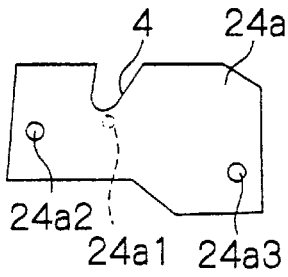

Reference will be made to FIGS. 4A-1 through 4A-3, 4B-1 through 4B-3 and 5A through 5D for describing more specific arrangements for implementing the operation shown in FIGS. 3A through 3C. FIGS. 4A-1 through 4A-3 show the image forming section 10 affixed to the apparatus 11. FIGS. 5A through 5D demonstrate how the drum cassette 6 is removed from the body 5.

Specifically, FIGS. 4A-1 through 4A-3 mainly show the image forming means arranged in the image forming section 10 while FIGS. 4B-1 through 4B-3 mainly show the side walls 24*a* and 24*b* of the section 10. While FIGS. 4A-2 and 4B-2 are top plan views, FIG. 4A-2 does not show members other than the drum 14 or image forming means for easy understanding. FIG. 4A-1 shows the image forming section as seen in a direction A shown in FIG. 4A-2. FIG. 4A-3 shows the side wall 24*a* as seen in a direction B also shown in FIG. 4A-2. FIG. 4B-1 shows the side wall 24*b* as seen in the direction A while FIG. 4B-3 shows the image forming section 10 as seen in the direction B. It should be noted that FIGS. 4A-1 and 4B-1 each show the image forming section 10 symmetrically in the right-and-left direction with respect to the view as seen in the direction B.

As shown in FIGS. 3A through 3C, the side walls 24*a* and 24*b* sandwich the image forming section 10 in the axial direction of the drum 14, which is perpendicular to the sheet surface of the above figures. The bearings 14*d* supporting the shaft 14*a* of the drum 14 are received in the U-shaped notches 4 formed in the side walls 24*a* and 24*b*, as stated earlier. Also, the charger 15, developing device 16, image transfer drum 17, discharging means 18 and cleaning device 19 are supported by the side walls 24*a* and 24*b*.

A motor, not shown, mounted on the apparatus body drives the developing roller 16*a*, two screws 16*b* and 16*c*, sheet feed roller 23, charger 15, seal roller 19*a* and screw 19*b* as well as a toner replenishing screw 16*d* shown in FIG. 2. The shafts of these members are journalled to the front side wall 24*a* at one end and passed through the rear side wall 24*b* to the outside of the image forming section 10 at the other end. As shown in FIG. 4B-1, the rear side wall 24*b* is formed with holes 24*b*6, 24*b*5, 24*b*4, 24*b*9, 24*b*3, 24*b*7, 24*b*2 and 24*b*10 respectively assigned to the developing roller 16*a*, screw 16*b*, screw 16*c*, toner replenishing screw 16*d*, registration roller, charger 15, seal roller 19*a*, and screw 29*b*. The shafts of these rotatable members are operatively connected to the motor outside of the side wall 24*b* via gears. The shaft of the image transfer roller 17 is also operatively connected to the motor via gears.

As shown in FIG. 4B-3, the front side wall 24*a* is formed with holes 24*a*-2 and 24*a*3. Fresh toner is replenished from a toner hopper, not shown, via the hole 24*a*2. The toner collected from the drum 14 is delivered to a recycling mechanism, not shown, via the hole 24*a*3. The recycling mechanism returns the collected toner to the developing device 16.

As shown in FIG. 4A-2, a front and a rear positioning lock 14*e* and 14*f*, or locking means, are angularly movably mounted on the shaft 14*a* of the drum 14. The positioning locks 14*e* and 14*e* each include a hook J. The positioning locks 14*e* and 14*f* with the hooks J constitute drum (image carrier) holding means or drum (image carrier) cassette holding means, as the case may be. The positioning locks 14*e* and 14*f* are formed integrally with a generally U-shaped handle 14*c*.

Assume that the body 5 of the image forming section is mounted to the apparatus 11, and then the drum cassette 6 is mounted to the body 5. Then, the handle 14*c* is angularly moved by hand. The handle 14*c* then covers and presses the support member 25 to thereby position it above the drum 14. At the same time, the handle 14*c* causes the hooks J of the front and rear positioning locks 14*e* and 14*f* to engage with pins 24*a* and 24*b* respectively studded on the inner surfaces of the side walls 24*a* and 24*b*. As a result, the drum 14 itself is locked to the body 5. That is, the drum holding means surely positions a new drum relative to the apparatus 11. The drum 14 can be easily unlocked from the body 6 when the above procedure is performed in the reverse order.

As stated above, the handle 14*c* not only allows the drum cassette 6 to be held by hand, but also locks the image transfer drum 17 and drum cassette 6 to the body 5 when angularly moved in one direction. Further, the handle 14*c* unlocks the image transfer drum 17 and drum cassette 6 from the body 5 when angularly moved in the other direction. Therefore, simple operation suffices for preparing the apparatus 11 for the mounting or dismounting the drum 14.

After the image forming section 10 has been mounted to the apparatus 11, the motor drives the drum 14 via gear portion 14*b* included in the drum 14.

Figure 20:
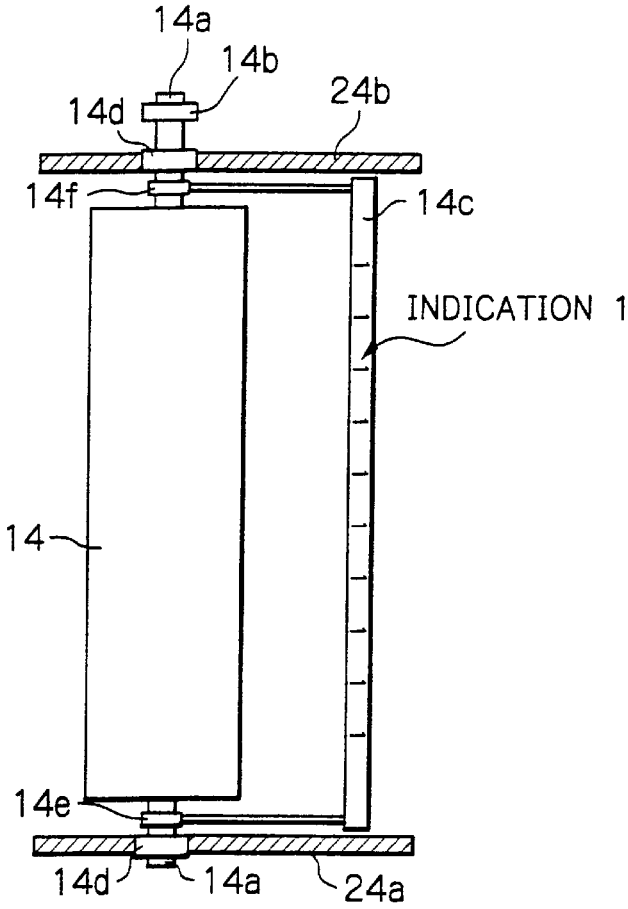
FIGS. 20 and 21 are plan views each showing a specific indication together with the drum cassette mounted on the body of the image forming section.

An indication or indicating means showing the operator the mounting and dismounting orders is provided on the surface of the handle 14*c* that is visible when the drum cassette 6 is mounted to the apparatus 11. The indication may be provided in any suitable form so long as it shows the user the above orders. In the illustrative embodiment, as shown in FIG. 20, numeral 1 is directly printed on the handle 14*c*. Other specific indications are, e.g., a message "Pull this toward you." printed on the handle 14*c*, a picture displayed on an operation panel, not shown, and a speech. As for the picture or the speech, a sensor responsive to the mounting of the drum cassette 6 may be used.

Figure 5A:
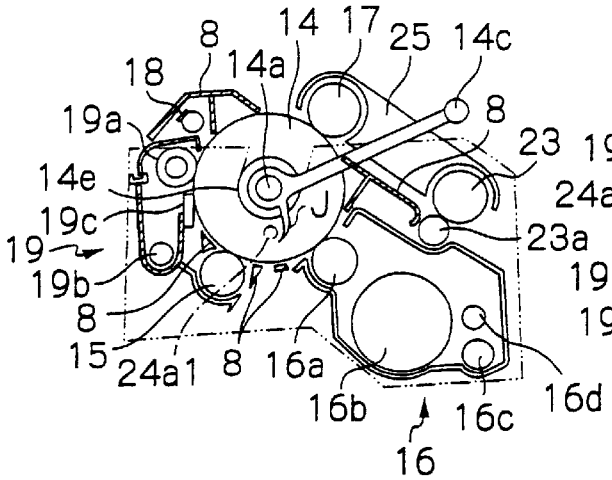
FIG. 5A is a front view showing the internal arrangement of the body with a drum being mounted thereto.
Figure 5B:
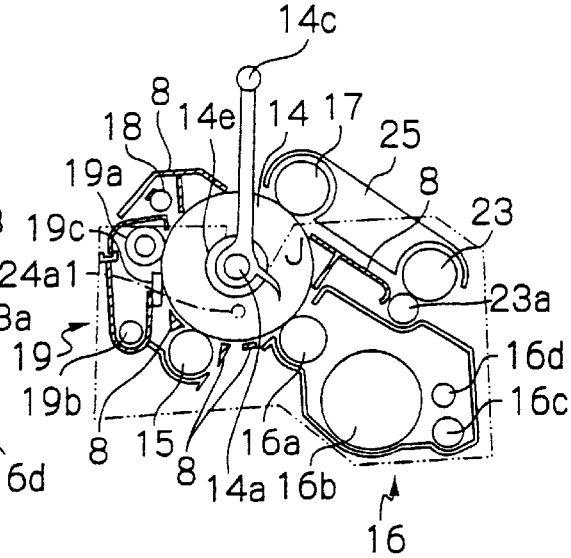
FIG. 5B is a front view showing the internal arrangement of the body with a support member being unlocked.
Figure 5C:
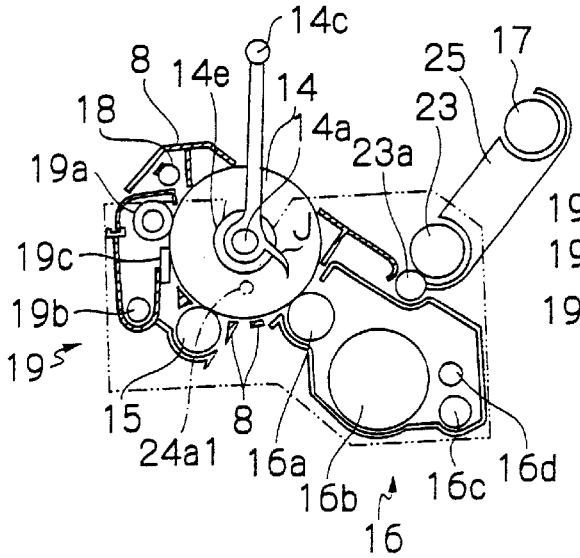
FIG. 5C is a front view showing the internal arrangement of the body with the support member being raised.
Figure 5D:
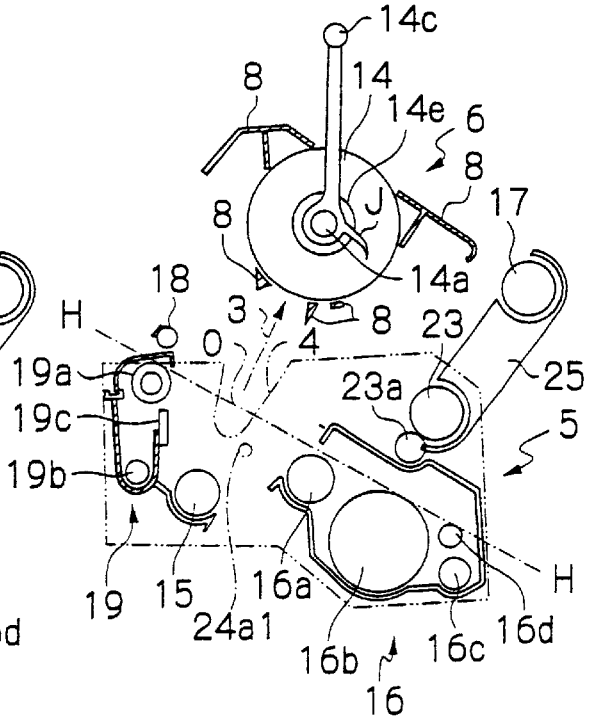
FIG. 5D is a front view showing the body and a drum cassette dismounted from the body.

A procedure for dismounting the drum 14 from the body 5 will be described hereinafter. First, as shown in FIG. 5A, the operator grips the handle 14*c*. As shown in FIG. 5B, the operator then turns the handle 14*c* about the shaft 14*a* counterclockwise in accordance with the indication "1". As a result, the positioning locks 14*e* and 14*f* are released from the pins 241*a* and 241*b*, respectively, unlocking the support member 25. As shown in FIG. 5C, the operator turns the support member 25 about the sheet feed roller 23 upward, i.e., clockwise. As shown in FIG. 5D, the operator then takes out the drum cassette 6 from the body 5.

To mount a new drum 14, the operator sets the bearings 14*d* of a new drum cassette 6 in the U-shaped notches of the side walls 24*a* and 24*b* (FIG. 5C). The operator then turns the support member 25 downward to the position above the drum 14 (FIG. 5B). Subsequently, the operator turns the handle 14*c* onto the support member 25 (FIG. 5A). As a result, the handle 14*c* positions the support member 25 and positions the drum 14 itself with the positioning locks 14*e* and 14*f* engaging with the pins 24*a*1 and 24*b*1, respectively.

As stated above, the operator can easily, efficiently mount and dismount the drum 14, which is one of expendables, from the body 5 simply by turning the handle 14*c*. This is particularly true with the drum cassette 6 that is pulled out of the body 5 upward. Moreover, an image can be accurately formed because the body 5 and drum 14 are positioned relative to each other more accurately via the positioning locks 14*e* and 14*f* than in a conventional apparatus in which the body 5 and drum 14 are individually positioned via the apparatus.

In the illustrative embodiment, as shown in FIGS. 3C and 5D, the image forming means including the charger 15, developing device 16, discharging means 18 and cleaning device 19 adjoin the drum 14 at the side opposite to the side where the drum cassette 6 is to be dismounted in the direction 3. More specifically, in FIGS. 3C and 5D, assume an imaginary plane perpendicular to the direction 3 and contains the axis O of the shaft 14*a* of the drum 14. Then, the side opposite to the side where the drum cassette 6 is to be pulled out in the direction 3 refers to a region downstream of the above imaginary plane in the direction 3. Therefore, no image forming means is present in the range of movement of the drum 14. This allows the operator to easily mount and dismount the drum cassette 6 from the apparatus 11. As shown in FIG. 3C, although the image transfer roller 17 is positioned at the side where the drum cassette 6 is to be pulled out, it is angularly movable about the axis of the sheet feed roller 23 away from the drum cassette 6 and therefore does not interfere with the cassette 6.

If desired, a spring or similar biasing means may constantly bias the support member 25 such that it automatically causes the support member 25 to move upward when the handle 14*c* is turned by hand.

The image forming means including the charger 15, developing device 16, discharging means 18 and cleaning device 19 are supported by the side walls 24*a* and 24*b*, constituting the body 5 of the image forming section. The drum cassette 6 including the drum 14 is removably mounted to such a unit. Therefore, when an error occurs in the image forming means, it is possible to remove the drum cassette 6 from the body 5 and then remove the body 5 from the apparatus 11. Any one of the charger 15, developing device 16, discharging device 18 and cleaning device 19 in which an error has occurred can be easily dealt with.

The developing device 16 is mounted on the body 5. Therefore, when the drum 14 is mounted to the apparatus 11, the developing device 16 has already been affixed to the apparatus 11 via the body 5, so that the drum 14 is mounted to the apparatus via the body 5. Consequently, when the drum 14 is mounted to or dismounted from the apparatus 11, the developing device 16 remains affixed to the apparatus 11 via the body 5. This prevents the developing device 16 from being dislocated before and after the replacement of the drum 14. Further, because the drum 14 is mounted to the body 5, it is adequately positioned relative to the developing device 16.

Figures 1, 6A:
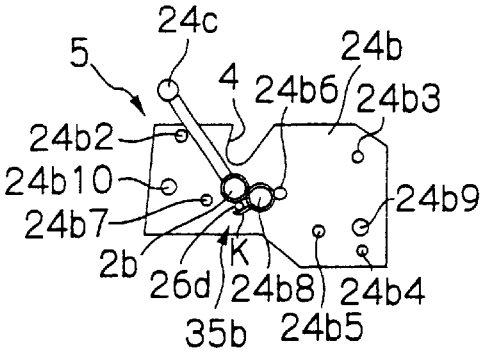
Figures 1, 6B:
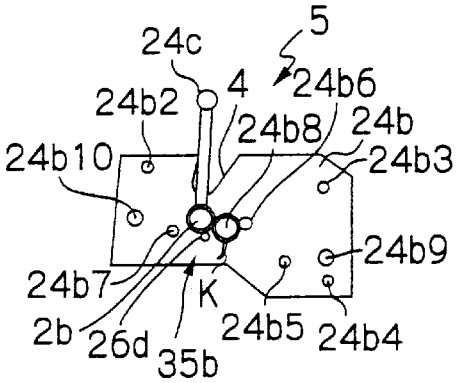
Figures 2, 6A:
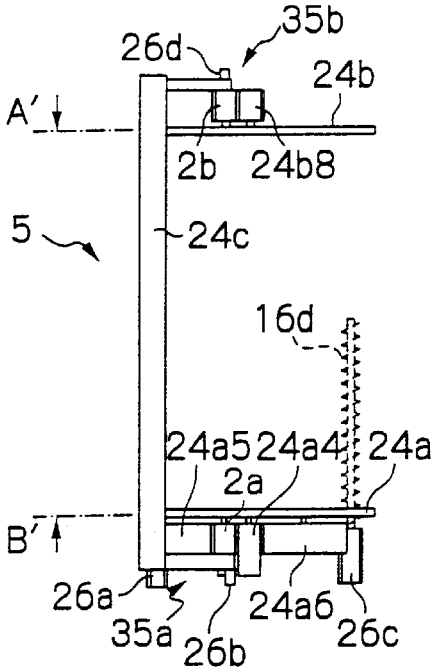
Figures 2, 6B:
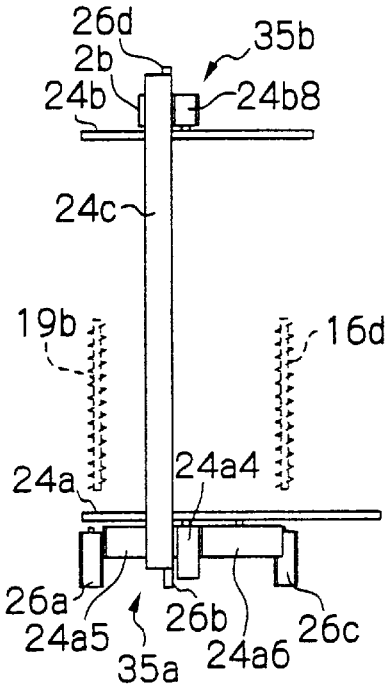
Figures 3, 6A:
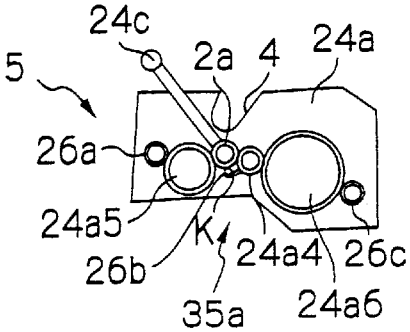
Figures 3, 6B:
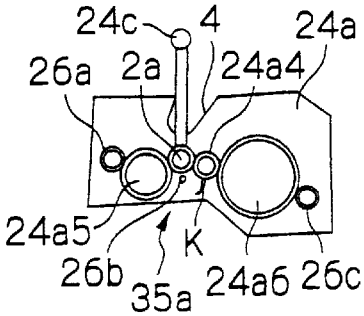

The mechanism for allowing the body 5 to be mounted and dismounted from the apparatus 11 will be described more specifically with reference to FIGS. 6A-1 through 6A-3 and 6B-1 through 6B-3. FIGS. 6A-1 through 6A-3 show the side walls 24*a* and 24*b* in the condition wherein the body 5 is set on the apparatus 11. FIGS. 6B-1 through 6B-3 show the side walls 24*a* and 24*b* in the condition wherein the handle 24*c* is turned in order to dismount the body 5. FIGS. 6A-2 and 6B-2 are top plan views associated with FIGS. 6A-1 and 6B-1, respectively. FIG. 6A-1 is a view as seen in a direction A' shown in FIG. 6A-2 while FIG. 6A-3 is a view as seen in a direction B' also shown in FIG. 6A-2. Likewise, FIG. 6B-1 is a view as seen in the direction A' while FIG. 6B-3 is a view as seen in the direction B'.

FIGS. 6A-1 and 6B-1 each show the side wall 24*b* symmetrically in the right-and-left direction with respect to a view as seen in the direction B'. FIGS. 6A-1 and 6B-1 show lugs 26*d* protruding from the apparatus 1 for a positioning lock. FIGS. 6A-3 and 6B-3 show a toner discharge path 26*a*, a lug 26*b* for a positioning lock and a toner replenishment path 26*c* each protruding from the apparatus 11.

As shown in FIG. 6A-1, when the body 5 is set on the apparatus 11, a positioning lock 24*b*8 is engaged with the lug 26*d*. Also, as shown in FIG. 6A-3, a positioning lock 24*a*4 is engaged with the lug 26*b*. The body 5 is therefore locked to the apparatus 11.

The handle 24*c* is gripped by hand when the body 5 is to be mounted to or dismounted from the apparatus 11, as stated earlier. Gears 2*a* and 2*b* and positioning locks 24*a*4 and 24*b*8 constitute a holding section that allows the operator to set the body 5 on the apparatus 11. These components constitute developing device holding means 35*a* and 35*b* in combination. Specifically, the handle 24*c* is angularly movable relative to the body 5 including the developing device 17. When the handle 24*c* is turned, the gears 2*a* and 2*b* and the gear portions of the positioning locks 24*a*4 and 24*b*8 held in mesh with each other cause the positioning locks 24*a*4 and 24*b*8 to angularly move. In this manner, the developing device holding means 35*a* and 35*b* cause the positioning locks 24*a*4 and 24*b*8 to rotate due to the moment of the handle 24*c*, so that the body 5 can be efficiently locked to or unlocked from the apparatus The positioning locks 28*a*4 and 24*b*8 each include a hook K. When the positioning locks 24*a*4 and 24*b*8 rotate, the hooks K engage with the lugs 26*b* and 26*d*, respectively, to thereby lock the body 5 to the apparatus 11. By turning the handle 24*c* in the other direction, it is possible to unlock the body 5 from the apparatus 11.

The previously mentioned toner hopper is communicated to the developing device 16 for replenishing fresh toner to the developing device 16. The cleaning device 19 is connected to the toner recycling mechanism arranged in the apparatus 11 in order to deliver collected toner to the mechanism.

More specifically, the handle 24*c* is angularly movably supported by the side walls 24*a* and 24*b* together with the gears 2*a* and 2*b*. In the portions of the side walls 24*a* and 24*b* where the handle 24*c* is mounted, the gears 2*a* and 2*b* are held in mesh with the positioning locks 24*a*4 and 24*b*8, respectively. When the handle 24*c* is turned by hand, the gears 2*a* and 2*b* cause the positioning locks 24*a*4 and 24*b*8, respectively, to rotate.

Figure 21:
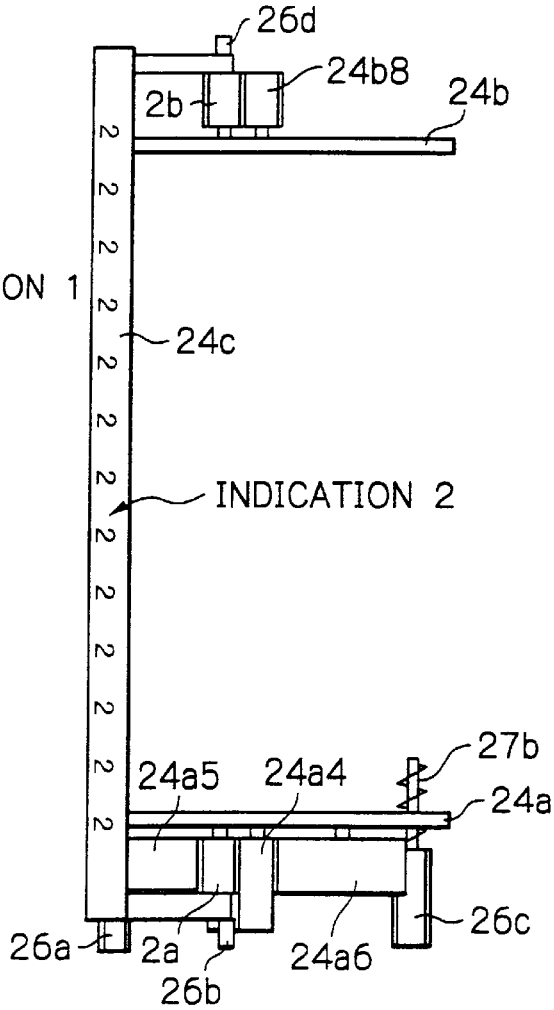

An indication or indicating means showing the operator the mounting and dismounting orders is provided on the surface of the handle 24*c* that is visible when the drum cassette 6 is dismounted from the body 5. The indication may be provided in any suitable form so long as it shows the user the above orders. In the illustrative embodiment, as shown in FIG. 21, numeral 2 is directly printed on the handle 24*c*. Other specific indications are, e.g., a message "Pull this toward you." printed on the handle 24*c*, a picture displayed on an operation panel, not shown, and a speech. Again, as for the picture or the speech, a sensor responsive to the mounting of the drum cassette 6 may be used.

Figure 22A:
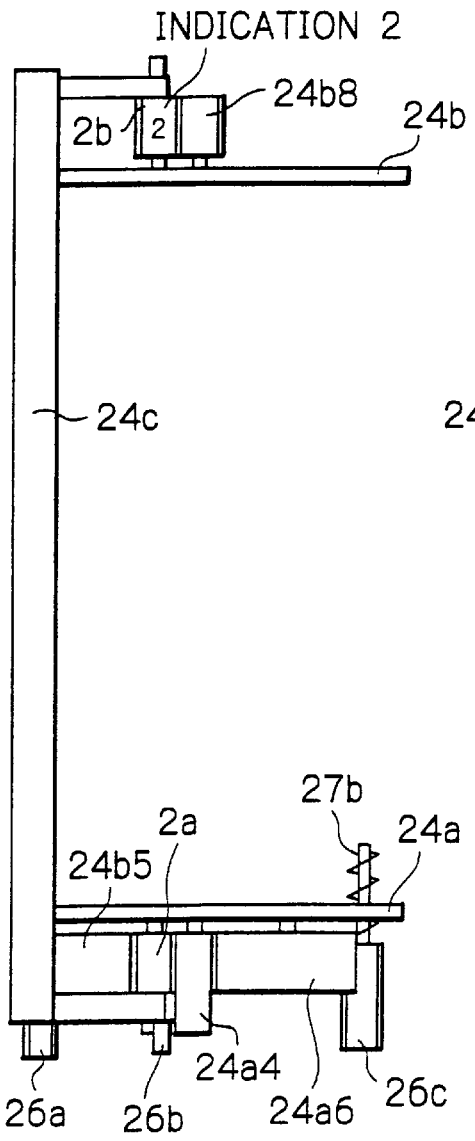
FIGS. 22-A and 22-B are plan views showing the indications with the drum cassette being dismounted from the body.
Figure 22B:
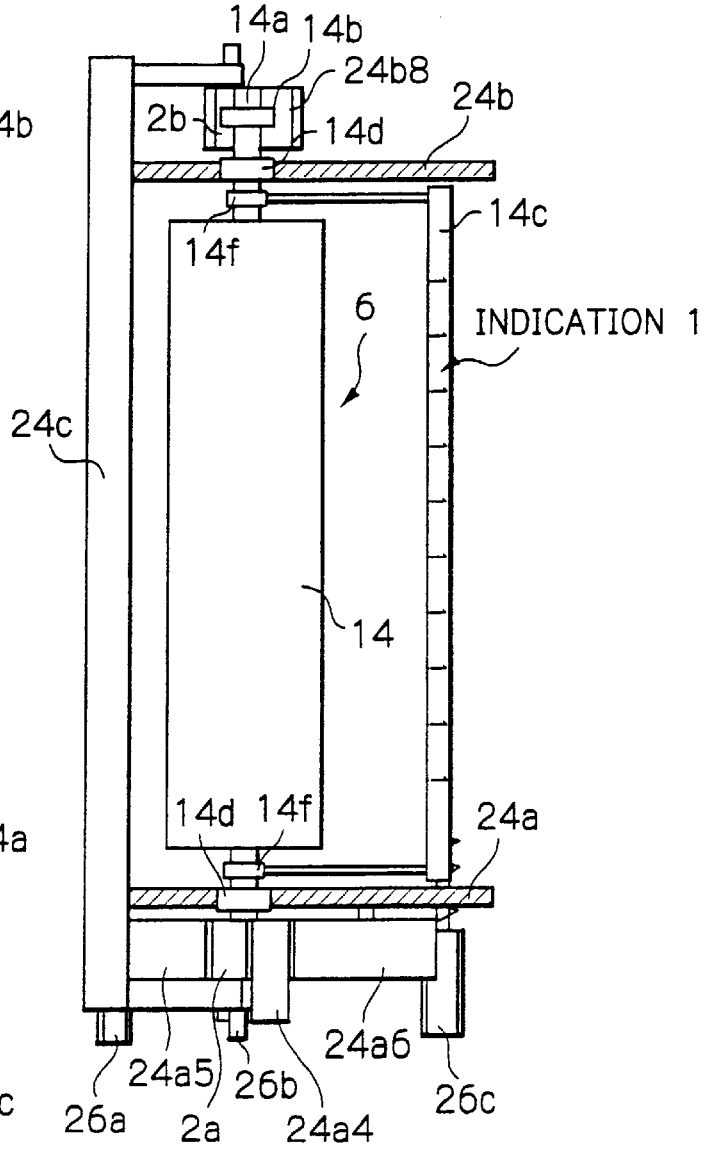
Figure 23:
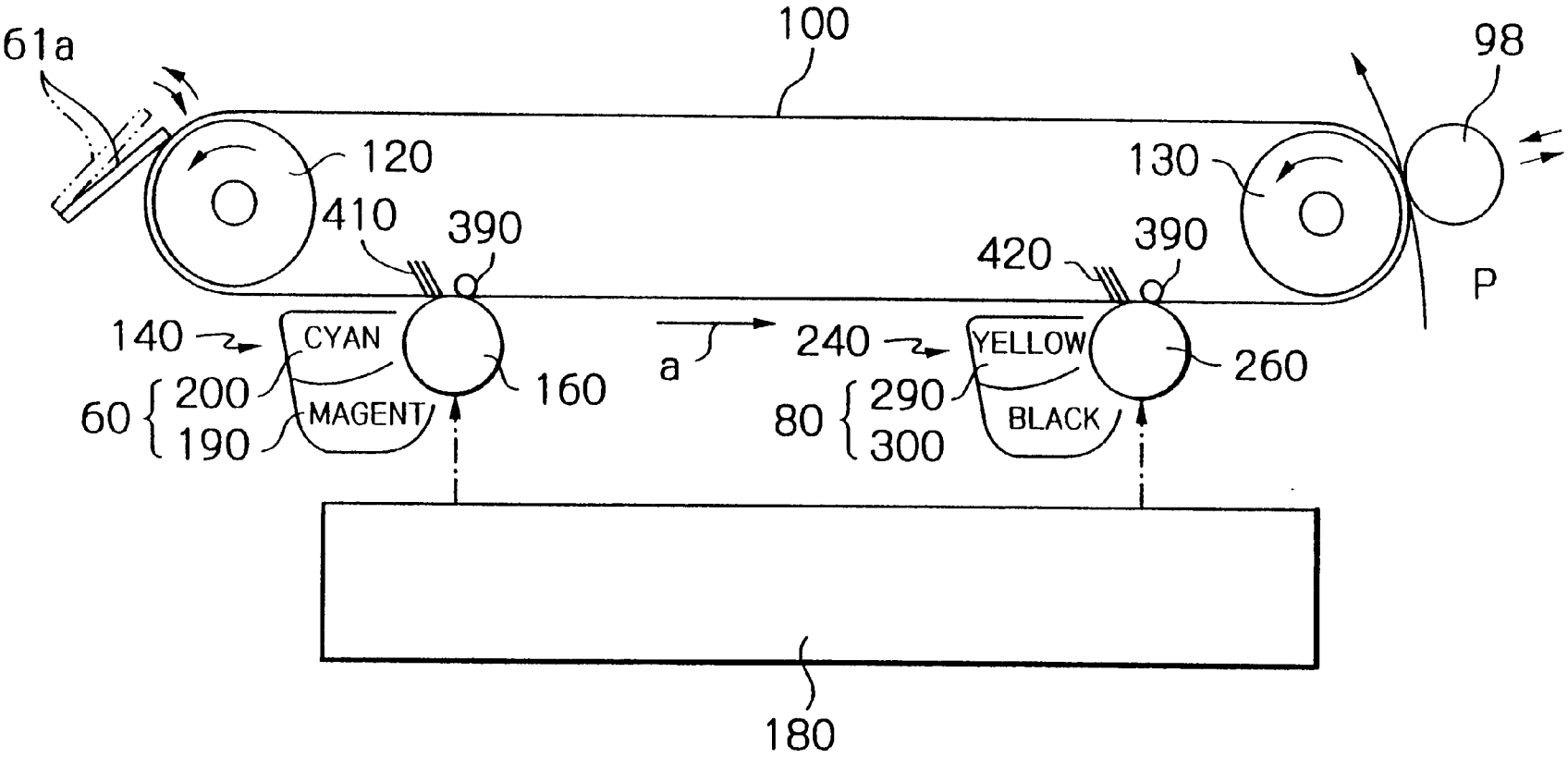
FIG. 23 is a view showing an intermediate image transfer type of color image forming apparatus representative of an alternative embodiment of the present invention.

Alternatively, as shown in FIG. 22A, numeral "2" may be printed on a member adjoining one base end of the handle 24*c*, e.g., on the gear 2*b*. In this case, as shown in FIG. 22B, while the drum cassette 6 is present on the body 5, the shaft 14*a* of the drum 14 hides the numeral or indication 2. That is, when the drum cassette 6 is removed from the body 5, the numeral 2 appears and shows the operator a step to be taken next. This configuration is also friendly to the user.

One base end of the handle 24*c* is rotatably supported by the front side wall 24*a*. The gear 2*a* is formed integrally with the above end of the handle 24*c*. The gear 2*c* is held in mesh with a gear or rotation transmitting member 24*a*5 as well as with the positioning lock 24*a*4. The positioning lock 24*a*4 is held in mesh with a gear or rotation transmitting member 24*a*6 as well. The gear 24*a*5 is held in mesh with the toner discharge path 26*a*, which is implemented by a gear rotatable integrally with the screw for discharging the toner to a portion of the apparatus body other than the image forming section 10. The gear 24*a*6 is held in mesh with the toner replenishment path 26*c* (see FIGS. 9A-1, 9A-2, 9B-1 and 9B-2), which is implemented by a hollow, cylindrical gear rotatable integrally with a screw conveyor for replenishing fresh toner.

The toner discharge path 26*a* and toner replenishment path 26*c* are arranged on the apparatus body and brought into mesh with the gears 24*a*5 and 24*a*6, respectively, when the body 5 is mounted to the apparatus 11. When the handle 24*c* is angularly moved, it causes the toner discharge path 26*a* and toner replenishment path 26*c* to rotate via the gears 24*a*5 and 24*a*6, respectively. In the figures, the handle 24*c*, positioning locks 24*a*4 and 24*b*8, gears 24*a*5 and 24*a*6, toner discharge path 26*a* and toner replenishment path 26*c* each are represented by a double circle. Nearby double circles are shown as overlapping each other.

Figure 7:
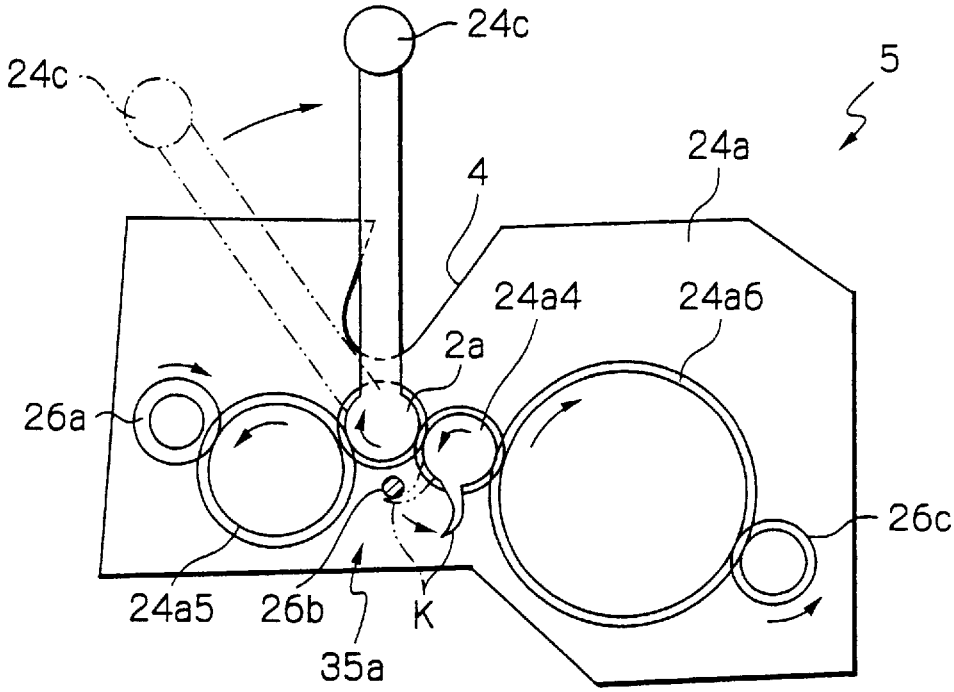
FIG. 7 is a front view showing the front side wall and handle.

How the operator mounts the body 5 to the apparatus 11 or dismounts the former from the latter will be described specifically. To dismount the body 5 from the apparatus 11, the operator angularly moves, in accordance with the indication, the handle 24*c* from the position shown in FIGS. 9A-1, 9A-2, 9B-1 and 9*b*-2 in which the body 5 is set on the apparatus 11 to the position shown in FIGS. 6B-1 through 6B-3 in which the body 5 is unlocked from the apparatus 11. More specifically, as shown in FIG. 7, when the handle 24*c* is moved in a direction indicated by an arrow, the positioning lock 24*a*4 is rotated and released from the lug 26*b*. This is also true with the positioning lock 24*b* 8 engaged with the lug 26*b*.

Figure 8:
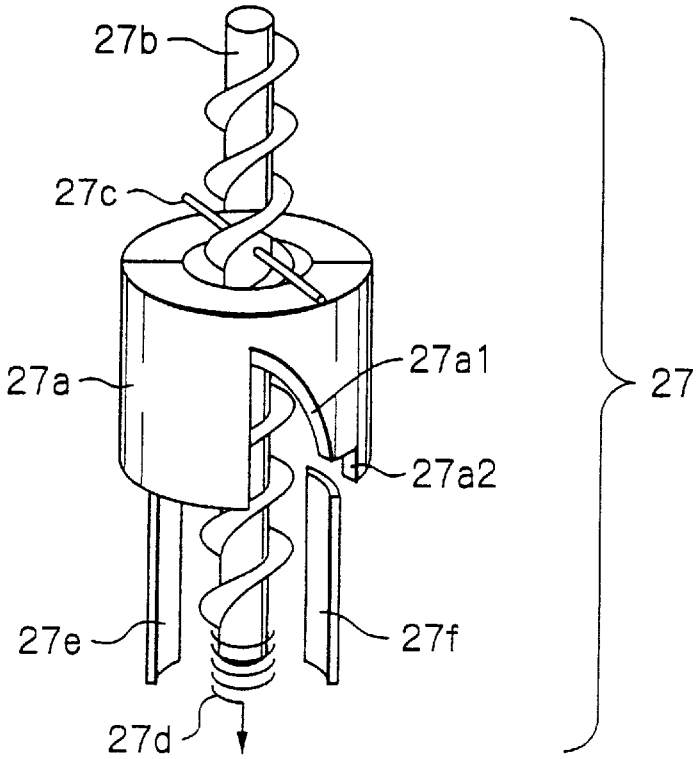
FIG. 8 is an isometric view showing a screw connecting member.

Further, the toner discharge path 26*a* and toner replenishment path 26*c* each rotate in a particular direction indicated by an arrow in FIG. 7. The path 26*a* communicating the cleaning device 19 to a waste toner storage, which is included in the apparatus body, and the path 26*c* communicating the toner hopper to the developing device 16 are implemented by a tube each. As shown in FIG. 8, a screw connecting member 27 is disposed in each of the paths 26*a* and 26*c*.

As shown in FIG. 2, one screw connecting member 27 connects the toner replenishing screw 16 and a toner replenishing mechanism 31, which is independent of the developing device 16. Likewise, the other screw connecting member 27 connects the screw 19*b* of the cleaning device 19 and a toner discharging mechanism 30, which is independent of the cleaning device 19. The toner discharging mechanism 30 includes the previously mentioned waste toner storage removably mounted thereto. The toner replenishing mechanism 31 includes a fresh toner storage for storing fresh toner fed from a removable toner bottle.

In the arrangement described above, when the operator turns the handle 24*c*, the toner conveyance paths between the developing device 16 and cleaning device 19 and the apparatus 11 are automatically canceled. Further, only if the operator replaces the toner bottle set on the fresh toner storage, fresh toner can be replenished to the developing device 16. This makes it needless for the operator to dismount the entire developing device from the apparatus 11. In addition, when the waste toner storage is filled up with waste toner, the operator should only replace the waste toner storage without removing the entire cleaning device 19 from the apparatus.

The screw connecting members 27 disposed in the toner discharge path 26*a* and toner replenishment path 26*c* are identical in configuration. The following description will concentrate on an arrangement inside the toner replenishment path 26*c* by way of example.

As shown in FIG. 8, the screw connecting member 27 includes a tube 27*a* and a screw 27*b* for toner replenishment mounted on the apparatus 11. A pin 27*c* extends throughout the screw 27*b* perpendicularly to the axis of the screw 27*b*. A tension spring 27*d* is anchored to the screw 27*b* at one end and constantly pulled in a direction indicated by an arrow at the other end. A pair of flat guides 27*e* and 27*f* each are slidably received in a particular hole formed in the thickened wall portion of the tube 27*a*. Further, the tube 27*a* is formed with a slant 27*a*1 and a step 27*a*2 contiguous with each other.

Figures 1, 9A:
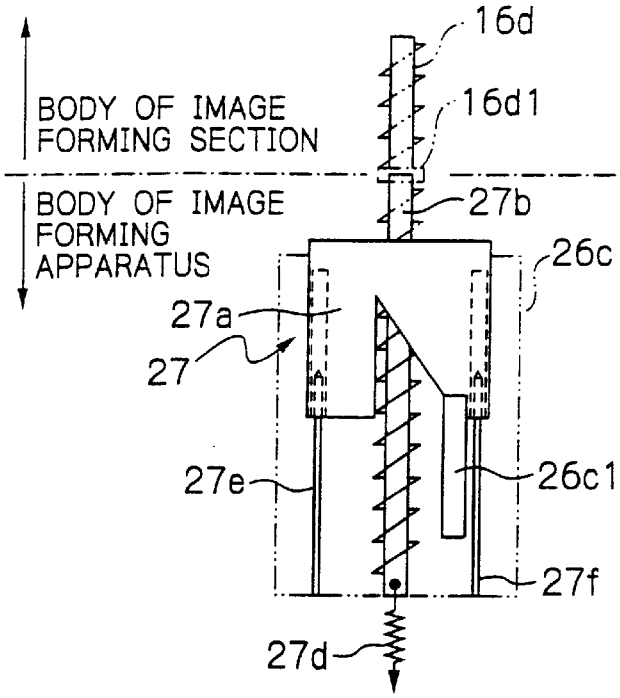
Figures 1, 9B:
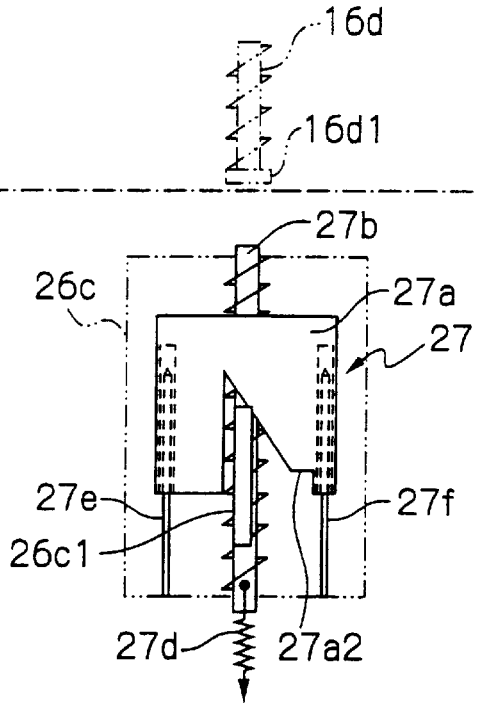
Figures 1, 9A:
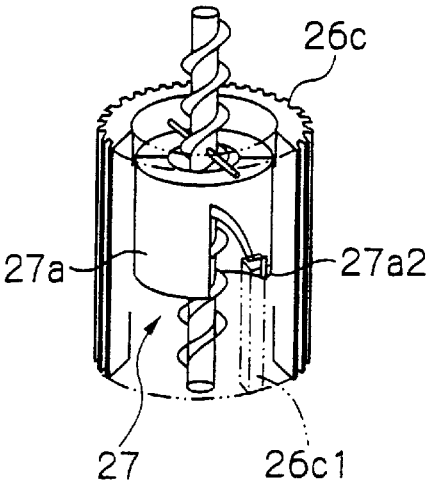
Figures 1, 9B:
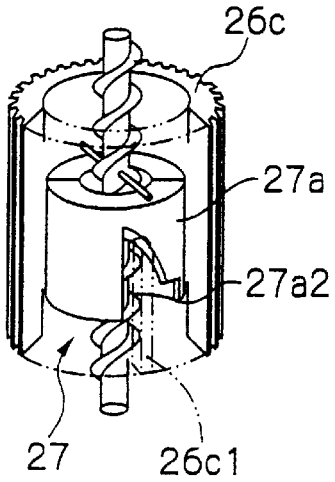

FIGS. 9A-1, 9A-2, 9B-1 and 9B-2 show a relation between the screw connecting member 27 and the toner replenishment path 26*c* extending from the apparatus 11. Specifically, FIGS. 9A-1 and 9A-2 show a relation between the screw connecting member 27 and the toner replenishment path 26*c* in the condition shown in FIGS. 6A-1 through 6A-3 in which the body 5 is mounted to the apparatus 11. FIGS. 9B-1 and 9B-2 show the above relation in the condition shown in FIGS. 6B-1 through 6B-3 in which the body 5 is unlocked from the apparatus 11. A rectangular lug 26*c*1 protrudes from the inner surface of the toner replenishment path 26*c* in the axial direction of the path 26*c*.

As shown in FIGS. 9-1 and 9A-2, when the body 5 is mounted to the apparatus 11, the lug 26*c*1 gets on the step 27*a*2 of the tube 27*a* against the action of the tension spring 27*d*, forcing the tube 27*a* toward the body 5. In this condition, when the operator turns the handle 24*c* in the direction indicated by the arrow in FIG. 7, the toner replenishment path 26*c* is rotated counterclockwise, as viewed in FIG. 7. Consequently, the lug 26*c*1 is released from the step 27*a*2 of the tube 27*a*. Therefore, the toner replenishing screw 27*b* is moved away from the body 5 from the position shown in FIGS. 9A-1 and 9A-2 to the position shown in FIGS. 9*b*-1 and 9B-2 while causing the body 6 to move in the same direction via the pin 27*c*. The entire screw connecting member 27 is fixed in place in the conditions shown in FIGS. 9B-1 and 9B-2.

Further, the end of the toner replenishing screw 27*b* moves away from the end of the toner replenishing screw 16*d* and further retracts to the outside of the side wall 24*a*. As a result, the side wall 24*a* is freed from the connection with the apparatus 11 for toner replenishment and toner discharge. In this condition, the body 5 can be dismounted from the apparatus 11.

It is noteworthy that the spring 27*d* constantly biases the toner replenishing screw 27*b* toward the apparatus 11. When the image forming section 10 is dismounted, the spring 27*d* prevents the screw 27*b* from jumping out toward the image forming section 10 and damaging it.

As stated above, when the developing device 16 is dismounted from the apparatus 11 together with the body 5, developer (toner) conveying means connecting the apparatus and developing device 16 is separated at the position between the toner replenishing screws 16*d* and 27*b*, as shown in FIG. 9A-1. When the body 5 is mounted to the apparatus 11, the two screws 16*d* and 27*d* are connected at the above position. A single toner receiving member, not shown, is positioned below both of the two screws 16*d* and 27*b* for receiving the toner that may drop from the screws 16*d* and 27*b*.

As shown in FIG. 7, the outer periphery of the toner replenishment path 26*c* is implemented as a gear and driven by the positioning lock 24*a*4 via the gear or rotation transmitting member 24*a*6. Therefore, when the operator turns the handle 24*c*, the developer path is automatically disconnected at the same time as the body 5 is unlocked from the apparatus 11.

The toner replenishment path 26*c*, tube 27*a*, toner replenishing screw 27*b* mounted on the apparatus 11 and movable toward and away from the toner replenishing screw 16*d* included in the developing device 16 and moving means for moving the screw 27*b* relative to the screw 16*d* in accordance with the rotation of the positioning lock 24*a*4 constitute coupling/uncoupling means. The moving means is made up of the spring 27*d* biasing the screw 27*b* away from the screw 16*d* and screw connecting member 27*a*.

The coupling/uncoupling means stated above is also applied to the toner discharge path connecting the cleaning device 19 and apparatus 11. This allows the body 5 to be fully isolated from the apparatus 11.

To mount the body 5 to the apparatus 11, the body 5 is set on the apparatus 11 with the handle 24*c* of the body 5 standing upright (FIGS. 6B-1 through 6B-3). The handle 24*c* is then brought down to the position shown in FIGS. 6A-1 through 6A-3, causing the positioning locks 24*a*4 and 24*b*8 to engage with the lugs 26*b* and 26*d*, respectively. The toner discharge path 26*a* rotates to the position shown in FIGS. 9B-1 and 9B-2 in interlocked relation to the handle 24*c* via the above-described mechanism. At this instant, the lug 26c1 slides on the slant 27a1 toward the body 5 against the action of the tension spring 27d and stops on getting on the step 27a2. Consequently, the toner replenishing screw 27b is coupled with the toner replenishing screw 16d and rotatable together for replenishing and discharging the toner.

The guides 27e and 27f affixed to the apparatus 11 are positioned inside the tube 27a and allow the tube 27a to move only in the axial direction of the toner replenishing screw 16d. The tube 27 is therefore prevented from rotating together with the toner discharge path 26a of the apparatus 11 or the toner replenishment path 26c of the body 5. The screw 27b on the apparatus 11 can therefore surely move toward the body 5.

Assume that the operator intends to mount the body 5 to the apparatus 11 without raising the handle 24c. Then, the hooks K of the positioning locks 24a4 and 24b8 respectively abut against the lugs 26b and 26d, obstructing the body 5. The handle 24c therefore surely urges the operator to bring down the handle 24c after mounting the body 5 to the apparatus. When the handle 24c is brought down, the paths 26a and 26c are rotated to insure the connection of toner replenishing route and toner discharging route. This allows the apparatus 11 to surely resume image formation after the mounting of the body 5.

Figure 18A:
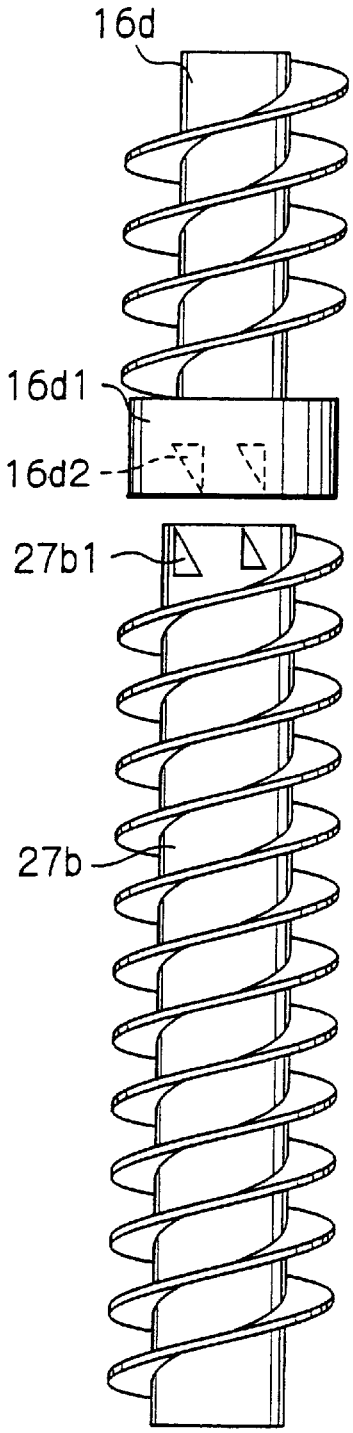
FIG. 18 is a front view showing the screws and a joint therebetween.
Figure 18B:
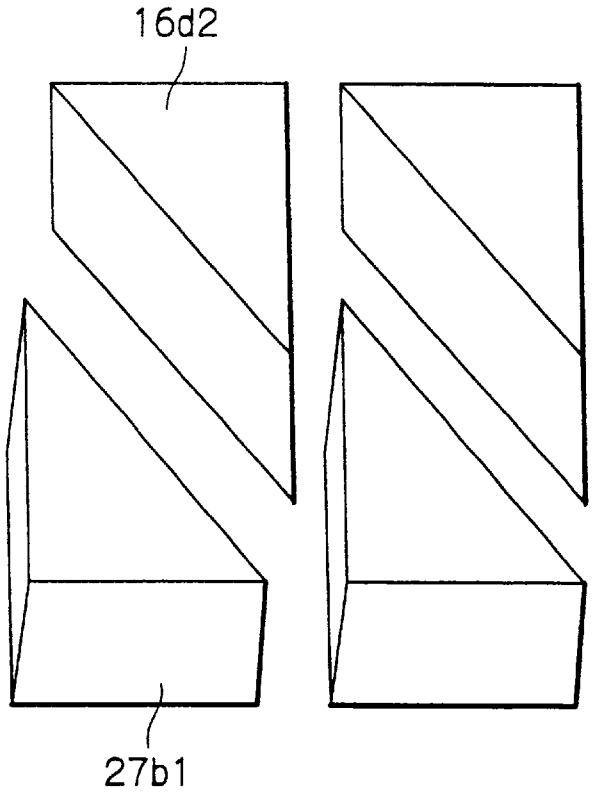

To couple the toner replenishing screws 27b and 16d, use may be made of a spline shaft although not shown or described specifically. FIGS. 18A and 18B show another specific arrangement for coupling the two screws 27b and 16d. As shown, a plurality of triangular lugs 27b1 protrude from the circumference of the end portion of the screw 27b. Likewise, a plurality of triangular lugs 16d2 protrude from the inner periphery of the screw 16d, when the screw 16d is rotated in the direction for toner replenishment, the lugs 27b1 and 16d2 abut against each other at their axial flat faces and surely transfer rotation. When the body 5 is mounted to the apparatus 11, the screw 27b smoothly enters a coupling portion 16d1, which is included in the screw 16d, with the inclined face of each lug 27b1 sliding on that of the associated lug 16d2. This prevents the screws 27b and 16d from hitting against and damaging each other or obstructing the mounting of the body 5.

Figure 10:
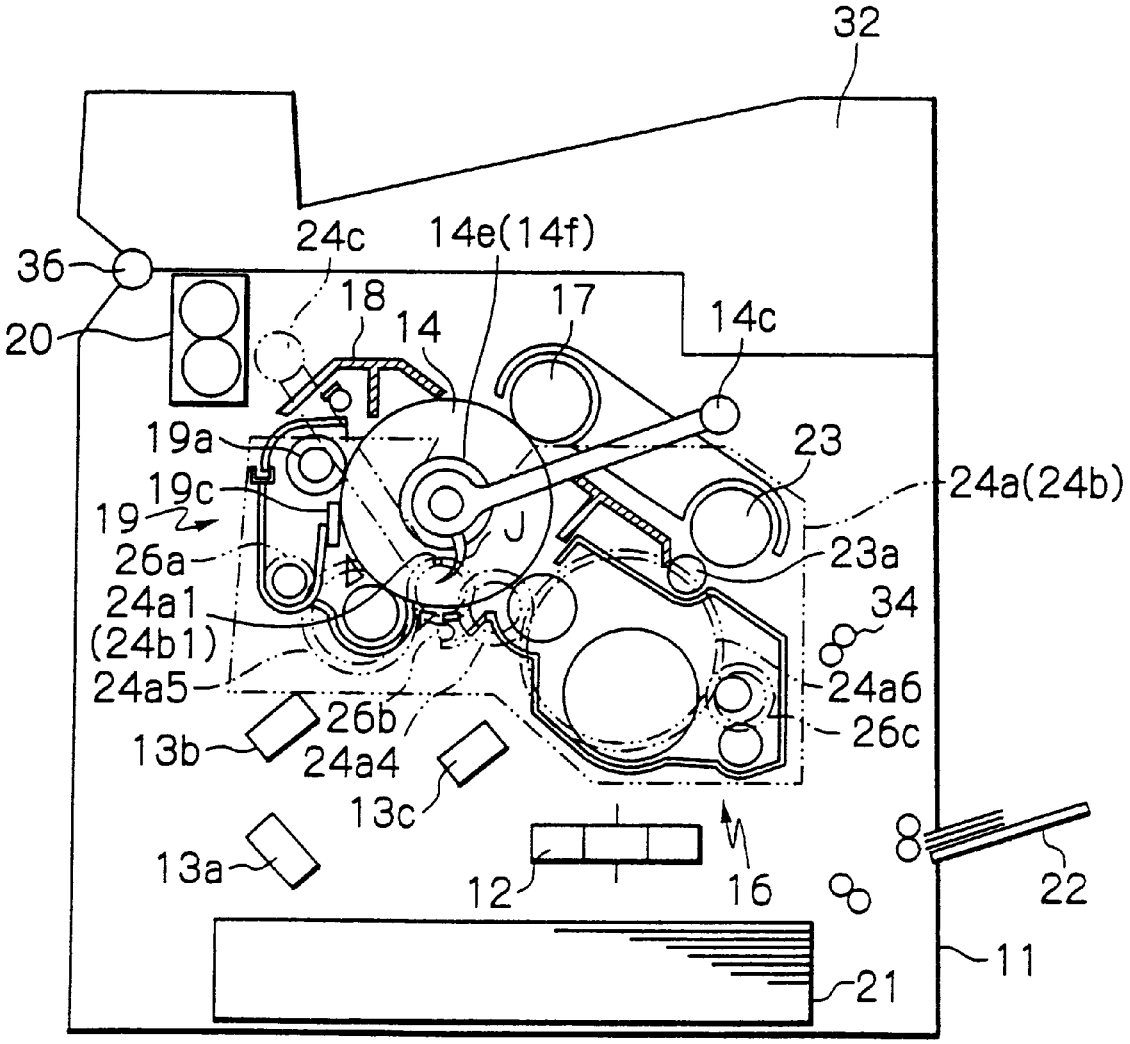
FIG. 10 is a front view showing a procedure for dismounting the image forming section from the apparatus.
Figure 11:
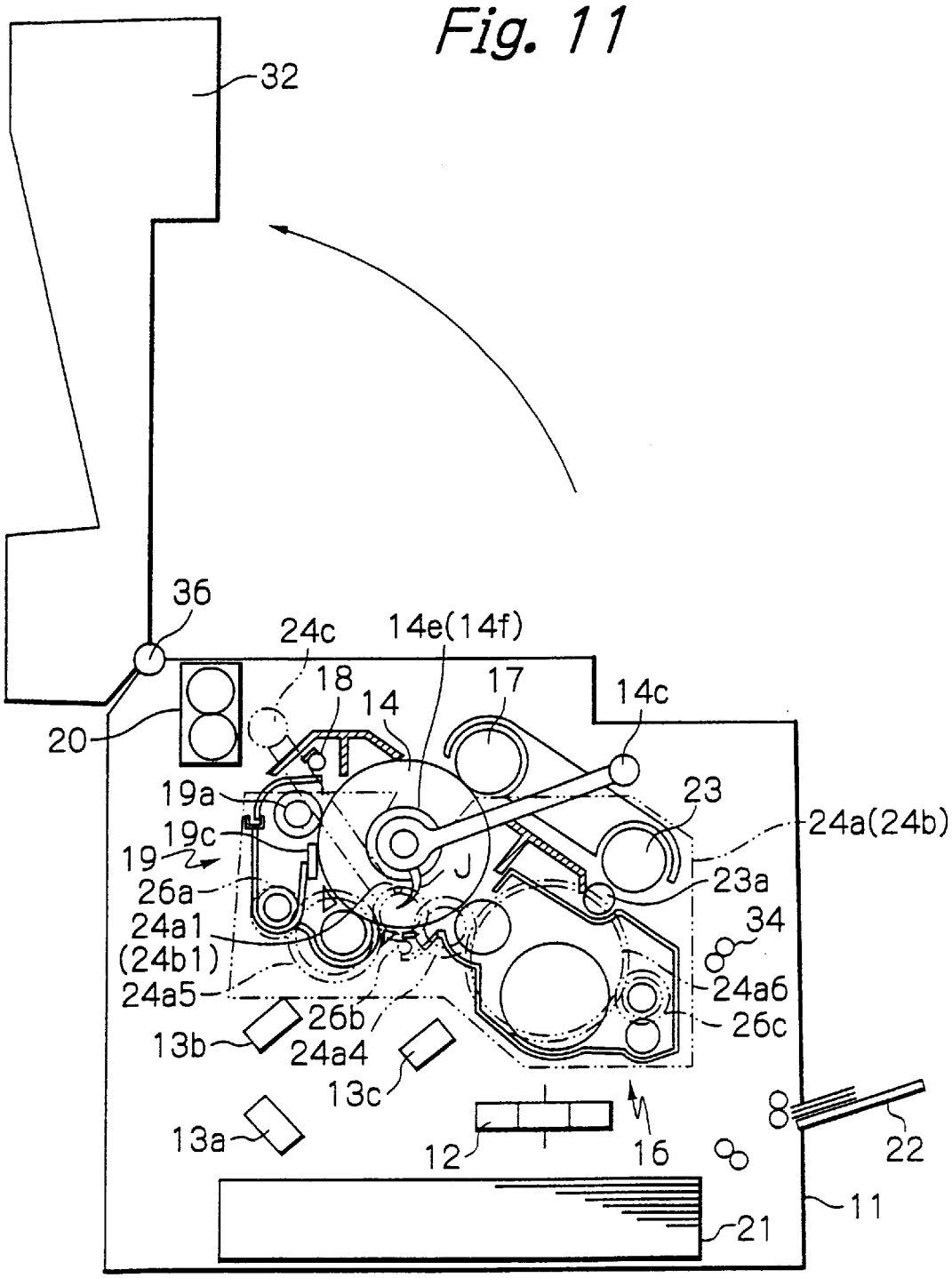
FIGS. 11 through 17 are front views for describing a procedure for dismounting the image forming section from the apparatus.
Figure 12:
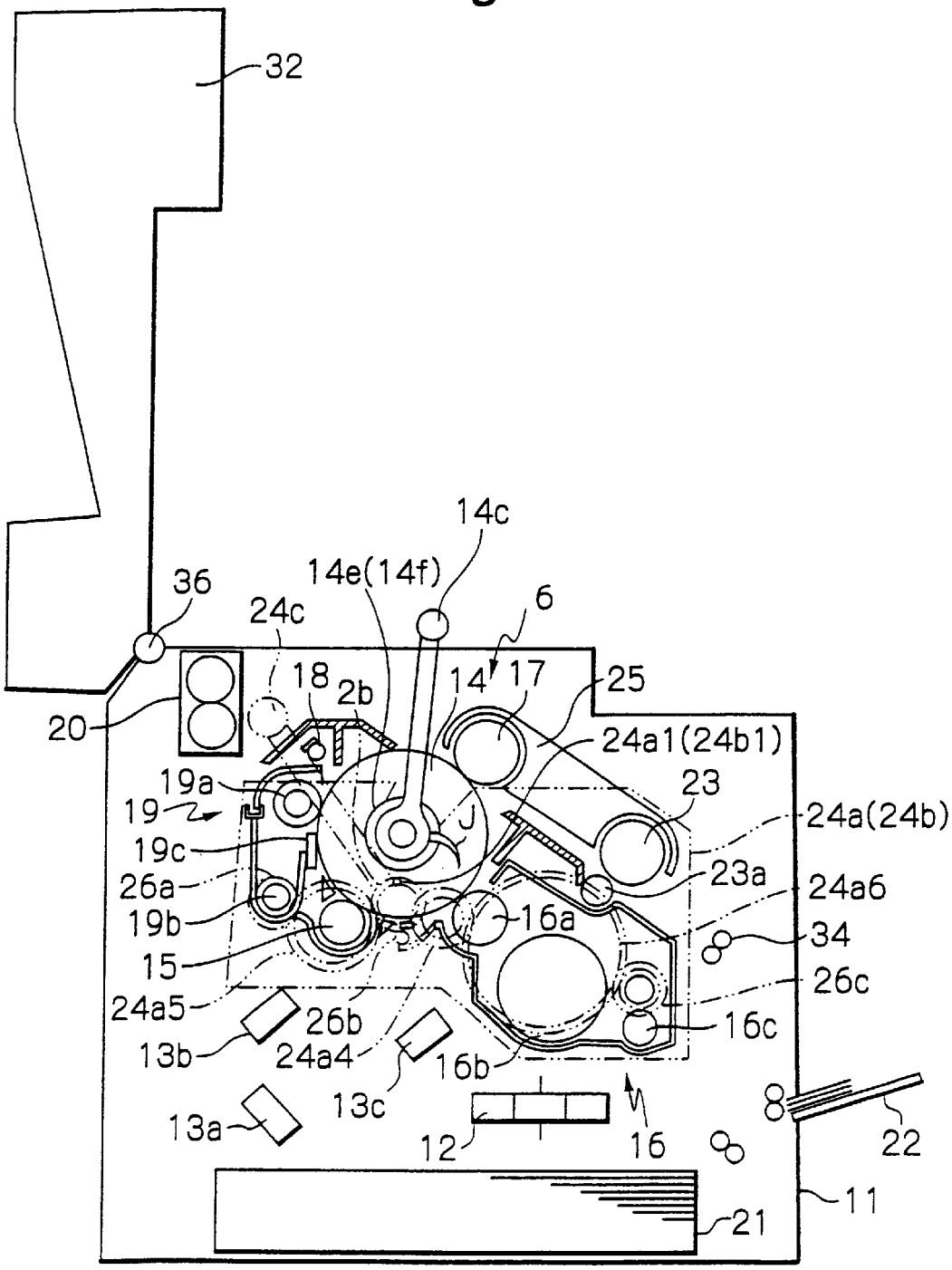

Reference will be made to FIGS. 10 through 17 for describing a procedure for dismounting the image forming section 10 from the apparatus 11. First, as shown in FIG. 10, the operator opens the top 32 of the apparatus 11 away from the rest of the apparatus 11 about a fulcrum 36 to a position shown in FIG. 11. The operator then raises the handle 14c such that the lugs 24a1 and 24b1 are released from the positioning locks 14e and 14f, respectively, (see FIG. 12). Subsequently, the operator pulls out the drum cassette 6 from the apparatus 11 (see FIG. 13).

Figure 14:
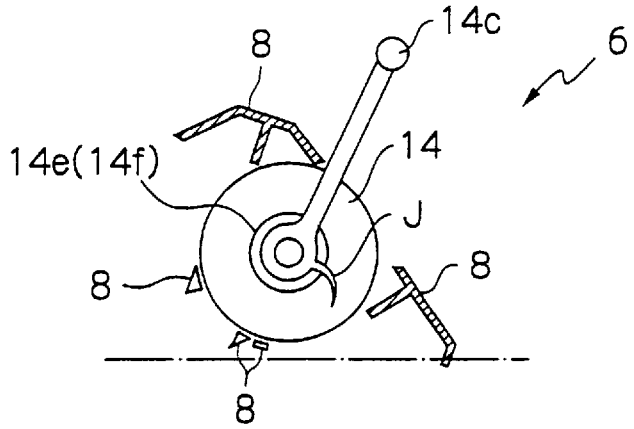
Figure 15:
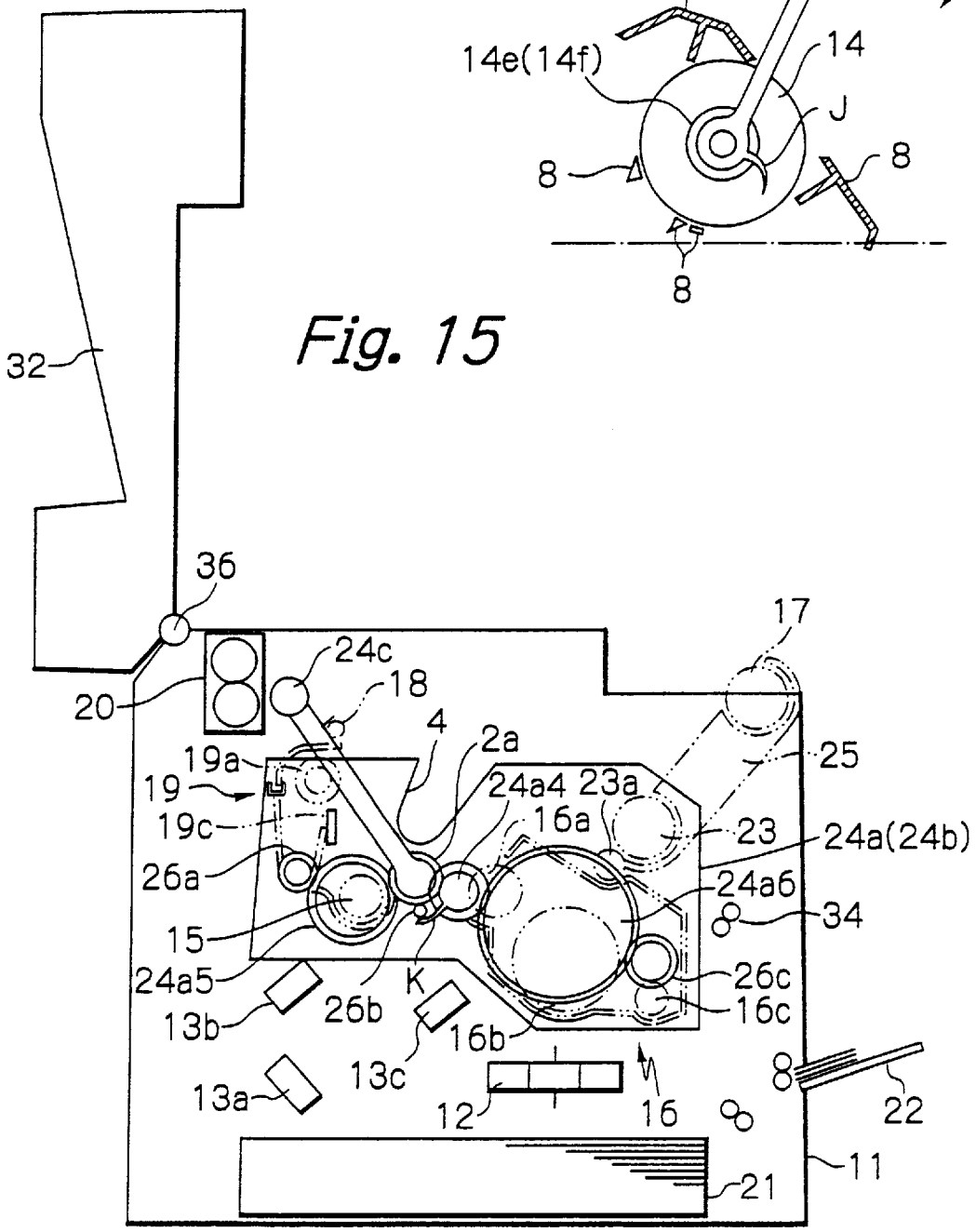
Figure 16:
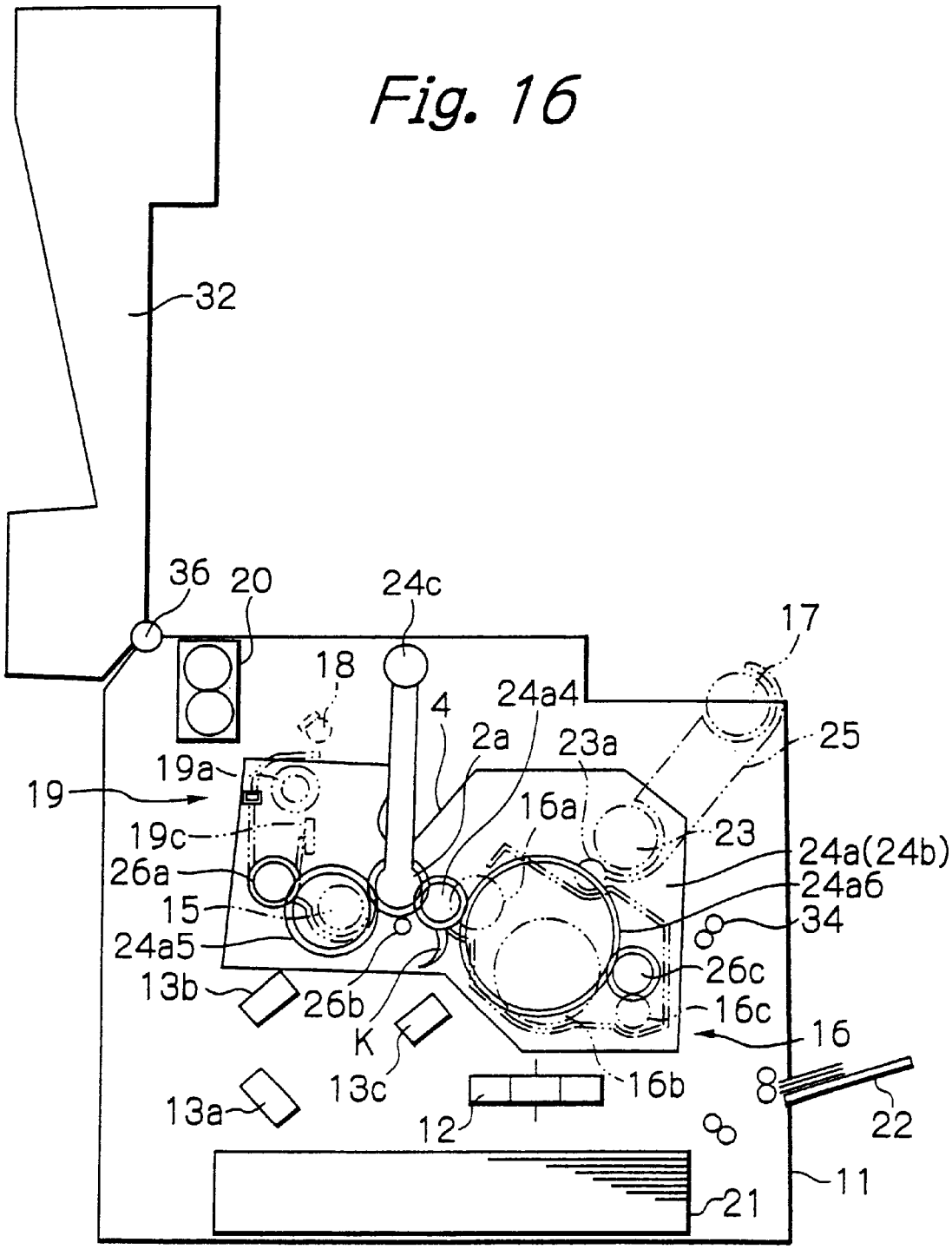
Figure 17:
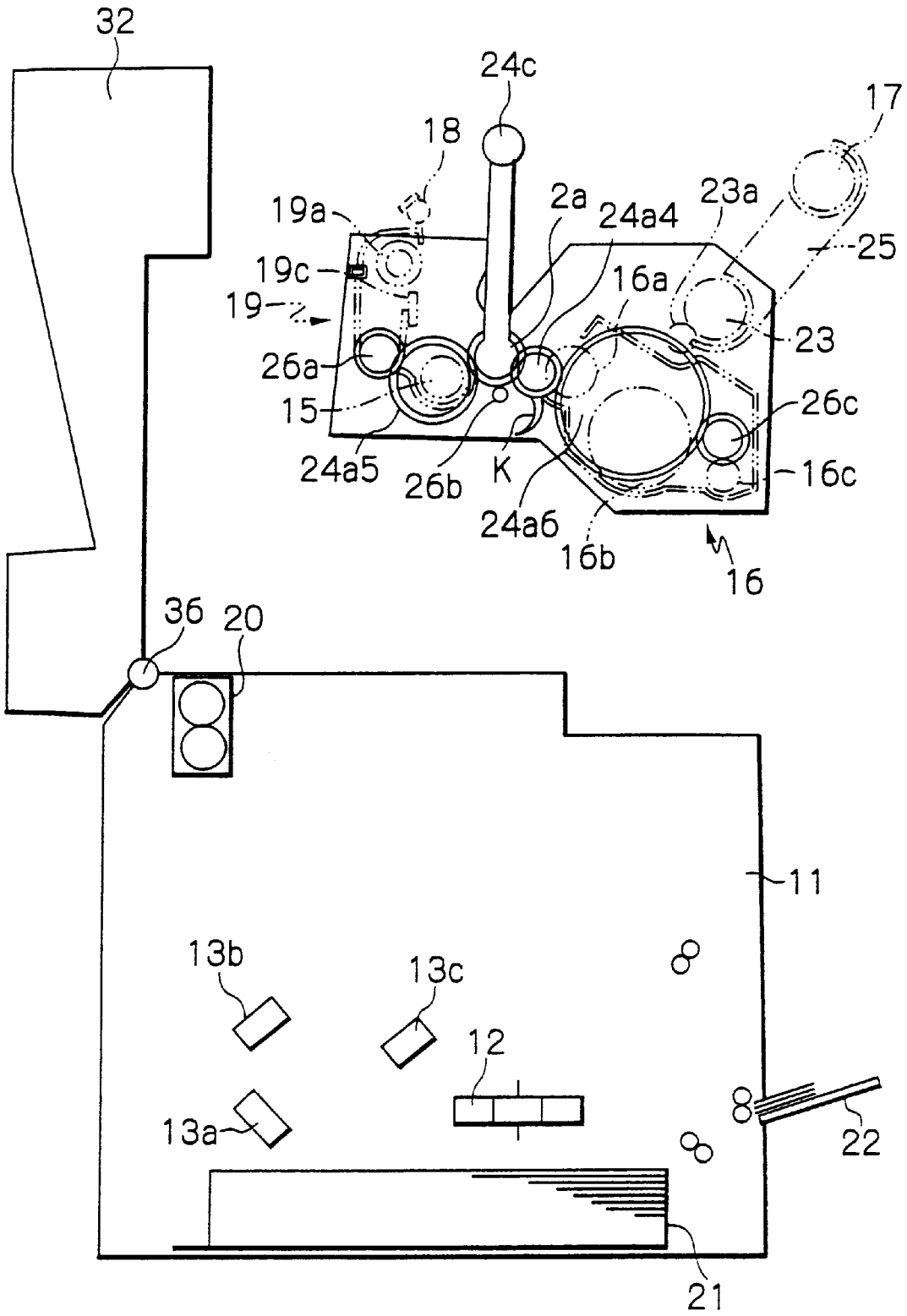

In the illustrative embodiment, the surface of the drum cassette 6 is exposed to the outside because it has to contact the various image forming means of the apparatus 11 at the time of image formation. The drum cassette 6 is therefore likely to contact, e.g., a floor when dismounted from the apparatus 11, causing the drum 14 to be damaged. To solve this problem, the framework 8 has a surface positioned radially outward of the surface of the drum 14, as shown in FIG. 14 specifically. With this configuration, the framework 8 protects the drum 14 from damage ascribable to the above occurrence.

Further, when the drum cassette 6 is removed from the apparatus 11, the handle 14c is positioned above the exposed portion of the cassette 6. When the operator gripping the handle 14c puts the drum cassette 6 on, e.g., a floor in the position shown in FIG. 14, the exposed portion of the cassette 6 does not contact the floor. In this manner, the handle 14 not only facilitates the handling of the drum cassette 6, but also protects the drum 14 from damage.

The drum cassette 6 is balanced in moment such that it has substantially the same orientation (FIG. 14) when set on the apparatus 11 and when dismounted from the apparatus 11 with the handle 14c being held by hand. Further, only if the operator lifted the drum cassette 6 lowers it vertically downward, the cassette 6 rests on a floor with the surface of the framework 8 contacting the floor. The operator can therefore mount and dismount the drum cassette 6 from the body 5 without being conscious of the orientation of the cassette 6.

As stated above, the drum cassette 6 is easy to mount and dismount and is protected from damage.

Figure 19:
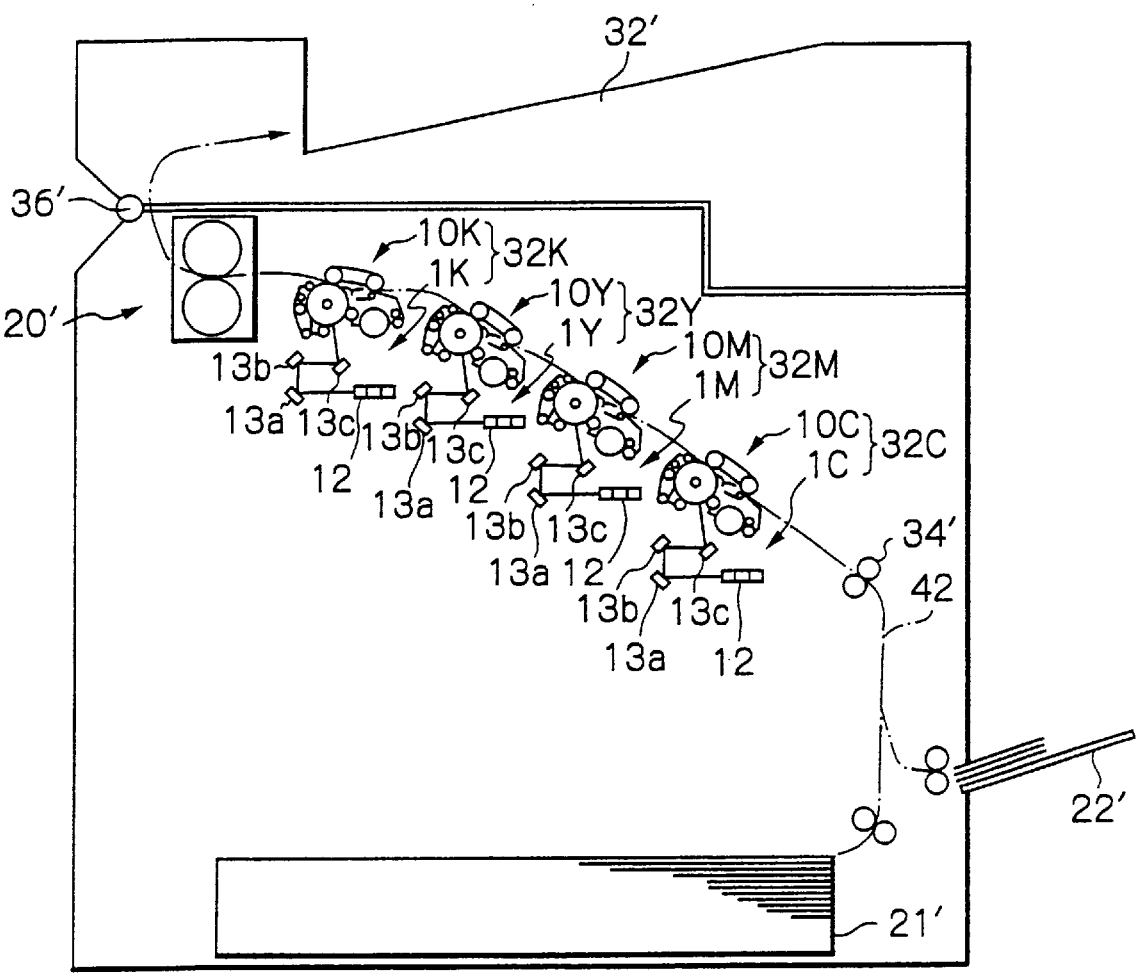
FIG. 19 is a front view showing the general construction of a color image forming apparatus.

While the illustrative embodiment has concentrated on a monochromatic image forming apparatus, it is similarly applicable to a color image forming apparatus, as will be described hereinafter. FIG. 19 shows a specific configuration of a color image forming apparatus. As shown, the apparatus includes a top cover 32', which is openable upward about a fulcrum 36'. Arranged below the top cover 32' are a sheet tray 21', a manual feed tray 22', a registration roller pair 34', and a fixing device 20'. A sheet path 42 extends between the registration roller pair 34' and the fixing device 20', as indicated by a dash-and-dot line. Four image forming units, i.e., a cyan (C) image forming unit 32C, a magenta (M) image forming unit 32M, a yellow (Y) image forming unit 32Y and a black image forming unit 32K are sequentially arranged along the sheet path 42 from the downstream side toward the upstream side in the direction of sheet feed.

The C image forming unit 32C is configured in the same manner as the image forming section 10. Specifically, the C image forming unit 32C includes an image forming section 10C storing a C developer and an optical writing section 1C that includes the light source, not shown, for writing an image in accordance with C image data, polygonal mirror 12, and mirrors 13a through 13c. The other image forming units 32M through 32K are identical with the C image forming unit 32C except for the color of toner stored therein.

It is possible even with the color image forming apparatus to mount and dismount a particular drum to each image forming unit (body of the image forming section) in order to reduce the running cost and to enhance accurate image formation.

The illustrative embodiment has the following various advantages in addition to the advantages described above.

In the illustrative embodiment, the drum 14 or the drum cassette 6 and the developing device 16 are classified by average service life. For example, the drum 14 whose life is relatively short and the means whose life is relatively long each are arranged in a particular unit. Members constituting the individual unit have substantially the same average life. This clearly indicates the user an operating sequence and prevents the operator from replacing members different in life at the same time, thereby reducing the running cost.

Generally, in an image forming apparatus of the type including the drum 14 as one of expendables, it is preferable that the body 5 of the image forming section and drum 14 are not mounted integrally with each other. The illustrative embodiment satisfies such a condition.

The illustrative embodiment allows the user to easily perform replacement without relying on a serviceman. More specifically, the body 5 is removable from the apparatus 11 only after the drum cassette 6 has been dismounted from the apparatus 11.

When the drum cassette 6 exists on the body 5, the drum 14 hides the handle 24*c*. The operator is therefore prevented from confusing the handle 14*c* of the drum cassette 6 with the handle 24*c* of the body 5.

When the drum cassette 6 is present on the apparatus 11, the operator is inhibited from reaching the handle 24*c* and therefore from unlocking the body 5 (developing device) from the apparatus 11. The operator can reach the handle 24*c* and unlock the body 5 from the apparatus 11 when the drum cassette 6 is absent on the apparatus 11.

Figure 13:
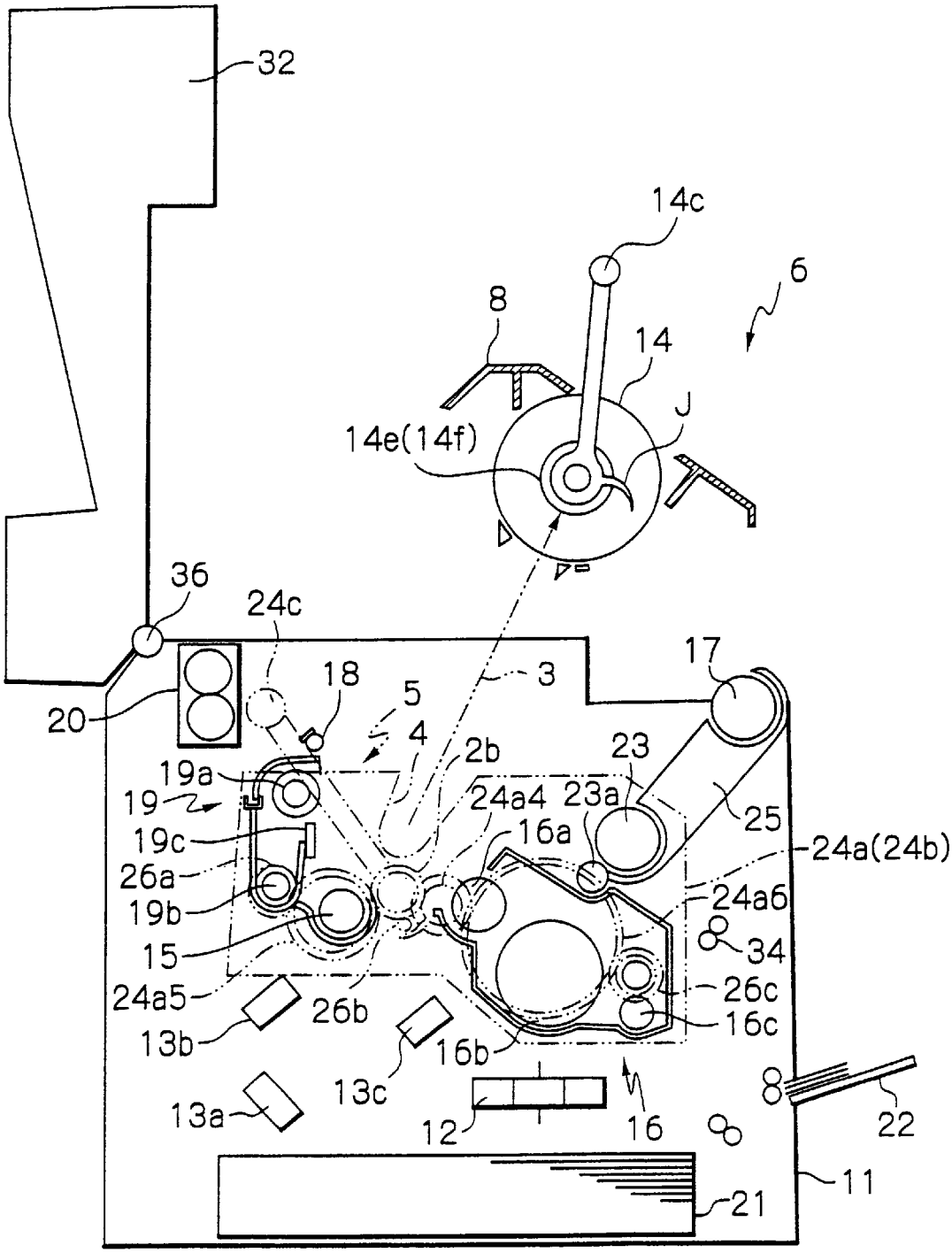

When the operator mounts the body (developing device 16) to the apparatus 11 and then brings down the handle 24*c* to the left, as viewed in FIG. 13, the hook K engages with the lug 26*b* to thereby lock the body 5 to the apparatus 11. In this condition, the handle 24*c* is positioned outside of the U-shaped recesses 4, allowing the drum cassette 6 to be mounted to the apparatus 11 (body 5).

As stated above, the illustrative embodiment realizes an image forming apparatus needing a minimum of running cost, reducing environmental loads, achieving accuracy high enough to cope with high-definition images, and easy to operate.

Figure 29:
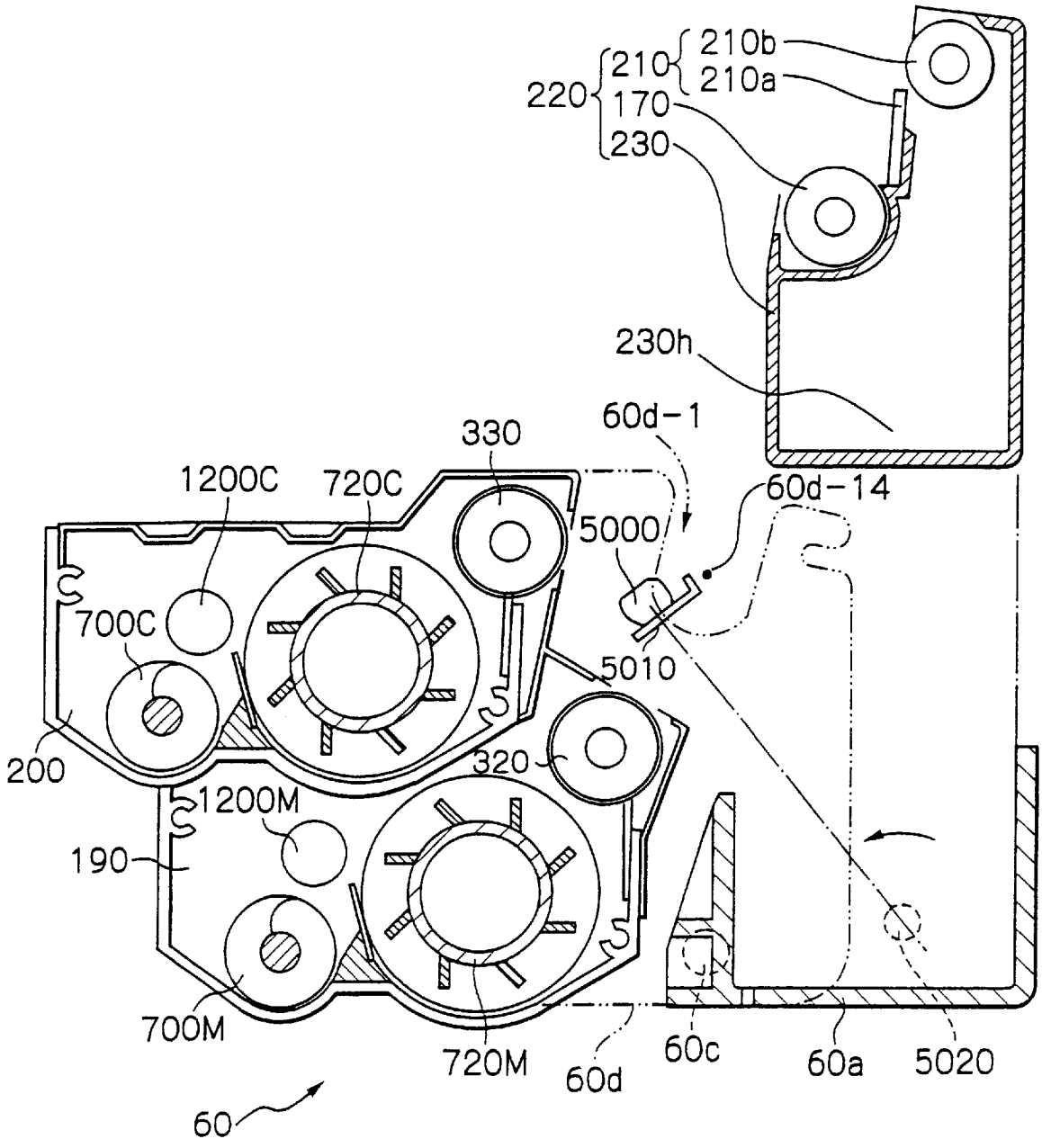
FIG. 29 is a view showing a cleaning cassette dismounted from the developing device.

An alternative embodiment of the present invention will be described hereinafter. This embodiment is implemented as a color image forming apparatus of the type including two image stations and using an intermediate image transfer body. The illustrative embodiment is basically similar to a color image forming apparatus taught in Japanese Patent Laid-Open Publication No. 10-177286 mentioned earlier. FIG. 29 shows the basic arrangement common to the illustrative embodiment and the above document.

As shown in FIG. 29, the color image forming apparatus includes a belt or intermediate image transfer body 100 passed over rollers 120 and 130 and driven in a direction a thereby. Process means for image formation are arranged around the belt 100. Specifically, a first image station 140, a second image station 240, an image transfer roller or image transferring means 98 and a cleaning blade 61*a* are sequentially arranged in this order below the belt 100 from the upstream side to the downstream side in the direction a. The image transfer roller 98 is movable into and out of contact with the roller 130. Likewise, the cleaning blade 61*a* is movable into and out of contact with the roller 120.

At the first image station 140, for example, charging means, not shown, uniformly charges the surface of a photoconductive drum 160 in the dark. An optical writing unit 180, which will be described specifically later with reference to FIG. 24, scans the charged surface of the drum 160 in accordance with image data of a certain color, thereby forming a latent image. A developing device 60 develops the latent image with toner to thereby form a toner image on the drum 160. The toner image is transferred from the drum 160 to the belt 100.

The developing device 60 at the first image station 140 includes a magenta developing section 190 and a cyan developing section 200. Likewise, a developing device 80 located at the second image station 240 includes a yellow developing section 290 and a black developing section 300. With such developing devices 60 and 80, it is possible to form a full-color image.

Image transfer brushes 410 and 420, for example, respectively face the drums 160 and 260 with the intermediary of the belt 100. While the same image forming area of the belt 100 sequentially arrives at the two image stations 140 and 240, the image transfer brushes 410 and 420 applied with a bias each transfer a toner image of one color to the belt 100. As a result, two toner images of different colors are transferred to the belt 100 one above the other. When the above image forming area again sequentially arrive at the image stations 140 and 240 due to the movement of the belt 100, toner images of the other different colors are transferred to the same image forming area of the belt 100 one above the other. Consequently, a full-color or four-color toner image is completed on the belt 100.

The image transfer roller 98 is pressed against and rotated by the belt 100. A bias for image transfer is applied to the roller 98 in order to transfer the full-color toner image from the belt 100 to a paper sheet or similar recording medium P being passed through a nip between the roller 98 and the belt 100. Fixing means, not shown, fixes the toner image on the sheet P.

Figure 24:
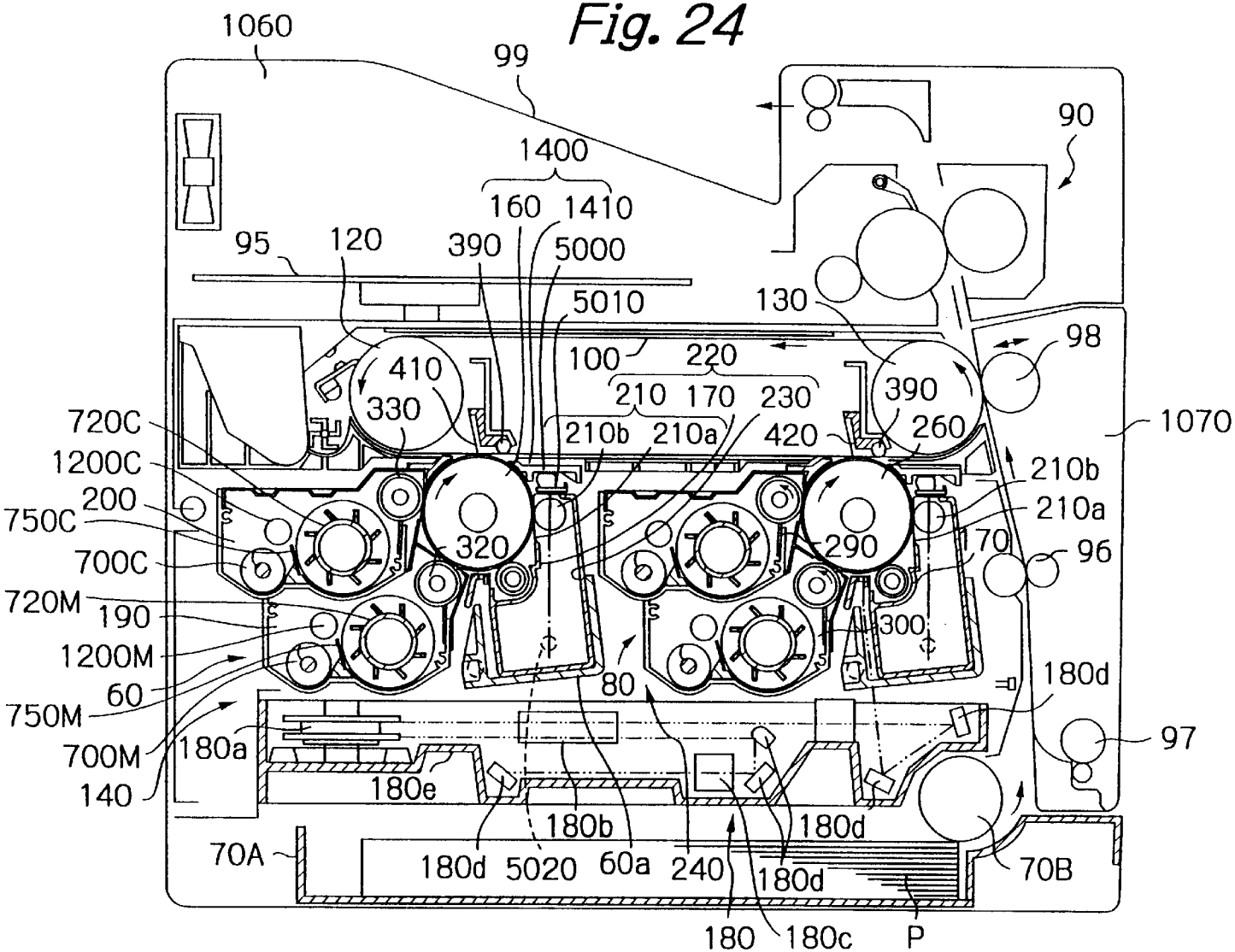
FIG. 24 is a partly sectioned front view showing the apparatus of FIG. 23 in detail.

FIG. 24 shows the illustrative embodiment more specifically. The illustrative embodiment constitutes an improvement over the image forming apparatus disclosed in Laid-Open Publication No. 10-177286. As shown, a sheet feed section 70A with a pickup roller 70B, the optical writing section 180, the developing devices 60 and 80, the belt 100, a fixing device 90 and an electric arrangement 95 are sequentially arranged in this order from the bottom toward the top of the apparatus. A roller 97 assigned to manual sheet feed, a registration roller pair 96 and the image transfer roller 98 form a substantially vertical sheet path at the right end of the apparatus. The sheet path extends from the pickup roller 70B to a print tray 99 via an image transfer position where the image transfer roller 98 and roller 130 contact each other and a fixing position where the fixing device 90 is located.

The optical writing unit 180 may be implemented as optics using LEDs (Light Emitting Diodes) as a light source or laser optics including a semiconductor laser as a light source. In any case, the writing unit 180 exposes the drums 160 and 260 imagewise in accordance with image data. In the illustrative embodiment, the writing unit 180 includes two semiconductor lasers. The semiconductor lasers each emit a laser beam toward one of two polygonal mirrors 180*a* that are stacked one upon the other. The light beams steered by the polygonal mirrors 180*a* are reflected toward lenses 180*b* and 180*c* and mirrors 180*d*. Consequently, the light beams each are incident on one of the drums 160 and 260.

The optical parts of the writing unit 180 are individually positioned on a housing 180*e*, which plays the role of the base of the apparatus body at the same time. The laser optics including two semiconductor lasers is only illustrative. In the illustrative embodiment, the writing unit 180 is positioned below the drums 160 and 260. The housing 180*e* therefore does not have to be formed with holes for passing the light beams and is improved in mechanical strength.

The latent image forming and developing system is mainly implemented as a drum cassette or unit, a cleaning cassette or unit and a developing cassette or unit. The two image stations 410 and 420 identical in configuration except for the color of toner are arranged side by side. Let the following description concentrate on the first image station 140 by way of example.

Figure 25:
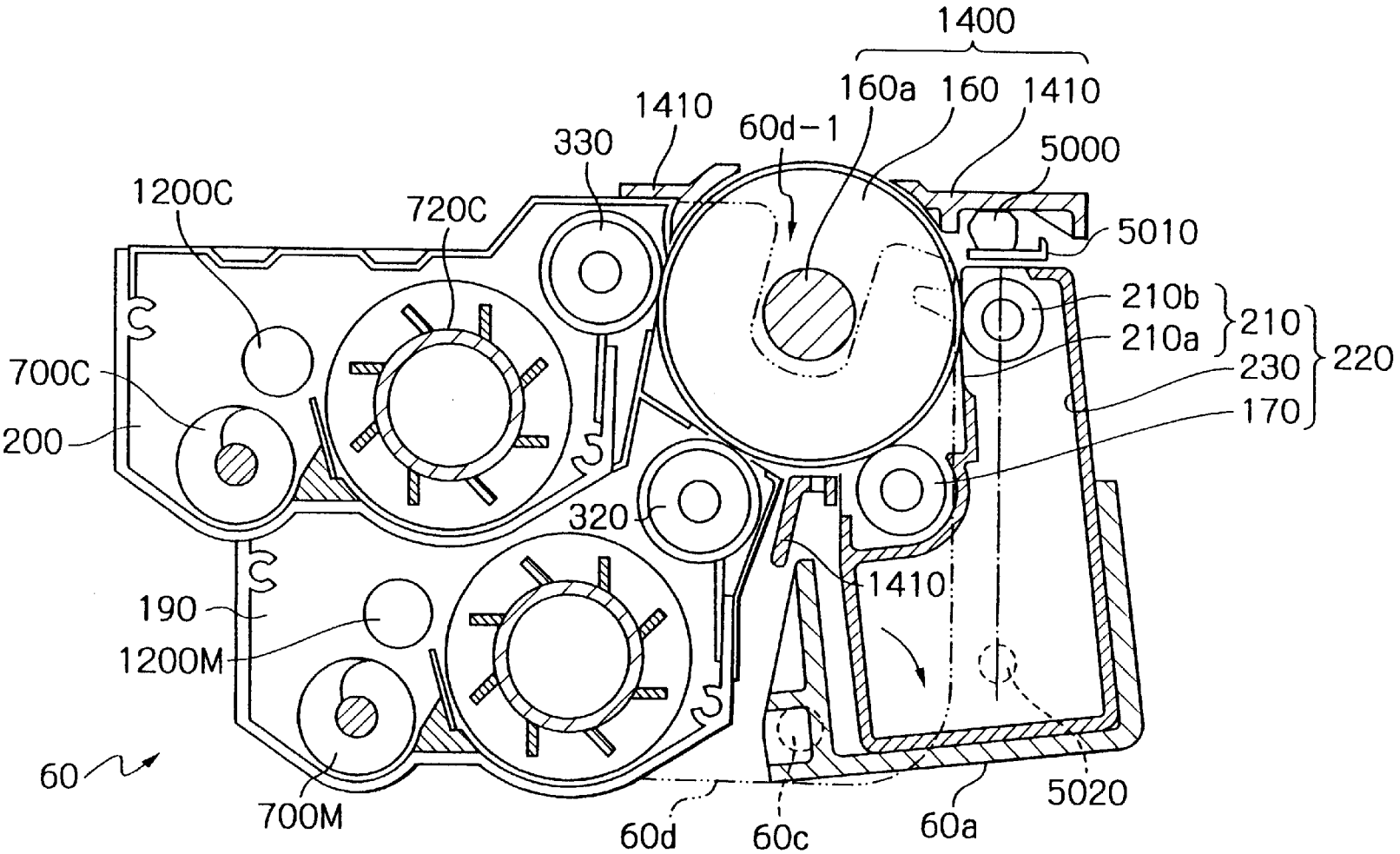
FIGS. 25 and 26 are partly sectioned front views showing a developing device included in the apparatus of FIG. 23.

As shown in FIG. 25, a drum cassette 1400 is made up of the drum 160, a rotatable shaft 160*a* supporting the drum 160, bearings 160*b* (only one is visible), and a holder 1410 that protects and rotatably supports the drum 160. The drum cassette 1400 differs from a conventional process cartridge in which a drum and other process means are arranged integrally with each other. A driveline including a gear 160*g* and a worm shaft 250, which will be described later with reference to FIG. 52, transmits the rotation of a drive motor MO (see FIG. 52) to the drum 160, causing the drum 160 to rotate clockwise as viewed in FIG. 25. The drum cassette 140 is positioned relative to the developing device 60, which support developing rollers 320 and 330, in order to accurately position the drum 160 relative to the rollers 320 and 330.

Figure 27:
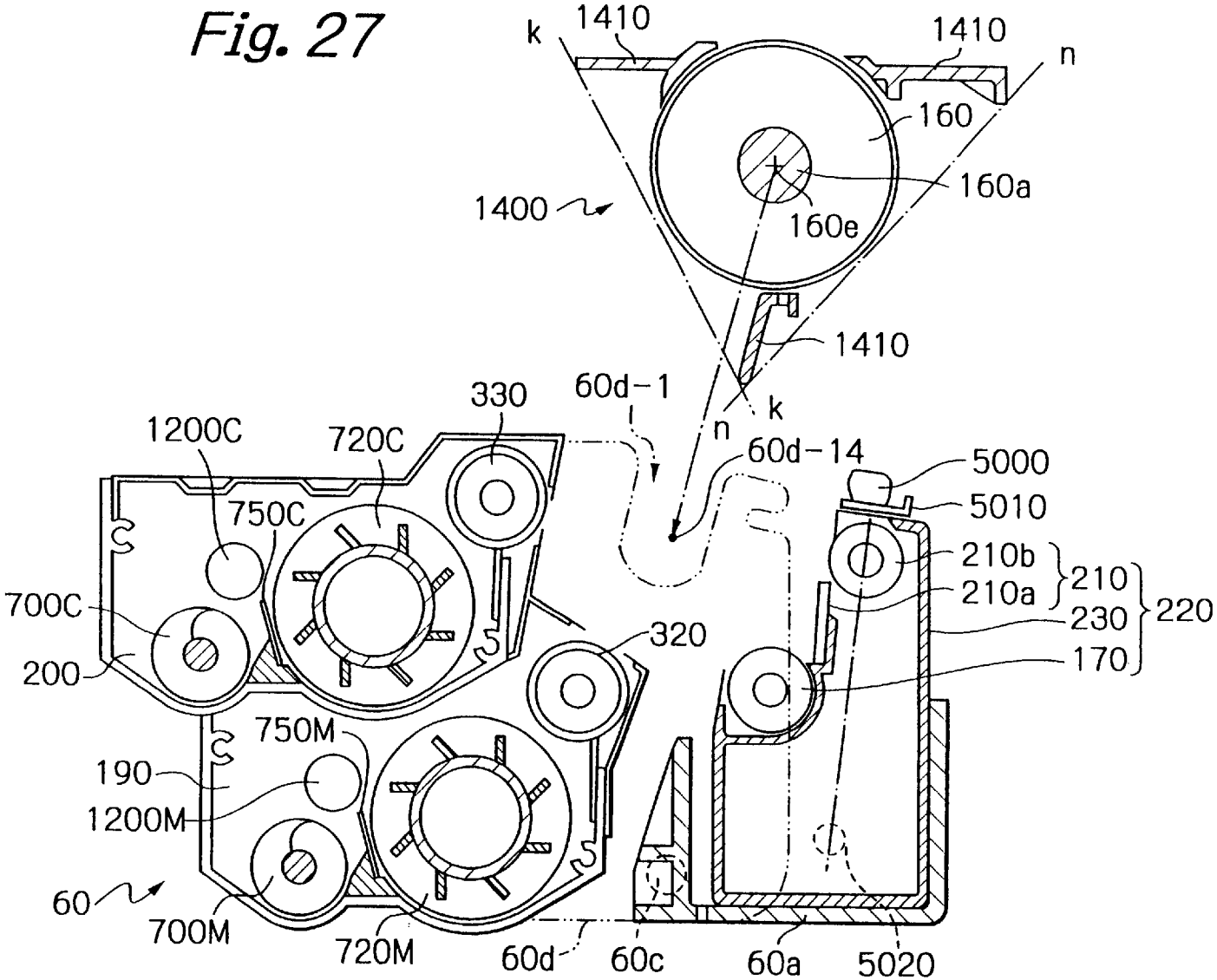
FIG. 27 is a view showing a relation between the developing device and a drum cassette.
Figure 28:
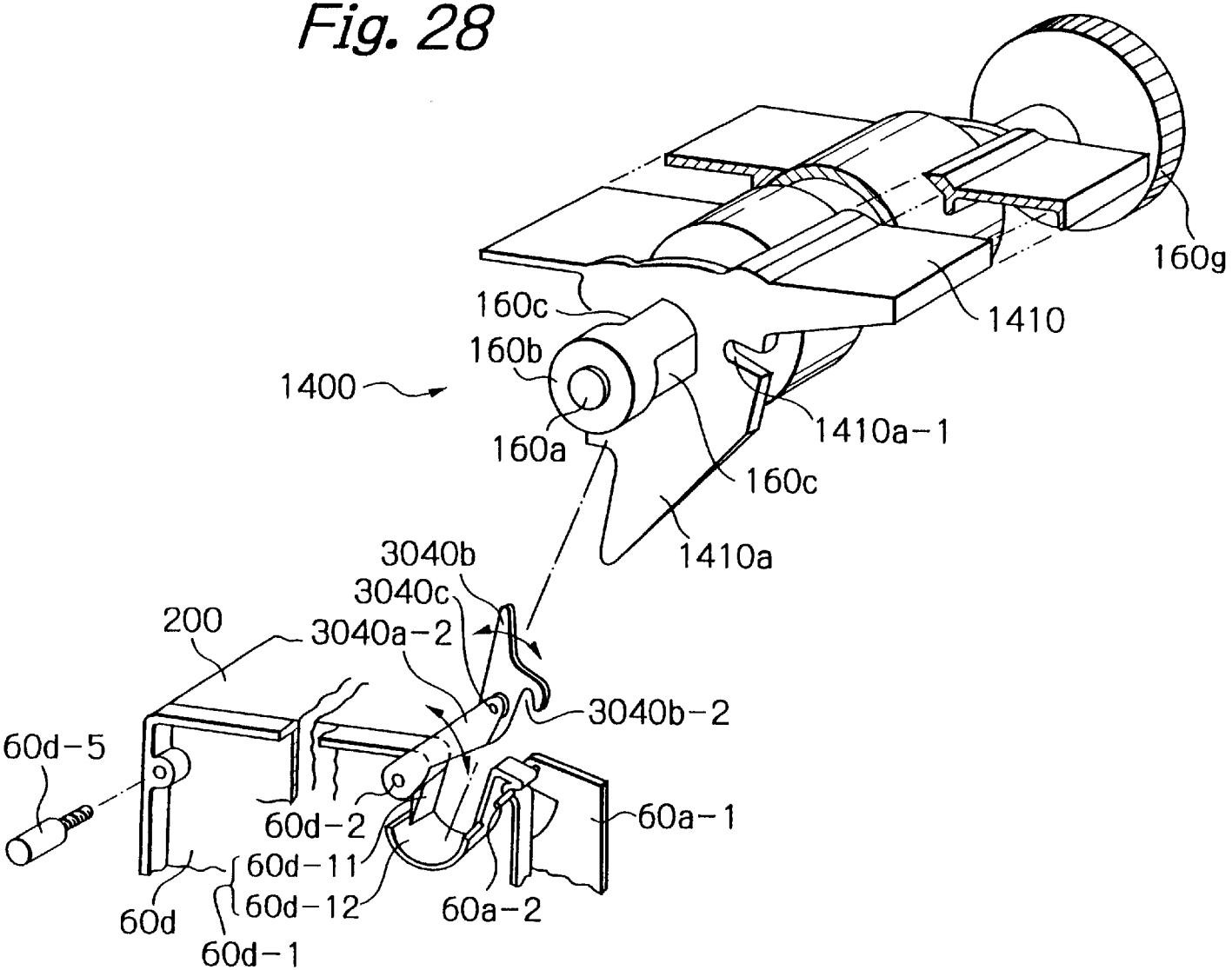
FIG. 28 is an exploded isometric view showing the drum cassette and locking means for locking it.

In the illustrative embodiment, the drum cassette 1400 is expected to adjoin or contact the developing rollers 330 and 320 and cleaning means 220 and is therefore exposed to the outside. It follows that the exposed portion of the drum cassette 1400 is apt to contact, e.g., a floor when the cassette 1400 is put on the floor, damaging the drum 160. In light of this, as shown in FIG. 27, the holder or framework 1410 includes a plurality of projections positioned around the drum 160 at preselected intervals. Lines k—k and n—n, for example, each connecting the tips of particular projections are positioned outward of the surface of the drum 160. When the drum cassette 1400 with this configuration is put on the floor with the line k—k or n—n at the bottom, the holder 1410 successfully prevents the drum 160 from contacting the floor.

As shown in FIG. 25, a cleaning cassette 220 including cleaning means 210 and a charge roller or charger 170 is positioned relative to the drum cassette 1400, so that the cleaning means 210 and charge roller 170 are accurately positioned relative to each other. The cleaning cassette 220 is movable toward and away from the drum cassette 1400. How the cleaning cassette 220 is positioned and moved will be described specifically later.

The configuration of the drum cassette 1400 and the relation thereof to the developing device 60 and cleaning cassette 220 described above allow the drum 160 to be replaced alone. This allows the time for replacing the drum cassette 1400 to be determined only on the basis of the life of the drum 160. That is, only a member that should be replaced is replaced in order to avoid wasteful expenses. This is one of points unique to the illustrative embodiment.

Further, to promote efficient replacement of the drum cassette 1400, only the cassette 1400 should preferably be removable from the apparatus body prior to the developing device 60 and cleaning cassette 220. The drum 160, i.e., the drum cassette 1400 is the process element that should be replaced most frequently. Dismounting the developing device 60 and cleaning cassette 220, which do not have to be replaced, at the time of replacement of the drum cassette 1400 is not only troublesome and undesirable from the appliance standpoint, but also contaminates the operator's hand and surroundings. Another point of the illustrative embodiment is that only a unit that should be dismounted is dismounted. A further point is that a unit that should be frequently replaced is dismounted prior to the other units.

The points unique to the illustrative embodiment described above also apply to the other cassettes and units included in each image station. It is to be noted that the drums 160 and 260 may be replaced with photoconductive belts, if desired.

Today, the life of the drum 160, which determines the time for replacing the drum cassette 1400, is as long as one corresponding to 400,000 to 500,000 sheets (four to five times as long as the traditional life). On the other hand, specifications and structural conditions required of an image forming apparatus are severe when the drum diameter should be small enough to implement a small size, light weight apparatus or when a plurality of developing sections adjoin a single drum, as shown in FIG. 24. In this environment, there is a tendency that a drum is used in such away that its fatigue is accelerated. More specifically, even though the life and durability of a drum may be improved, the drum must, of course, be frequency replaced if used hard. The frequency of replacement of a drum is not expected to be reduced even in the future.

In the cleaning cassette 220, the charge roller 170 uniformly charges the surface of the drum 160. A cleaning blade 210*a* removes toner left on the surface of the drum 160 after image transfer as well as impurities. A seal roller 210*b* prevents toner from flying about during cleaning. The cleaning blade 210*a* and seal roller 210*b* constitute cleaning means 210. A cleaning case or holder 230 supports the charge roller 170 and cleaning means 210 such that they adjoin the surface of the drum 160. The cleaning case 230 stores toner collected from the drum 160.

More specifically, the charge roller 170 and seal roller 210*b* are rotatably mounted on the cleaning case 230 and operatively connected to the drum 160 by a gear train not shown. The driveline, which will be described later with reference to FIG. 52, causes the drum 160 to rotate. The driveline is selectively brought into or out of mesh in accordance with the movement of the cleaning cassette 220 relative to the drum cassette 1400.

Usually, the charge roller 170 and cleaning means 210 have substantially the same life corresponding to, e.g., 400,000 sheets to 500,000 sheets in order to minimize wasteful replacement. The space available in the cleaning case 230 is selected that it is filled up with collected toner before the life of the charge roller 170 and cleaning means 210 ends. The cleaning cassette 220 is accommodated in a cassette case 60*a* together with the developing device 60 so as to be accurately positioned relative to the drum cassette 1400 and drum 160. Further, the cleaning cassette 220 is removable from the cassette case 60*a* and can be replaced alone, as will be described specifically later.

The cleaning cassette 220, like the drum cassette 1400, is positioned and fixed in place on the developing device 60 and is removable alone.

As shown in FIG. 24, the cleaning cassette 220 necessarily occupies a broad range around the drum 160, e.g., a range extending from the right-hand side of the drum 160 to the bottom of the same, as illustrated, due to the decreasing size of the apparatus and that of the drum 160 itself. In this condition, the cleaning cassette 220 cannot be dismounted, e.g., upward unless the drum cassette 1400 is dismounted first. This kind of configuration therefore not only miniaturizes the apparatus, but also allows the drum cassette 1400 to be easily dismounted prior to the other units. Moreover, the above configuration prevents the operator from dismounting the cleaning cassette 220 without being conscious of the preselected priority order. This clearly shows the operator a step to be taken next and is therefore desirable from the appliance aspect, while obviating mishandling and damage to parts during replacement. This is particularly true with an image forming apparatus whose expendables are expected to be replaced by the user.

In the illustrative embodiment, the drum 160 and the body of the image forming device each are dismounted perpendicularly to the axis thereof. Therefore, the drum 160, for example, is prevented from contacting the driveline when mounted or dismounted. This is contrastive to a case wherein the drum 160 is mounted and dismounted in the axial direction thereof.

The full state of the cleaning cassette 220 is reported to the user for thereby urging the user to replace the cassette 220. Of course, the charge roller 170 and cleaning means 210 made up of the cleaning blade 210*a* and seal roller 210*b* are only illustrative. Further, the crux of the illustrative embodiment similarly applies to a cleaningless cassette.

The drum cassette 1400 is positioned and fixed in place integrally with the developing device 60 and is removable alone, as stated above. The developing device 60 includes the previously mentioned magenta developing section 190 and cyan developing section 200 in which the developing rollers 320 and 330, respectively, are disposed. In addition, the developing device 60 includes the cassette case 60*a* that accommodates cleaning cassette 220. Such components of the developing device 60 are joined together by the cassette case 60*a* and a developing device side wall 60*d*, which will be described later.

In the cyan developing section 200, cyan toner is fed to one end of a screw 700C via a port 1200C. The screw 700C conveys the cyan toner to the inside of the developing chamber 200. A paddle roller 720C conveys the cyan toner in opposite direction to the screw 700C while agitating it, thereby charging the toner. The charged cyan toner deposits on the developing roller 330. A partition 750C separates the screw 700C and paddle roller 720C and therefore the two opposite flows of the cyan toner.

Likewise, in the magenta developing section 190, magenta toner is fed to one end of a screw 700M via a port 1200M. The screw 700M conveys the magenta toner to the inside of the developing chamber 190. A paddle roller 720M conveys the magenta toner in opposite direction to the screw 700M while agitating it, thereby charging the toner. The charged magenta toner deposits on the developing roller 320. A partition 750M separates the screw 700M and paddle roller 720M and therefore the two opposite flows of the magenta toner. The yellow developing section 290 and black developing section 300 constituting the developing device 80 are identical with the cyan developing section 200 and magenta developing section 190 except for the color or toner.

As shown in FIG. 25, the cassette case 60*a* is angularly movable supported by the developing device side wall 60*d*, so that the cleaning cassette 220 is movable toward and away from the drum cassette 1400. More specifically, the cassette case 60*a* supports a generally U-shaped holder 5010 that is angularly movable about a shaft 5020. The holder 5010 and shaft 5020 constitute a locking mechanism.

A quenching lamp or discharging means 5000 is mounted on the top of the holder 5010 for dissipating potential left on the drum 160 after image transfer. Usually, the quenching lamp 5000 is positioned between the holder 1410 of the drum cassette 1400 and the cleaning cassette 220, so that it can illuminate the drum 160. The quenching lamp 5000 moves toward or away from the drum cassette 1400 in accordance with the angular movement of the cassette case 60*a*, i.e., cleaning cassette 220. The developing device 60 is fixed in place at a reference portion defined on the apparatus body, particularly opposite side walls 3000 and 4000 thereof.

In the illustrative embodiment, the magenta developing section 190 and cyan developing section 200 are of toner replenishment type and are basically not replaced, as will be described more specifically later. It has been customary to rigidly mount the sections 190 and 200 on the apparatus body by, e.g., adhesion, squeezing or special screws. In the illustrative embodiment, the sections 190 and 200 are implemented as the developing device 60 removably mounted to the apparatus body in order to facilitate replacement or disassembly ascribable to expected troubles or recycling work.

As shown in FIG. 24, the magenta developing section 190 and cyan developing section 200 necessarily occupy a broad range extending from the left-hand side of the drum cassette 1400 to the bottom of the same symmetrically to the cleaning cassette 220 due to the decreasing size of the apparatus. In this condition, the sections 190 and 200 cannot be dismounted upward unless the drum cassette 1400 is dismounted before the sections 190 and 200. This kind of configuration therefore not only miniaturizes the apparatus, but also allows the drum cassette 1400 to be easily dismounted prior to the other units. Moreover, the above configuration prevents the operator from dismounting the developing device 60 without being conscious of the preselected priority order. This clearly shows the operator a step to be taken next and is therefore desirable from the appliance aspect, while obviating mishandling and damage to parts during replacement. This is particularly true with an image forming apparatus whose expendables are expected to be replaced by the user.

To summarize the first image station 140, the developing device 60 is positioned and fixed in place at the reference position of the apparatus body assigned to the first image station 140. Subsequently, the drum cassette 1400 and cleaning cassette 220 are mounted to the developing device 60 and positioned relative to the device 60. The drum cassette 1400 and cleaning cassette 220 each are removable from the developing device 60 alone. The developing device 60 is removable from the apparatus body alone. This insures an accurate relative position between the cassettes or units and facilitates replacement. The drum cassette 1400, which needs the most frequent replacement, cannot be dismounted unless it is dismounted before, e.g., the cleaning cassette 220 alone. Further, the drum cassette 1400 should be mounted after the other units. That is, the drum cassette 1400 is dismounted first, then the cleaning cassette 220 is dismounted, and then the developing device 60, if necessary, is dismounted. Alternatively, after the removal of the drum cassette 1400, the cassette case 60*a* may be bodily removed in order to dismount the cleaning cassette 220 and developing device 60 together.

Japanese Patent Laid-Open Publication No. 11-295952 mentioned earlier also teaches that a developing device is removably mounted to an apparatus body in consideration of replacement ascribable to unexpected troubles or recycling work. However, the illustrative embodiment differs from the above document in object and therefore in construction, as will be described hereinafter.

Specifically, at the time when Laid-Open Publication No. 11-195952 was filed, the maximum life of a developer was as short as one corresponding to 100,000 sheets, requiring a developing device to be replaced as frequently as a drum unit as an expendable. Therefore, from the appliance standpoint, a slidable member was used to fix the developing device in place on an apparatus body together with the drum unit, thereby facilitating mounting and dismounting. However, in such an arrangement directed toward easy mounting and dismounting, the developing device unlocked from the apparatus body simply rested on the apparatus body due to its own weight. As a result, the drum unit was replaced with the developing device being held in an unstable position. Replacement was therefore extremely inefficient and was apt to damage a drum. Moreover, repeated replacement necessary brought about deviation or play between the developing device and the drum unit. The deviation or play sequentially accumulated and finally effected images.

State-of-the-art developers have a life comparable with the life of a machine. Therefore, a developing device, which has been replaced on the basis of the life of a developer, is not an expendable, but a component that basically needs no replacement. In light of this, in the illustrative embodiment, the developing device or unit 60 is mounted to the apparatus body alone as one of stationary parts constituting the apparatus body. This is why the developing device 60 is used as the reference of the first image station 140 as to position.

However, the developing device 60 should be constructed in consideration of troubles, damage to parts, contamination ascribable to flying toner and other unexpected occurrences as well as repair, replacement, cleaning, disassembly and recycling. For this purpose, the illustrative embodiment additionally includes locking means (lever 3040 to be described later) for allowing the developing device 60 to be selectively locked to or unlocked from the apparatus body alone. The locking means frees the developing device 60 from play at the time of replacement and allows it to be easily dismounted, as needed.

The cleaning cassette 220 also needs exclusive locking means that prevents the cassette 220 from shaking at the time of replacement of the drum cassette 1400 for the following reason. In the illustrative embodiment, the drum cassette 1400 does not include any process means except for the drum 160 and separate from the charge roller 170 and cleaning means 210. Therefore, should the cleaning cassette 220 shake at the time of replacement of the drum cassette 1400, the charger roller 170 or the cleaning means 210 would scratch the drum 160. By contrast, a conventional drum unit includes a drum, a charger and a cleaning blade, as taught in, e.g., Laid-Open Publication No. 11-295952. This kind of unit can, of course, be dismounted without scratching the drum.

The second image station 240 is identical in configuration with the first image station 140 except for the color of toner and will not be described specifically in order to avoid redundancy.

The illustrative embodiment is applicable to all kinds of electrophotographic process means without regard to color/black-and-white, the number of drums or that of developing units as well as their structure or the construction of the apparatus body.

In the illustrative embodiment, the brush 410 and a roller 390 for the image transfer from the drum 160 to the belt 100 (primary image transfer) are not moved toward or away from the belt 100. This, coupled with the fact that the belt 100 is angularly spaced from the writing position of the drum 160 by 180°, protects a toner image transferred to the belt 100 from disturbance even when the drum 160 becomes eccentric.

Further, in the illustrative embodiment, the belt 100 is retracted when the drum 160 is removed, and then returned to its original position after a new drum 160 has been set. The drum 160 can therefore be replaced only if the belt 100, which does not have to be accurately positioned relative to the drum 160, is retracted and then returned, protecting images from adverse influence.

Reference will be made to FIGS. 25 through 29 for describing a procedure for dismounting the drum cassette 140 and cleaning cassette 220 located at the first image station, FIG. 24, more specifically. FIG. 25 shows the first image station 140 positioned at the preselected reference position on the apparatus body. As shown, the charge roller 170, magenta developing section 190, cyan developing section 200, quenching lamp 5000 and cleaning blade 210*a* are arranged on the developing device side wall 60*d* and cassette case 60*a* around the drum 160. While the developing device side wall 60*d* and cassette case 60*a* with such image forming means should be referred to as the body of an image forming section, it is referred to as the developing device 60 as well because the developing sections are the main component.

More specifically, the developing device side wall (simply side wall hereinafter) 60*d* supports the magenta developing section 190 and cyan developing section 200 and supports the cassette case 60*a* such that the case 60 is angularly movable about the shaft 60*c*. A generally U-shaped notch 60*d*-1 is formed in the top of the side wall 60*d*. The shaft 160*a* of the drum 160 is received in the notch 60*d*-1 so as to position the drum cassette 1400. The cassette case 60*a* supports the holder 5010 such that the holder 5010 is angularly movable about the shaft 5020. FIGS. 26 through 29 show consecutive conditions following the condition of FIG. 25.

Figure 26:
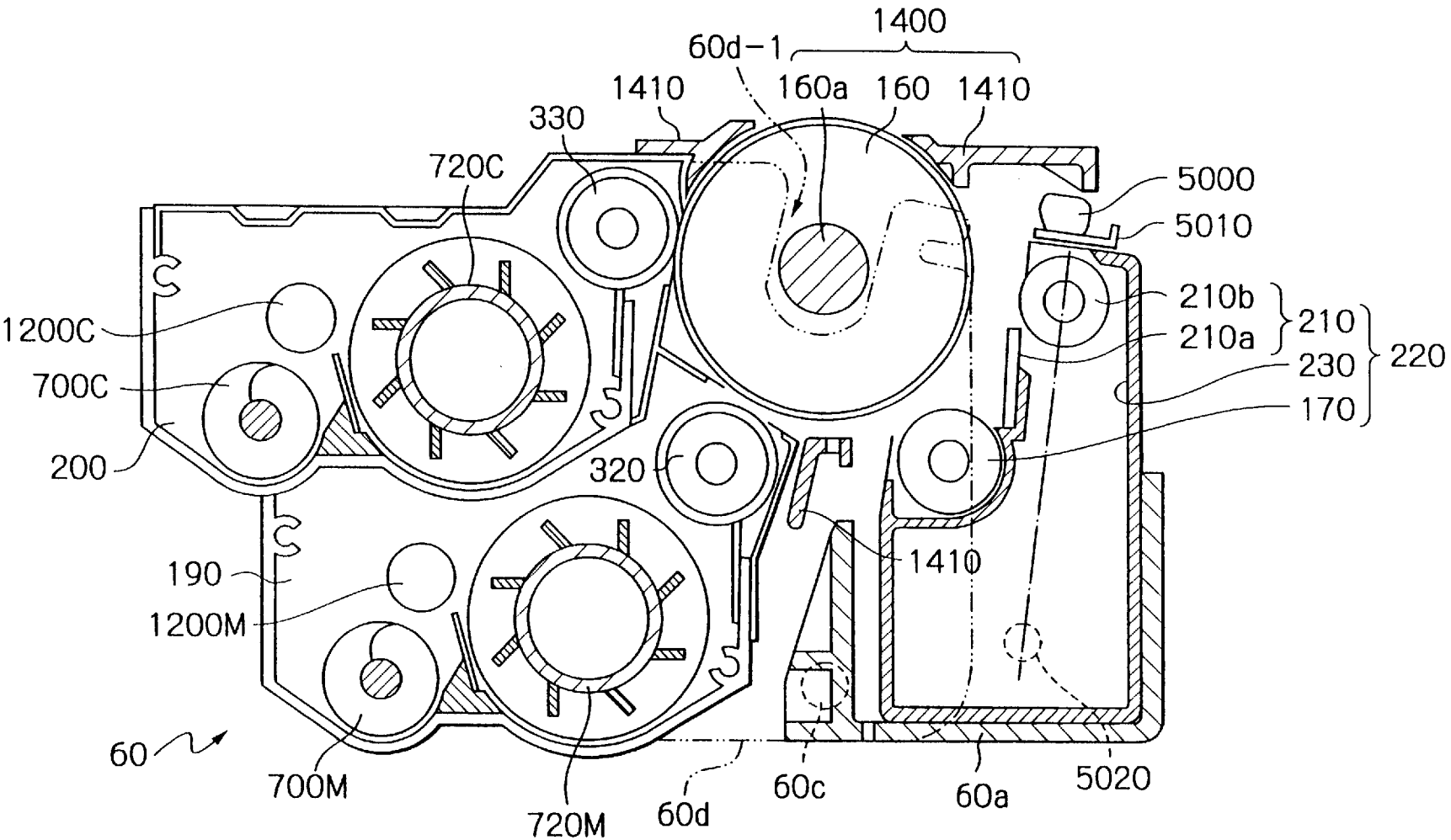

First, the cassette case 60*a* is unlocked, as will be described more specifically later, in order to move the cassette case 60*a* to the right, as indicated by an arrow in FIG. 25. As a result, as shown in FIG. 26, the charge roller 170 and cleaning means 210, i.e., cleaning cassette 220 and quenching lamp 5000 are moved away from the drum 160. That is, the cleaning blade 210*a* and seal roller 210*b* are released from the drum 160, allowing the drum cassette 1400 to be removed.

More specifically, as shown in FIG. 25 by way of example, the seal roller 210*b* in the preselected position faces the developing roller 330 with the intermediary of the drum 160. In this position, the seal roller 210*b* contacts part of the circumference of the drum 160 positioned above an imaginary plane that contains the axis of the developing roller 330 and that of the drum 160. The drum 160 cannot be picked out upward unless the seal roller 210*b* is spaced from the drum 160 beforehand. Likewise, the drum 160 cannot be mounted or dismounted unless the cleaning blade 210*a* is released from the drum 160. This is why the cassette case 60 *a* is moved to the right about the shaft 60*c* beforehand.

Subsequently, as shown in FIG. 27, the drum cassette 1400 picked out upward away from the side wall 60*d* along the notch 60*d*-1. Thereafter, the holder 5010 is moved to the left about the shaft 5020 in order to move the cleaning cassette 220 out of the dismounting range. The cleaning cassette 220 is then picked out upward away from the cassette case 60 *a*, as shown in FIG. 29.

As shown in FIG. 29, the cleaning case 230 has a box-like configuration that includes a hermetically sealed space below the cleaning blade 210*a* and seal roller 210*b*. This space constitutes a storage 230*h* for storing the toner scraped off from the drum 160 by the cleaning blade 210*a*. The storage 230*h* is configured integrally with the cleaning cassette 220 and removable from the developing device 60. Therefore, when the storage 230*h* is filled up with waste toner, the cleaning cassette 220 is bodily replaced. Alternatively, only the waste toner may be discarded in order to reuse the cleaning cassette 220.

FIGS. 30 through 40 show the above procedure even more specifically. In FIGS. 30 through 40, the procedure described with reference to FIGS. 25 through 29 is reversed in order to facilitate an understanding of the description and figures. In FIGS. 30 through 40, emphasis is put on the major part of the configuration for the same purpose.

As shown, in the developing device 60, the developing device side wall 60*d* is formed with holes 1200M and 1200C for replenishing toner to the magenta developing chamber 190 and cyan developing chamber 200, respectively. The notch 60*d*-1 is made up of a generally U-shaped notch 60*d*-11 and a substantially semicircular protuberance 60*d*-12 protruding from the edge of the notch 60*d*-11 forward in the direction perpendicular to the sheet surface of, e.g., FIG. 30. Only the notch 60*d*-1 is inclined at a certain angle. A shaft 60*d*-2 protrudes from the side wall 60*d* forward in the above direction in the vicinity of the notch 60*d*-1. The previously mentioned lever 3040 is pivotally supported by the shaft 60*d*-2.

A hole 60*d*-3 is formed in the side wall 60*d* below the notch 60*d*-1. A generally U-shaped notch 60*d*-4 is formed in the side wall 60*d* and faces the lever 3040 with the intermediary of the notch 60*d*-1. The notch 60*d*-4 has a depth corresponding to a radius of curvature having a center coincident with the hole 60*d*-3. A shaft 60*d*-5 protrudes from the side wall 60*d* forward in the direction perpendicular to the sheet surface of, e.g., FIG. 30, at a top left position that is opposite to the notch 60*d*-1.

The cassette case 60*a* is a box-like, top-open case. The cassette case 60*a* is positioned between opposite side walls 60*d* such that the outer surface of the side wall 60*a*-1 of the case 60*a* positioned at the front in the direction perpendicular to the sheet surface of, e.g., FIG. 30 and the inner surface of the side wall 60*d* positioned at the rear slide on each other. The cassette case 60*a* faces the magenta developing section 190 and cyan developing section 200. The shaft 60*c* and a shaft 60*a*-2 protrude from the outer surface of the side wall 60*a*-1 forward in the above direction.

The shaft 60*c* is received in the hole 60*d*-3, so that the side wall 60*d* rotatably supports the cassette case 60*a*. When the shaft 60*a*-2 enters and abuts against the bottom of the U-shaped notch 60*d*-4, the bottom of the notch 60*d*-4 stops the cassette case 60*a* angularly moving to the left about the shaft 60*c*. It is to be noted that the position where the shaft 60-2 abuts against the left edge of the notch 60*d*-4 is the position where the cassette case 60*a* is set during image formation.

The shaft 5020 mentioned earlier protrudes from the inner surface (rear surface) of the side wall 60*a*-1 of the cassette case 60*a*. The shaft 5020 rotatably supports the holder 5010 of the quenching lamp 5000 positioned at the inward or rearward of the cassette case 60. A right-angled bearing 5030 is mounted on the top of the holder 5010. Ribs 60*a*-3 and 60*a*-4 extend from the bottom upward on the inner surface of the side wall 60*a*-1 at opposite sides of the shaft 5020.

Figure 30:
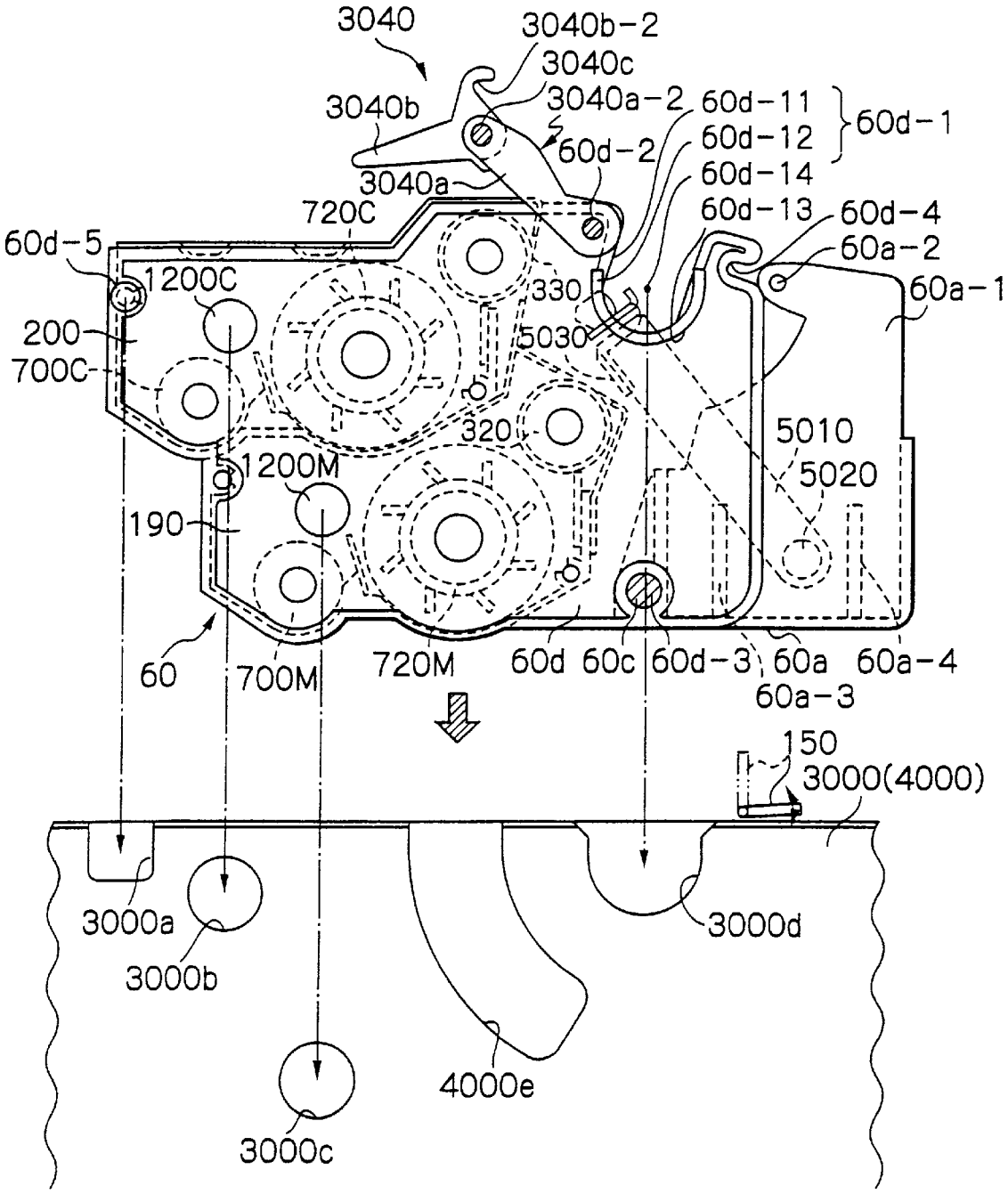
FIG. 30 is a view showing a relation between the developing device and a side wall included in the apparatus body.

The side wall 3000 included in the apparatus body is implemented by a generally L-shaped thin sheet metal whose top is bent toward the front in the direction perpendicular to the sheet surface of, e.g., FIG. 30. The side wall 3000 is formed with notches and holes so configured as to mount the magenta developing section 190 and cyan developing section 200. The notches and holes will be sequentially described from the left toward the right hereinafter in correspondence to the magenta developing section 190 and cyan developing section 200.

A top-open, generally U-shaped notch 3000*a* corresponds in position to the shaft 60*d*-5. A hole 3000*b* corresponds to the hole 1200C for the replenishment of cyan toner while a hole 3000*c* corresponds to the hole 1200M for the replenishment of magenta toner. The holes 3000*b* and 3000*c* are greater in diameter than the holes 1000C and 1200M, respectively. A top-open, semicircular notch 3000*d* corresponds to the semicircular protuberance 60*d*-13 protruding from the edge of the notch 60*d*-12.

A top-open, curved notch 4000*e* is positioned at the left-hand side of the notch 3000*d*. Drive means for driving the developing device is mounted on the rear side wall 4000 of the apparatus body in the direction perpendicular to the sheet surface of, e.g., FIG. 30. The notch 4000*e* is configured to receive the drive means. Drive means arranged on the developing chambers 190 and 200 are connected to the above drive means via the notch 4000. The rear side wall 4000 is identical with the front side wall 3000 except that it lacks the holes 3000*b* and 3000*c*.

Figure 31:
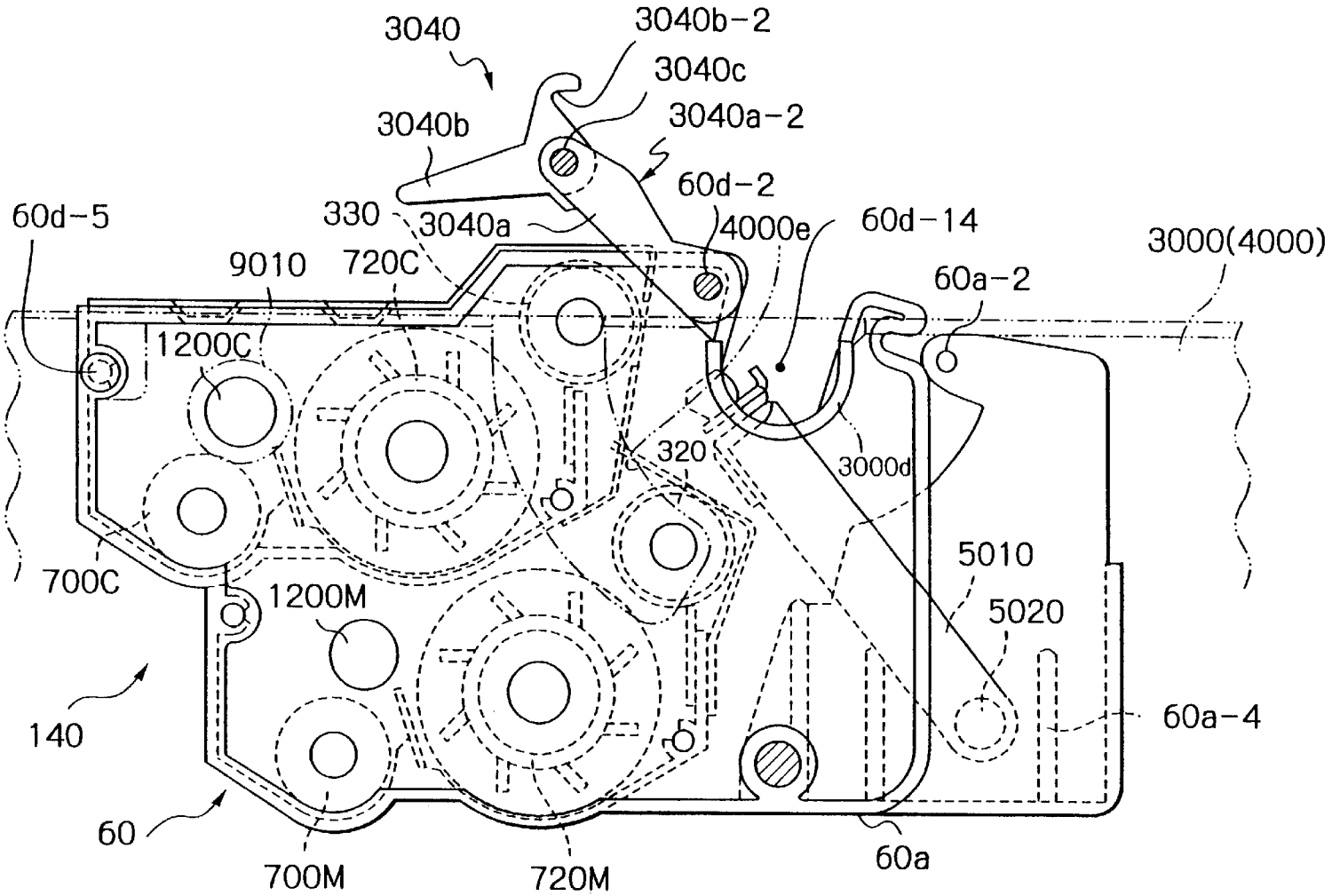
FIG. 31 is a front view showing developing device mounted to the side wall.

FIG. 31 is a front view showing the developing device 60 lowered substantially vertically and mounted to the side wall 300 of the apparatus body. As shown, the semicircular protuberance 60*d*-13 of the developing device 60 is received in the semicircular notch 300*d* of the side wall 3000, positioning the developing chambers 190 and 200 relative to the side wall 3000 in the right-and-left direction and the direction of height. In this condition, the center 60*d*-14 of the protuberance 60*d*-13 constitutes a reference position for the first image station 140. The shaft 60*d*-5 of the developing device 60 contacts the horizontal bottom of the notch 3000*a*. This prevents the developing device 60 from rotating and cooperates with the protuberance 60*d*-13 to position the device 60 relative to the side wall 3000 in the direction of height. The developing device 60 is therefore held in a preselected position for image formation.

At this stage of procedure, the developing device 60 is positioned on the side wall 3000, but is not fixed in place, i.e., simply rests on the side wall 3000 (and side wall 4000). In the apparatus taught in Laid-Open Publication No. 11-295952, the drum cassette 140 is mounted to and dismounted from the developing device held in such an unstable position, bringing about the problems discussed earlier.

The illustrative embodiment surely locks the developing device 60 to the apparatus body, i.e., side wall 3000 (and side wall 4000). Special, exclusive locking means, however, would make the configuration complicated and high cost. In the illustrative embodiment, the drive means and toner replenishing means assigned to the developing chambers 190 and 200, as well as other essential parts and means, play the role of locking means at the same time for a small-size, low-cost configuration, as will be described hereinafter.

Figure 32B:
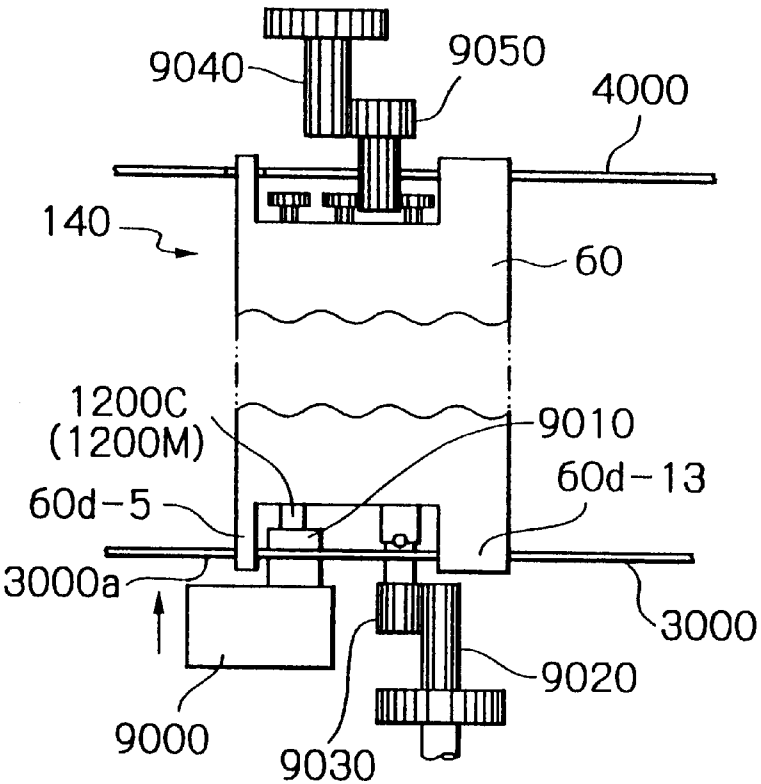
FIG. 32B is a view showing the developing device locked to the apparatus.
Figure 32A:
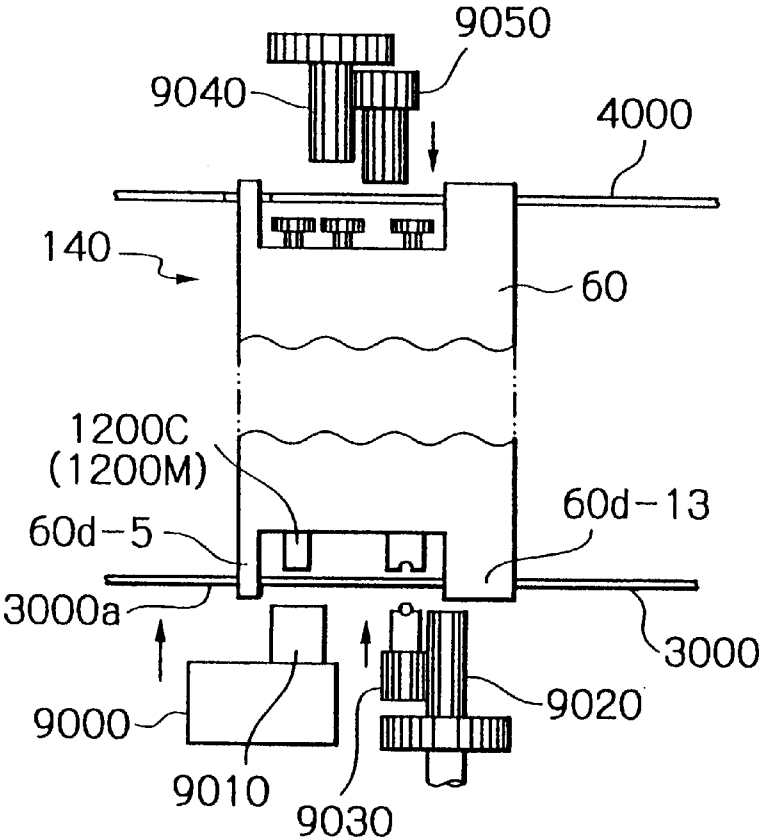
FIG. 32A is a view showing the developing device unlocked from the apparatus.

FIGS. 32A and 32B are plan views showing how the locking means locks the developing device 60 to the apparatus body in a simplified view. FIG. 32A shows a condition before locking. As shown, toner replenishing means 9000, drive means 9020 for switching the magnetic pole of the developing roller and developing roller drive means 9040 are positioned outside of the side walls 3000 and 4000. A pipe 9010 accommodating a screw therein, a gear shaft 9030 and a gear 9050 (movable parts) included in the above means 9000, 9020 and 9040, respectively, are passed through holes formed in the side walls 3000 and 4000 toward the cyan developing chamber 190. As a result, the developing device 60 is locked to the apparatus body.

In FIGS. 32A and 32B, only the toner replenishing means 9000 and pipe 9010 assigned to the cyan developing chamber 200 is visible. Toner replenishing means and a pipe with a screw identical in configuration and function with the above means 9000 and pipe 9010 are assigned to the magenta developing chamber 200.

The toner replenishing means 9000 includes a hopper to which fresh toner is fed, so that the fresh toner can be replenished to the developing section 190 or 200, as needed.

The movable parts may be operated either automatically or manually, as desired, so long as they can be interlocked to the developing section 190 or 200. Consequently, the developing device 60 is locked to the side wall 3000 (and side wall 4000), as shown in FIG. 32B.

Figure 33:
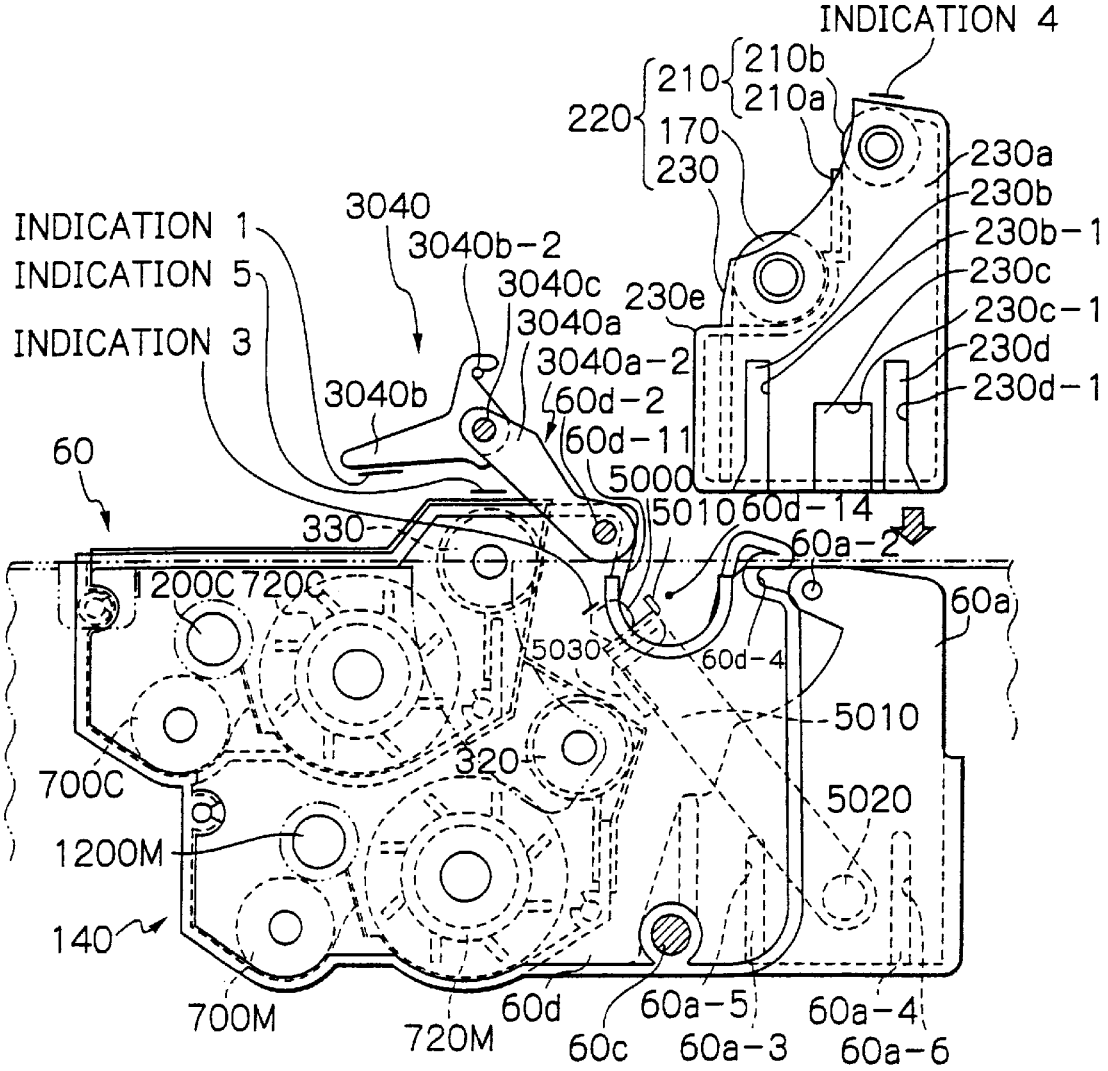
FIG. 33 is a view showing the developing device mounted to the side wall before a cleaning cassette is mounted to the developing device.

FIG. 33 shows the cassette case 60*a* in a condition just before the cleaning cassette 220 is mounted thereto. As shown, the cleaning cassette 220 includes the cleaning case 230, which is a hollow, box-like case. The cleaning means 210 substantially seals the cleaning case 230; the case 230 is fully hermetically sealed on contacting the drum 160. A side wall 230*a* included in the cleaning case 230 rotatably supports the charge roller 170 and seal roller 210*b* positioned inward or rearward of the side wall 230*a*. The outer or front surface of the side wall 230*a* is formed with three parallel grooves 230*b*, 230*c* and 230*d*. These grooves 230*b* through 230*c* each extend from the bottom of the side wall 230*a* upward and are concave rearward or inward. A left side wall 230*e* includes a generally U-shaped bottom portion partly recessed to the left, as viewed in FIG. 33, so as not to lie in an effective scanning range assigned to a laser beam. At this stage of procedure, the quenching lamp 5000 remains in a position rotated to the left about the shaft 5020.

Figure 34:
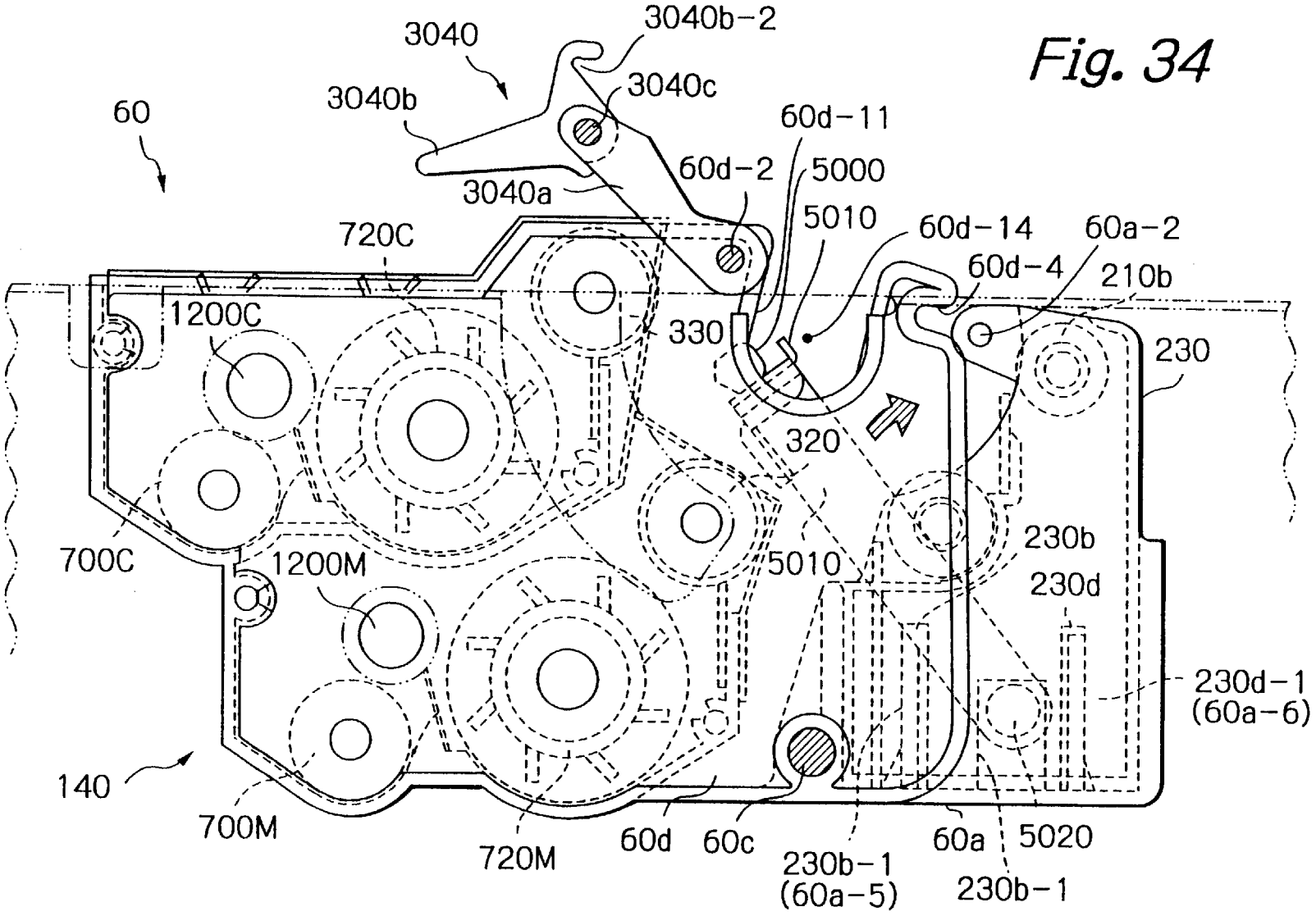
FIG. 34 is a fragmentary front view showing a first image station at which the cleaning cassette is lowered substantially vertically into a cassette case.

FIG. 34 shows the cleaning cassette 220 lowered substantially vertically into the cassette case 60. As shown, the left edge 230*b*-1 of the groove 230*b* and the right edge 230*d*-1 of the groove 230*d* respectively contact the left face 6*a*-5 of the rib 60*a*-3 and the right-face 6*a*-6 of the rib 60*a*-4, positioning the cleaning cassette 220 relative to the cassette case 60*a* in the right-and-left direction. Also, the cleaning cassette 220 smoothly enters the cassette case 60*a* because the ribs 60*a*-3 and 60*a*-4 guide the grooves 230*b* and 230*d*, respectively.

Further, the top edge 230*c*-1 of the groove 230*c* contacts the circumference of the shaft 5020, positioning the cleaning cassette 220 relative to the cassette case 60*a* in the direction of height. In addition, the wall of the groove 230*c* and the free end of the shaft 5020 abut against each other, positioning the cleaning cassette 220 relative to the cassette case 60*a* in the front-and-rear direction in the direction perpendicular to the sheet surfaced of FIG. 34.

Figure 35:
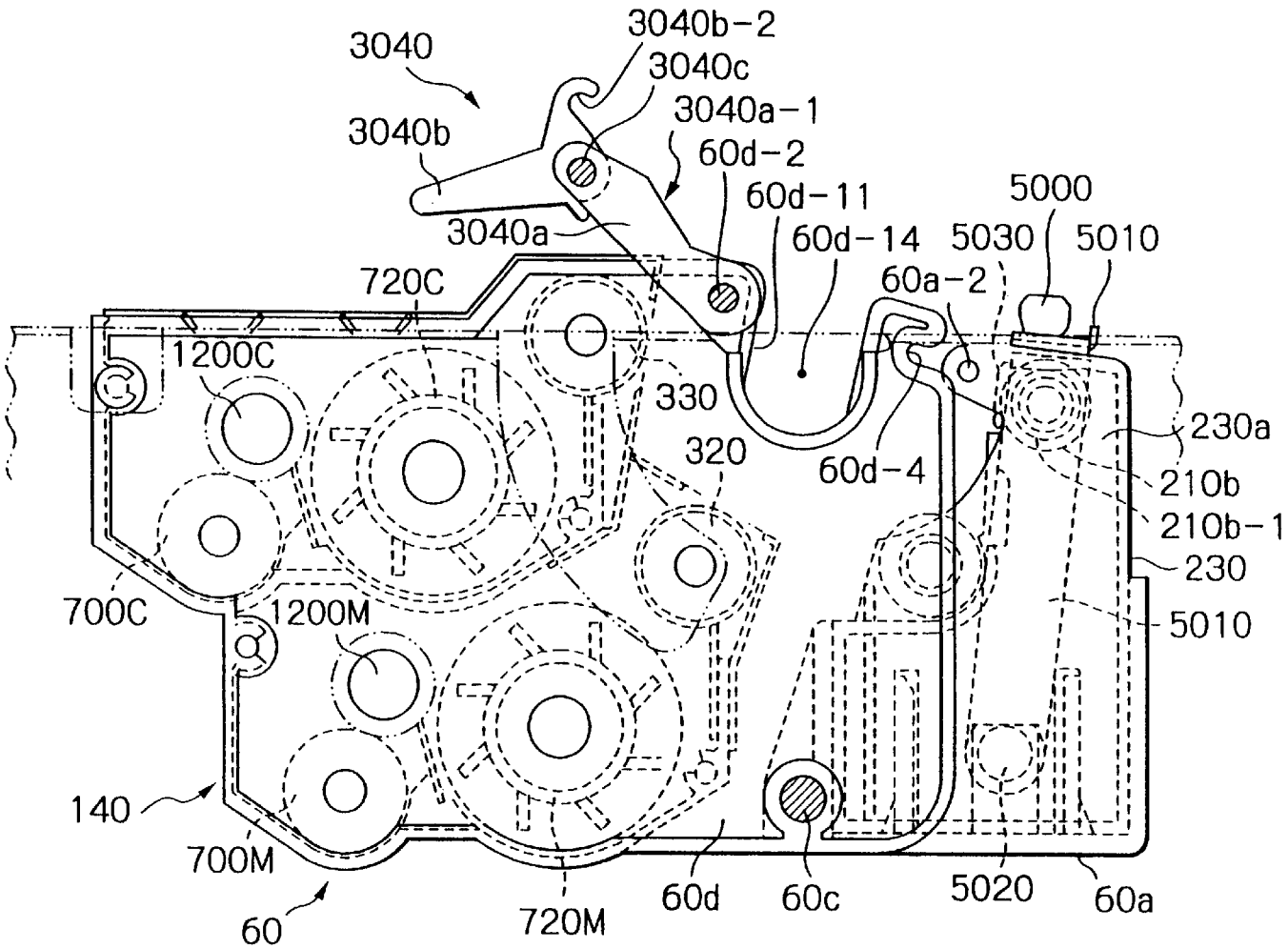
FIG. 35 is a fragmentary front view of the first image station at which the cleaning cassette is mounted to the cassette case, and then the cassette case is locked by a holder.
Figure 36:
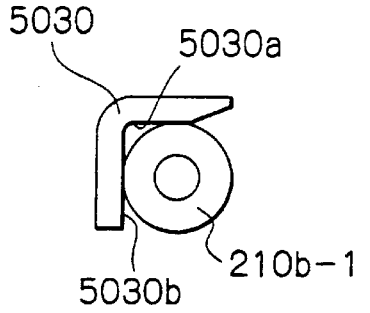
FIG. 36 is a view showing how the circumference of a bearing for rotatably supporting a seal roller on a side wall of a cleaning case engages with the top of a right-angled bearing mounted on the top of the holder.

As shown in FIG. 35, the U-shaped holder 5010 is angularly moved to the right and fixed in place on the cassette case 60*a* in which the cleaning cassette 220 has been received. As shown in FIG. 36 specifically, a bearing 210*b*-1 is mounted on the side wall 230*a* of the cleaning case 230 and rotatably supports the seal roller 210*b*. The bearing 210*b*-1 contacts the top 5030*a* of the right-angled bearing 5030 included in the holder 5010; the bearing 5030 plays the role of a locking piece. In this condition, the top 5030*a* of the bearing 5030 and shaft 5020 cooperate to lock the cleaning cassette 220 to the cassette case 60*a*.

As also shown in FIG. 36, the circumference of the bearing 210*b*-1 contacts the left wall 5030 of the bearing 5030, playing the role of a stop that restricts the rightward movement of the holder 5010. At the same time, the bearing 210*b*-1 and the left wall 5030 define a position where the quenching lamp 5000 should be located. By the procedure described above, the cleaning cassette 220 and quenching lamp 5000 are positioned relative to the cassette case 60*a*.

Figure 37:
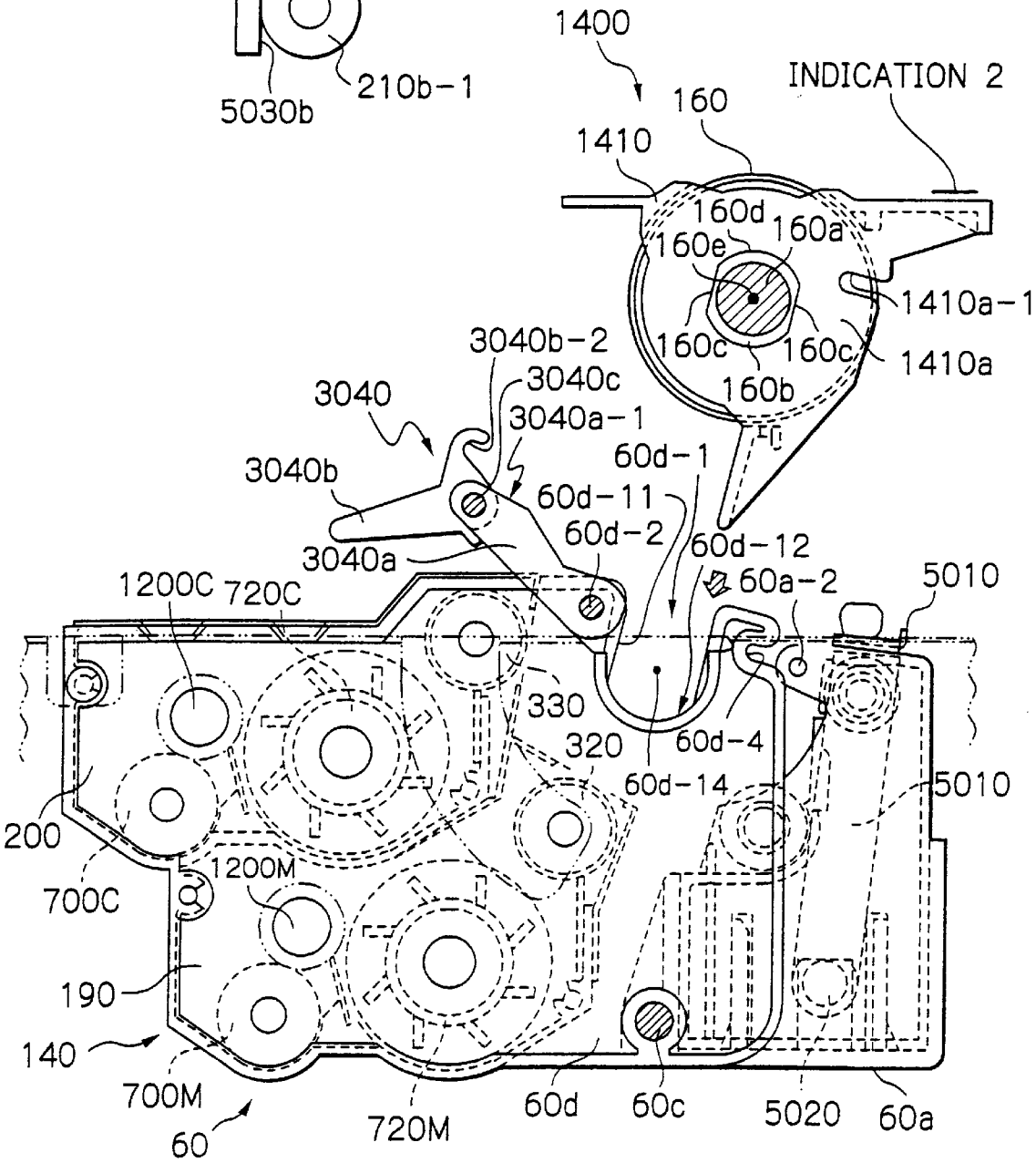
FIG. 37 is a fragmentary front view showing the first image station in a condition just before the mounting of the drum cassette to the developing device.

FIG. 37 shows the developing device 60 before the drum cassette 1400 is mounted thereto. As shown, the shaft 160*a* of the drum 160 is rotatably supported by the side wall 1410*a* of the holder 1410 via an oval bearing 160*b*. The oval bearing 160*b* is mounted on the side wall 1410*a* at an inclined position. The inclination of the bearing 160*b* is coincident with the angle at which the drum cassette 1400 is inserted into the developing device 60. A notch 140*a*-1 is formed in the side wall 140*a* at the right-hand side of the bearing 160*b* and has the same curvature as the notch 60*d*-4 of the developing device side wall 60*d*.

Figure 38:
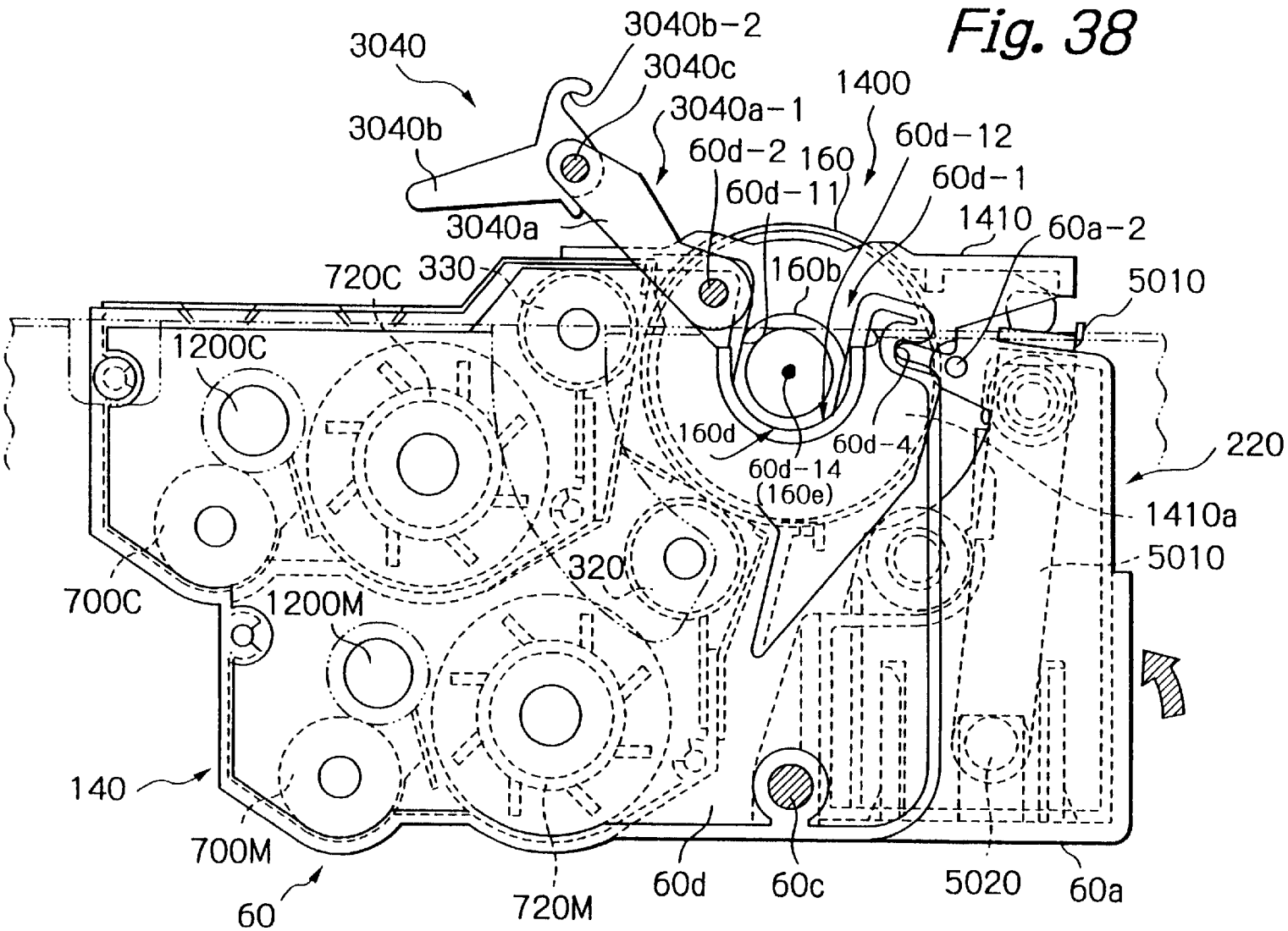
FIG. 38 is a fragmentary front view showing the first image station with the drum cassette being moved obliquely downward onto the developing device.

As shown in FIG. 38, the drum cassette 1400 is lowered obliquely downward into the developing device 60. The outside diameter of the bearing 160*b* contacts the substantially semicircular notch 60*d*-2 of the developing device 60, positioning the drum cassette 1400 relative to the developing device 60 in the direction of height. More specifically, the axis 160*e* of the shaft 160*a*, i.e., the axis of the drum 160 is coincident with the center 60*d*-14 of the developing device 60, which is the reference position assigned to the first image station 140. As a result, the drum 160 is positioned relative to the developing device 60. At the same time, the two parallel portions 160-*c* of the oval bearing 160*b* contact the parallel portions of the notch 60*d*-11, playing the role of a guide and that of a stop.

Further, the outer or front surface of the side wall 1410*a* of the holder 1410 and the inner or rear surface of the developing device side wall 60*d* are slidable on each other, positioning the drum cassette 1400 relative to the developing device 60 in the front-and-rear direction.

When the drum cassette 1400 is being lowered into the developing device 60, the cleaning cassette 220 is spaced from the cassette 1400 without fail and does not scratch the drum 160 at all.

Figure 39:
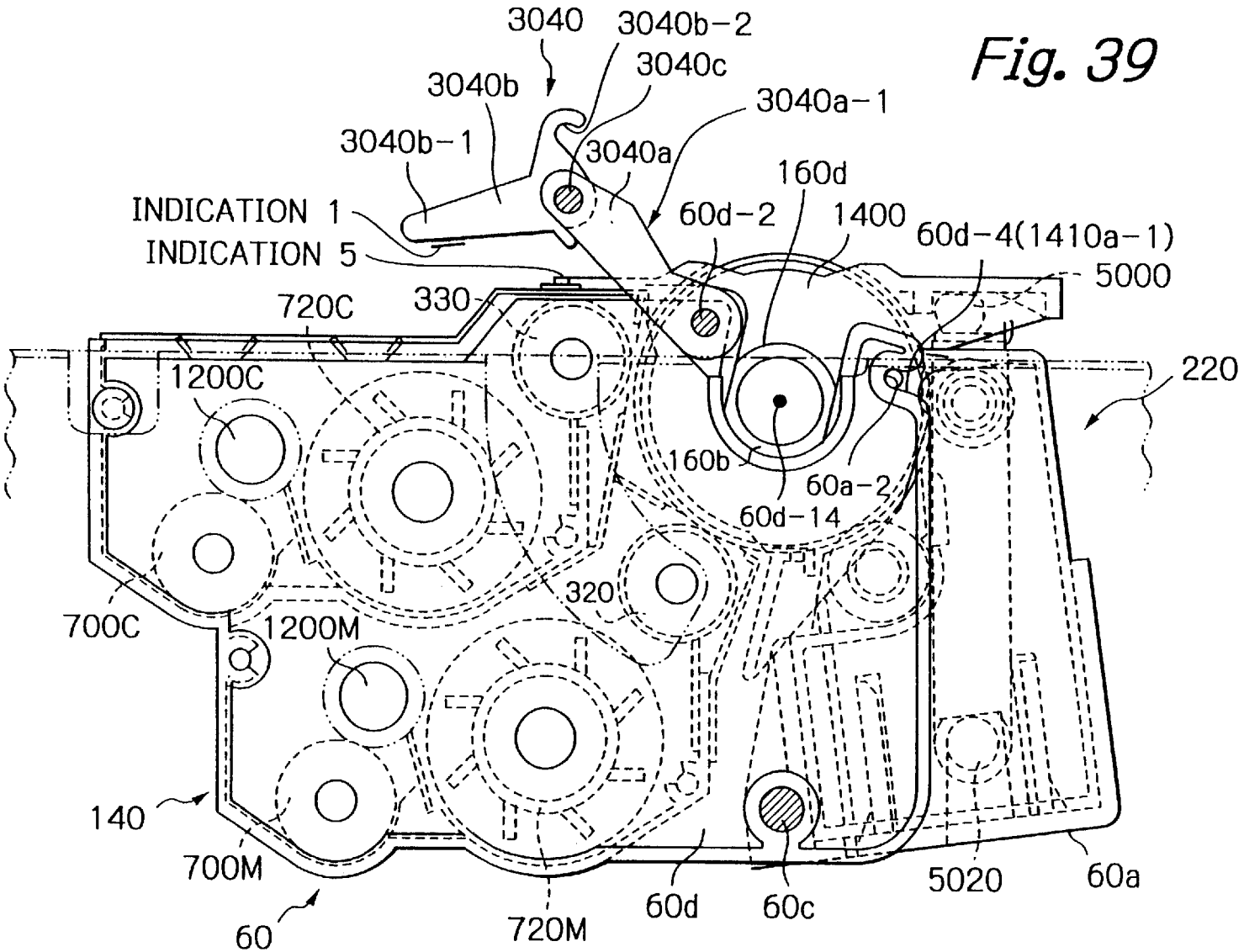
FIG. 39 is a fragmentary front view showing the first image station with the cassette case being angularly moved to a position where the cleaning cassette and a quenching lamp face the drum cassette.

FIG. 39 shows a condition wherein the cassette case 60*a* is moved to the right about the shaft 60*c* to the position where the cleaning cassette 220 and quenching lamp 5000 face the drum cassette 1400. As shown, the notch 60*d*-4 of the developing device side wall 60*d* and the notch 1410*a*-1 of the drum cassette 1400 are identical in configuration and aligned with each other in the front-and-rear direction in the direction perpendicular to the sheet surface of FIG. 39. The notches 60*d*-4 and 1410*a*-1 and the shaft 60*a*-2 of the cassette case 60*a* are engaged with each other in the direction of the radius of curvature. The cassette case 60*a* is therefore positioned relative to the developing device side wall 60*d* and drum cassette 1400. More specifically, the cleaning cassette 220 and quenching lamp 5000 are positioned relative to the side wall 60*d* and drum cassette 1400.

The position where the shaft 60*a*-2 abuts against the deepest points of the notches 60*d*-4 and 1410*a*-1 is the preselected position of the cassette case 60*d*. At the same time, the shaft 60*a*-2 and notches 50*d*-4 and 1410*a*-1 cooperate to restrict the leftward movement of the cassette case 60*a*. By the procedure described so far, the drum cassette 1400, cleaning cassette 220 and quenching lamp are accurately positioned.

Figure 40:
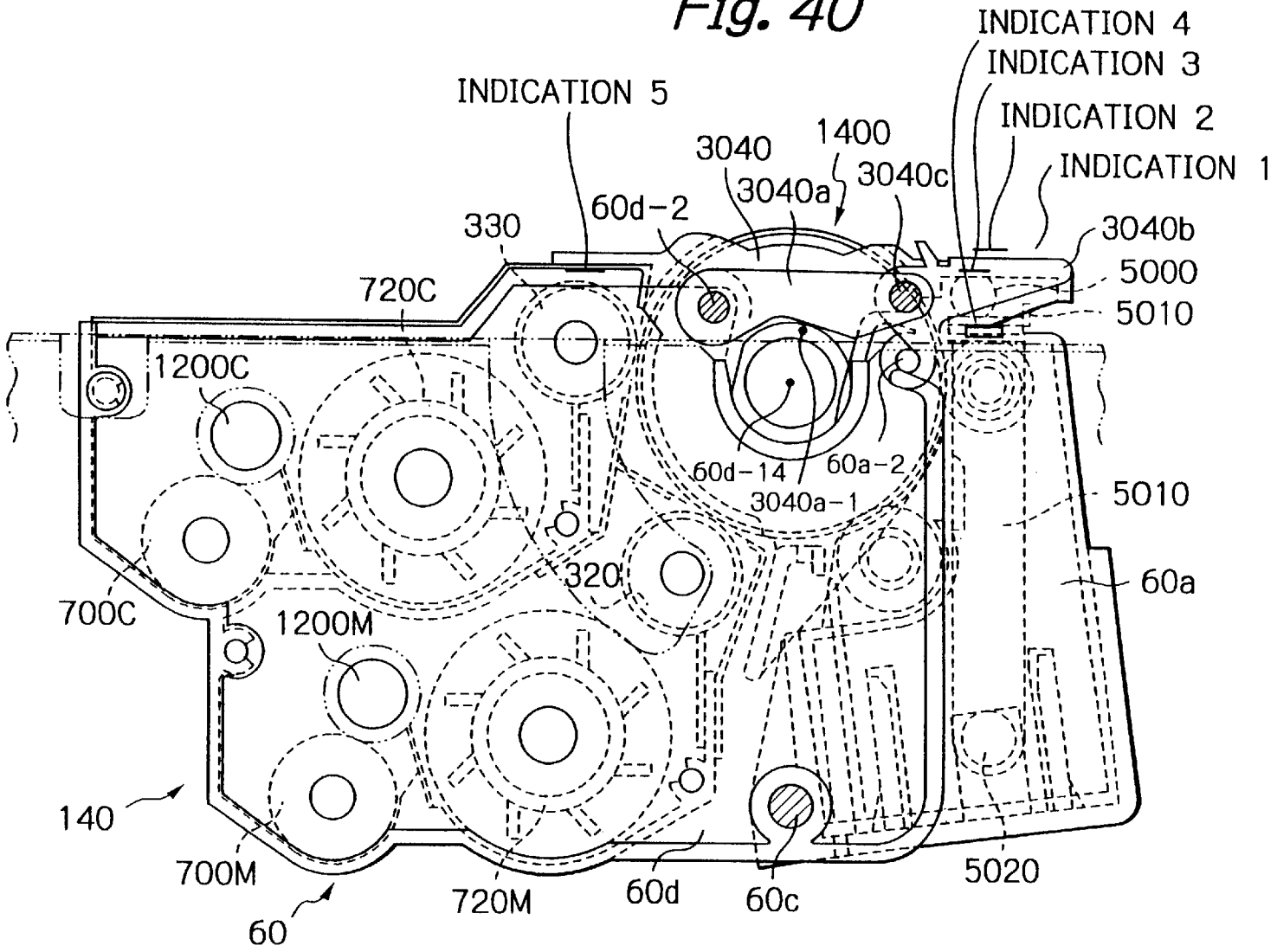
FIG. 40 is a fragmentary front view showing the first image station with the drum cassette and cassette case being locked to the side wall of the developing device.

FIG. 40 shows a condition in which the lever 3040 is moved about the shaft 60*d*-2 to the position where the drum cassette 1400 and cassette case 60*a* (cleaning cassette 220 and quenching lamp 5000) are locked to the developing device side wall 60*d*. As shown in FIG. 39, the lever 3040 includes a first lever 3040*a* and a second lever 3040*b* that are movably interconnected by a shaft 3040*c*. Further, the lever 3040 is rotatably supported by the shaft 60*d*-2, constituting a link mechanism movable in two steps. Specifically, the second lever 3040*b* has a thumb piece 3040*b*-1 at one end thereof. When the operator turns the second lever 3040*b* about the shaft 60*d*-2 by nipping the thumb piece 3040*b*-1, a straight portion included in the first lever 3040*a* abuts against the outside diameter portion of the oval bearing 160*b* of the drum cassette 1400. As a result the rightward turn of the first lever 3040*a* stops.

When the operator further turns the first lever 3040*b*-1 to the right, only the second lever 3040*b* moves about the shaft

3040*c* until a notch 3040*b*-2 formed at the other end of the leer 3040*b* engages with the shaft 60*a*-2 of the cassette case 60*a*. At this instant, as shown in FIG. 40, the first lever 3040*a* presses the drum cassette 1400 against the developing device side wall 60*d*, locking the cassette case 60*a* to the side wall 60*d*. More specifically, the first lever 3040*a* locks the drum 160 to the developing device 60 while the second lever 3040*b* locks the cassette case 60*a* to the developing device 60. Stated another way, because the holder 5010 locks the cleaning cassette 220 to the cassette case 60*a*, the second lever 3040*b* locks the cleaning cassette 220 to the developing device 60. A dismounting procedure is opposite to the mounting procedure described above.

As stated above, the lever 3040 plays the role of locking means for locking the drum 160 to the developing device 60. Also, the lever 3040 constitutes major part of a simultaneous locking mechanism that selectively locks the drum 160 and cleaning cassette 220 to the developing device 60 at the same time or unlocks the former from the latter at the same time. The operator cannot dismount the drum 160 or the cleaning cassette 220 without operating the simultaneous locking mechanism. More specifically, the operator can complete preparation for mounting or dismounting the drum 160 and cleaning cassette 220 to or from the developing device 60 by a single action.

Another specific mounting procedure available with the illustrative embodiment will be described hereinafter. In this procedure, before the developing device 60 is mounted to the apparatus body, the cleaning cassette 220 is mounted to the cassette case 60*a* and then mounted to the apparatus body together with the developing device 60. Thereafter, the drum cassette 1400 is mounted to the developing device 60. Stated another way, after the drum cassette 1400 has been dismounted from the developing device 60, the developing device and cleaning cassette 220 can be dismounted integrally with each other. More specifically, the drum cassette 1400 does not include any process means except for the drum 160 and is removable from the developing device 60. The drum cassette 1400 is mounted to the apparatus body last or dismounted from the apparatus body first.

Further, by using the developing device 60, which does not need replacement over a long time, as the reference position of the process means, the illustrative embodiment positions the drum cassette 1400 and cleaning cassette 220 relative to the developing device 60. The drum unit 60 remains locked to the apparatus body at least when the drum cassette 1400 is removed.

The configuration of the first image station shown and described is a specific configuration of the process means. The crux of the illustrative embodiment is at least that the developing section defines a reference position, and the drum is removable alone.

In the illustrative embodiment, each of the process means including the drum is removable independently of the others, as stated above. This successfully reduces the running cost of the apparatus and environmental loads. Further, the illustrative embodiment facilitates replacement by the user. Specifically, the drum cassette 1400, cleaning cassette 220 and developing device 60 are sequentially removable from the apparatus body in this order. So long as the drum cassette 1400 is present on the apparatus body, the drum cassette 1400 hides the holder 5010 accessible for removing the cleaning cassette 220. This prevents the user from confusing the holder 5010 with the lever 3040 used to remove the drum cassette 220. Even an unskilled person can therefore accurately deal with the above units in the preselected order.

Further, in the illustrative embodiment, indication means is provided on each of the drum cassette 1400, cleaning cassette 220 and developing device 60 in order to show the user a step to taken next at the time of dismounting. The indication means further promotes easy operation by the user. Specific indication means will be described hereinafter with reference to FIGS. 41A through 41C.

Figure 41A:
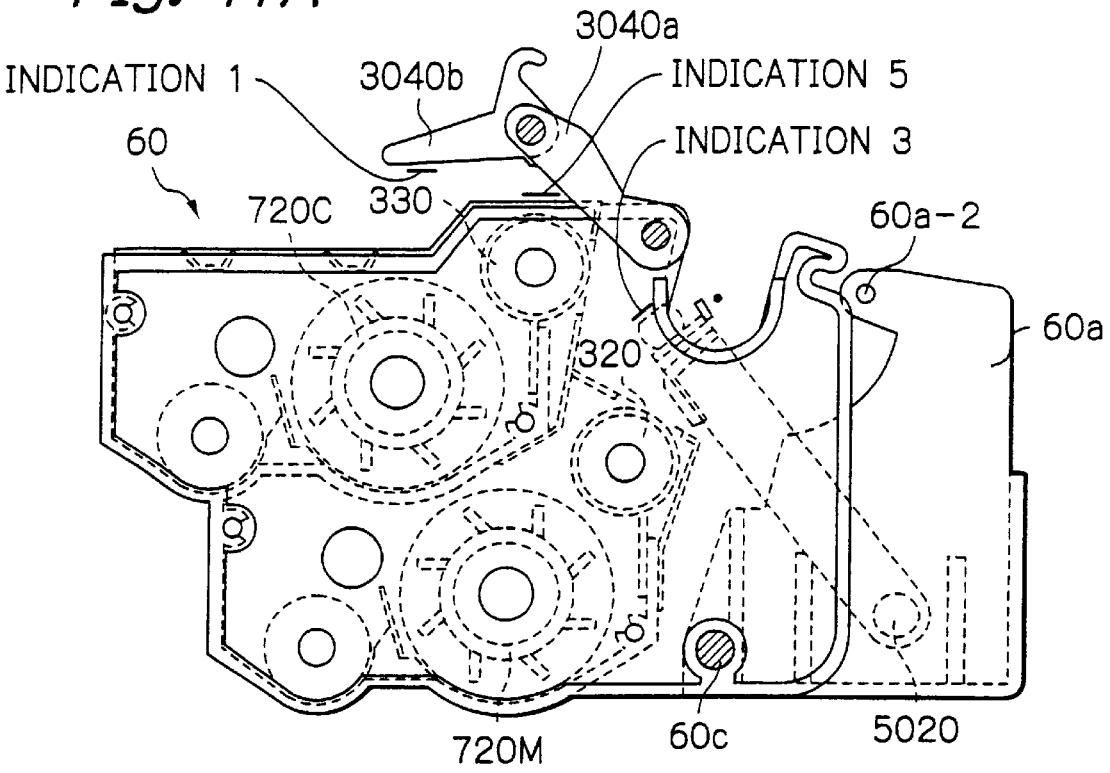
FIG. 41A is a view showing the positions of indications provided on the developing device.

As shown in FIG. 41A, the first indication that is visible when the drum cassette 1400 is mounted to the apparatus body is provided on the second lever 3040*b*, showing the user the preselected dismounting procedure. While the indication may be provided in any suitable form, the illustrative embodiment uses numeral 1. The second and third indications visible when the drum cassette 1400 is removed are respectively provided on the quenching lamp 5000 and developing device 60. The second and third indications are implemented as numerals 3 and 5, respectively.

Figure 41B:
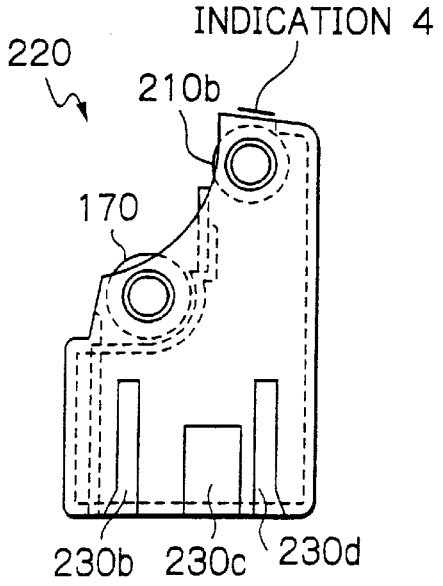
FIG. 41B is a view showing an indication provided on the cleaning cassette.
Figure 41C:
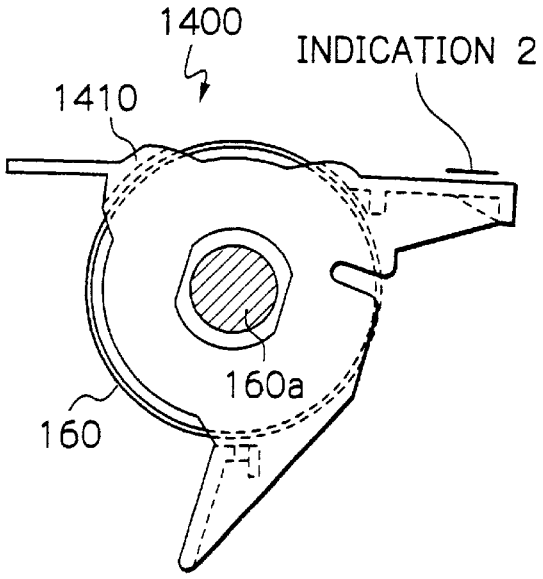
FIG. 41C is a view showing an indication provided on the drum cassette.

An indication is provided on the cleaning cassette 220 at a position visible when the holder 5010 with the quenching lamp 5000 is released, as shown in FIG. 41A. As shown in FIG. 41B, in the illustrative embodiment, this indication is implemented as numeral 4. Further, numeral 2 is provided on the drum cassette 1400 (FIG. 41C) at a position visible when the cassette 1400 is mounted to the apparatus body. Again, such a numeral is only illustrative and may be replaced with a printed message, e.g., "Lift this lever." or "Lift this cassette.", a still picture or a movie indicative of a step to be taken next, or a speech.

FIG. 40 shows the indications described above in the condition wherein the image station is constructed on the apparatus. As shown, the operator first lifts and moves the lever 3040 in accordance with the indication "1", then picks up the drum cassette 1400 in accordance with the indication "2", then turns the holder 501 in accordance with the indication "3", then removes the cleaning cassette 220 in accordance with the indication "4", and then removes the developing device 60 in accordance with the indication "5".

The drum cassette 1400 and holder 5010 hide the indications "3", "4" and "5", so that the operator cannot see such indications until the operator removes the drum cassette 1400 and holder 5010. While the indication "2" is not hidden in the illustrative embodiment, it may be hidden by a penthouse protruding from the second lever 3040*b*, if desired.

The illustrative embodiment causes the process unit having the shortest service life to be dismounted first. More specifically, the drum cassette 1400 that exhausts more than the other process units is dismounted first alone while the other process units are left on the apparatus body. The operator is therefore free from troublesome operation in the event of replacement of the drum.

FIGS. 42 through 46 demonstrate a procedure for dismounting the cassettes and units constituting the first and second image stations 140 and 240. It is to be noted that the order in which the operator deals with the two image stations 140 and 240 is open to choice.

Figure 42:
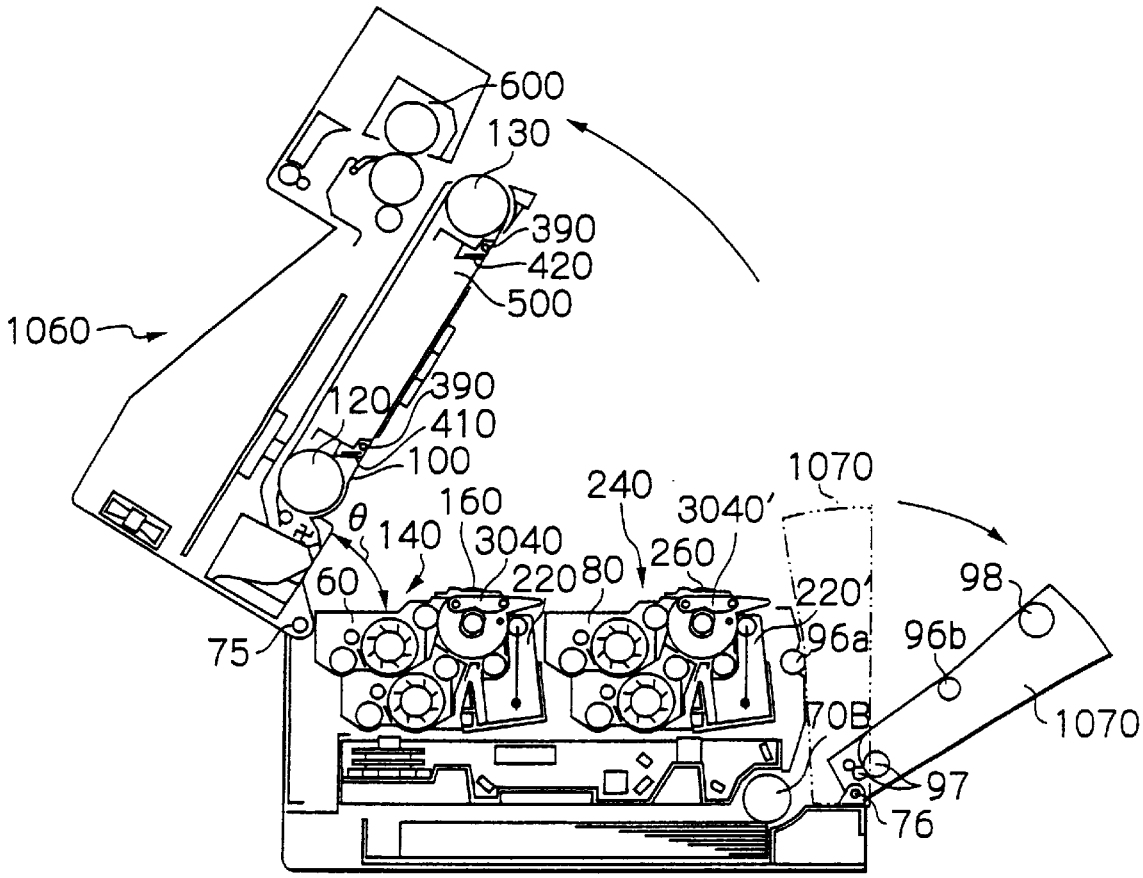
FIG. 42 is a front view of the apparatus with a top cover and a right cover being opened.
Figure 43:
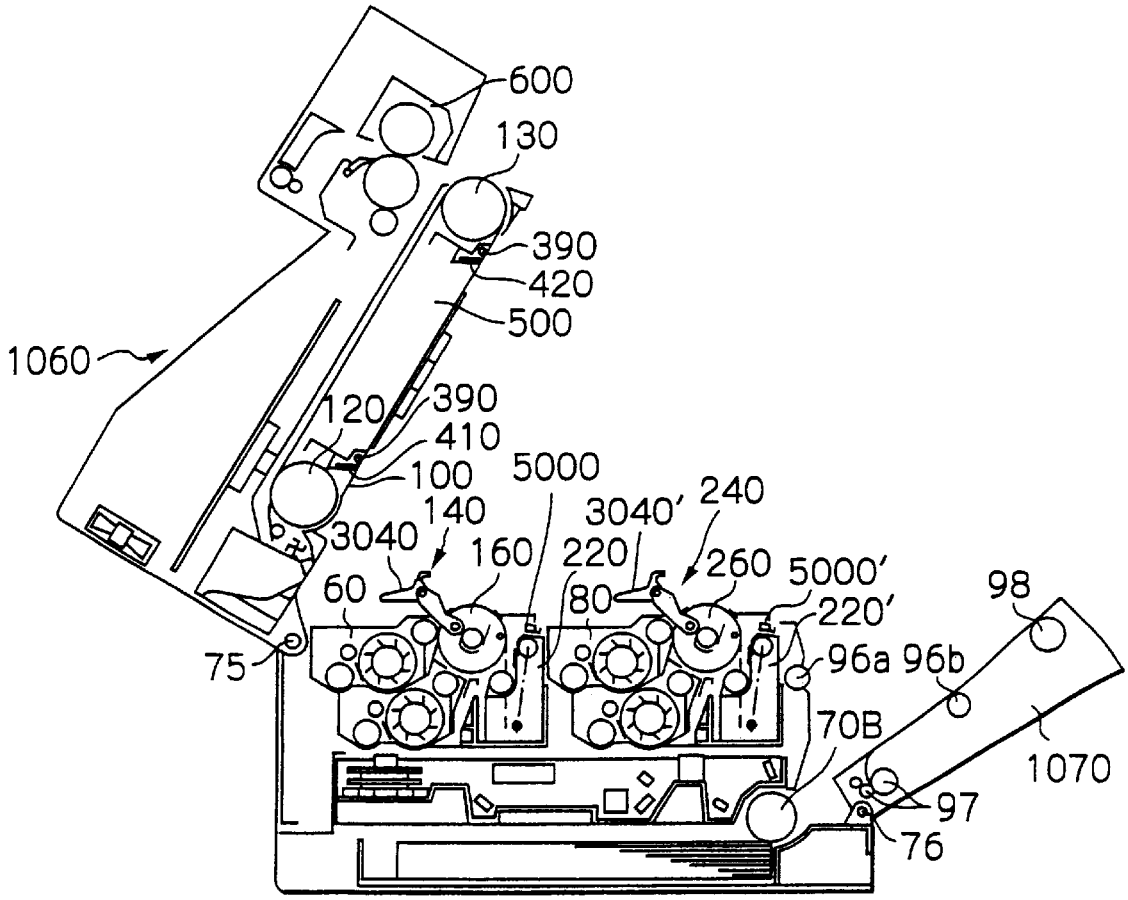
FIG. 43 is a front view showing cleaning means and a charger released from a photoconductive drum.

As shown in FIG. 42, a top cover 1060 is loaded with the intermediate image transfer unit 500 and fixing unit 600 while a right cover 1070 is loaded with part of the sheet path and image transfer roller. The operator first opens the top cover 1060 and right cover 1070 upward so as to uncover the image stations 140 and 240. Subsequently, as shown in FIG. 43, the operator releases the lever 3040 and a lever 3040' included in the image stations 140 and 240, respectively. As a result, the cleaning means and charger 220 of the image station 140 are spaced from each other. Likewise, cleaning means and a charger 220' included in the image station 240 are released from each other.

Figure 44:
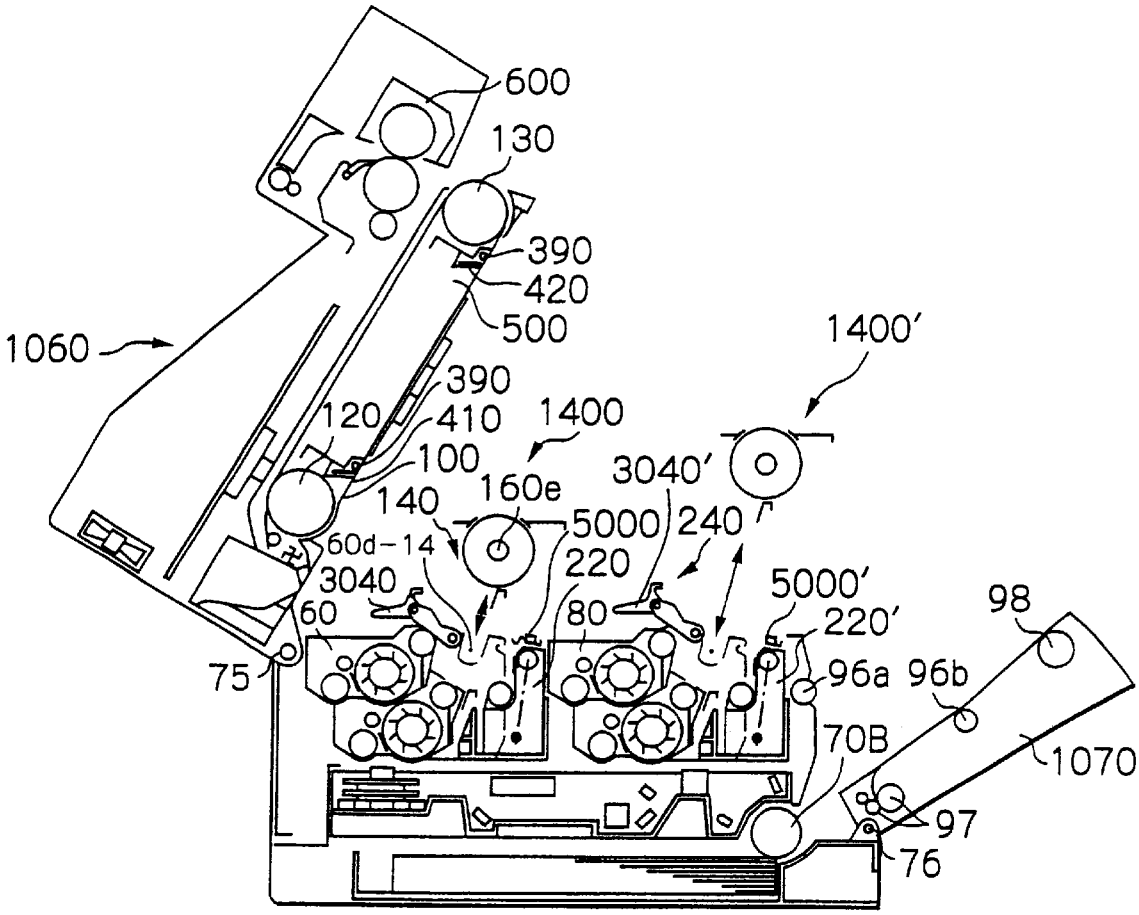
FIG. 44 is a front view showing the apparatus with the drum cassette being dismounted from the developing device.
Figure 45:
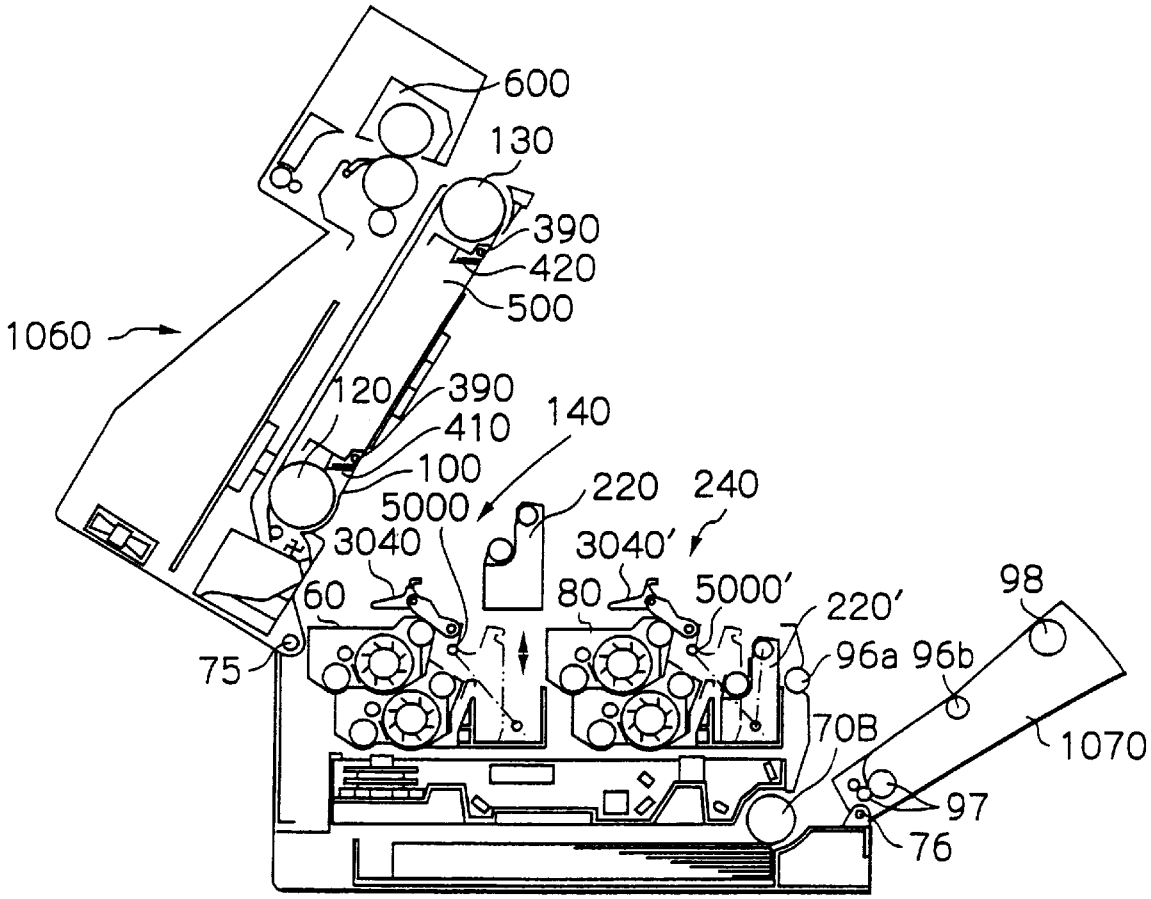
FIG. 45 is a front view showing the first image station at which the cleaning cassette is dismounted from the apparatus body.

As shown in FIG. 44, the operator dismounts the drum cassette 1400 and a drum cassette 1400' from the developing devices 60 and 80 (apparatus body), respectively. As shown in FIG. 45, the operator then turns the holder 5010, not shown, supporting the quenching lamp 5000 to the left to thereby unlock the cleaning cassette (second image station 240). Also, the operator dismounts the cleaning cassette from the developing device, i.e., apparatus body (first image station).

Figure 46:
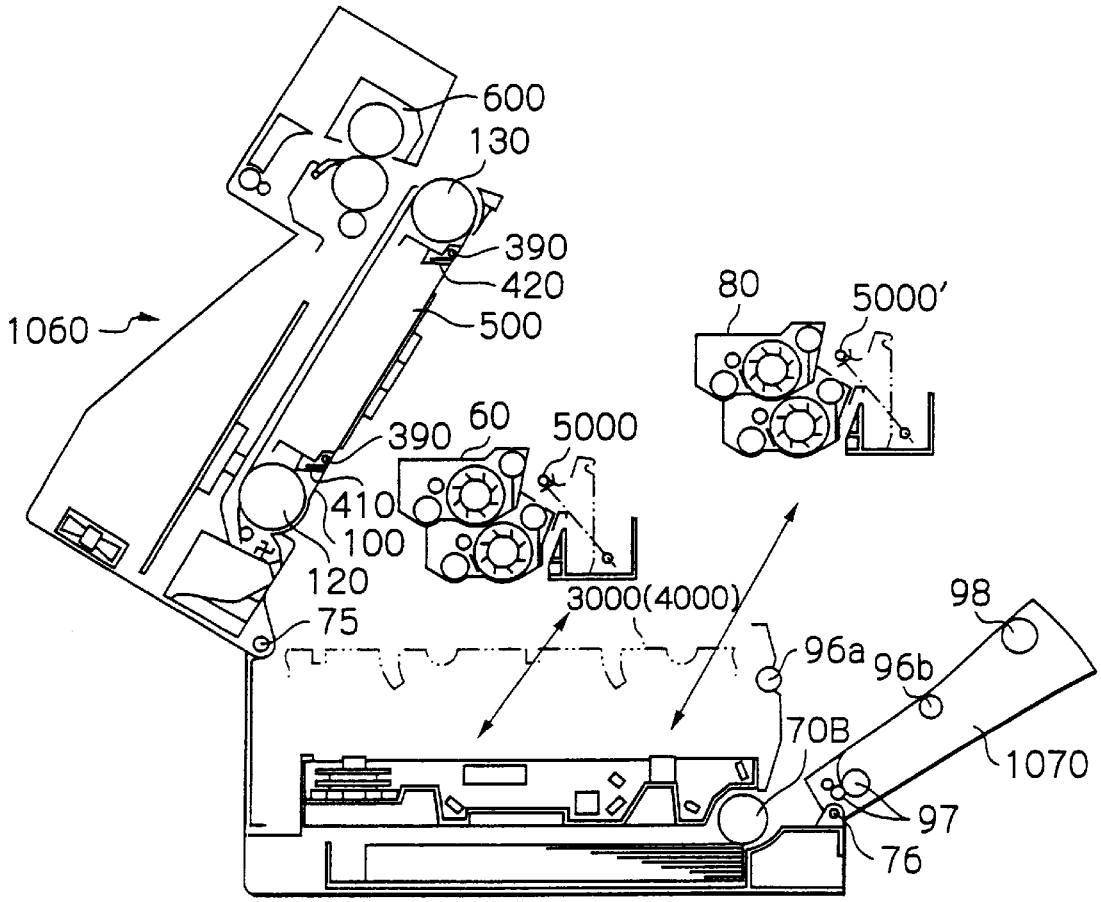
FIG. 46 is a front view showing the apparatus body from which the developing device is dismounted.

FIG. 46 shows a condition wherein the operator deals with both of the image stations 140 and 240 in the event of an unexpected occurrence. As shown, the operator releases the drive means and toner replenishing means, which lock the developing devices 60 and 80 at the same time, and then dismounts the developing devices 60 and 80 from the apparatus body.

Figure 47:
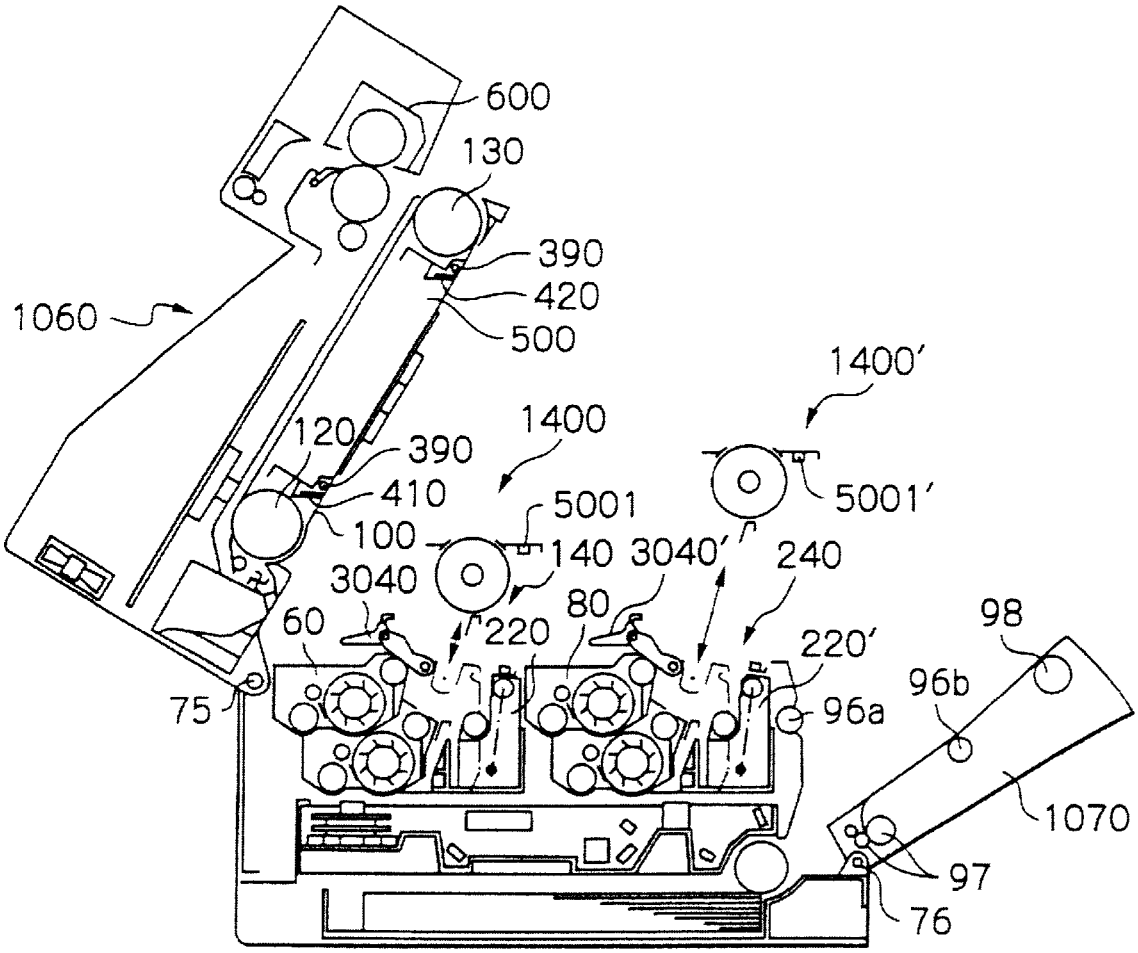
FIG. 47 is a view showing the drum cassette accommodating the quenching lamp as well.

FIG. 47 shows another specific configuration of the drum cassettes 1400 and 1400'. As shown, the drum cassettes 1400 and 1400' additionally include the quenching lamps 5000 and 5000', respectively. If the quenching lamp 5000, for example, has a long life, then it can be mounted on the developing device 60 whose life is also long. However, a current trend in the imaging art is toward a low-cost and therefore short-life quenching lamp that meets the need for cost reduction. Such a quenching lamp must be replaced as one of expendables.

Figure 48:
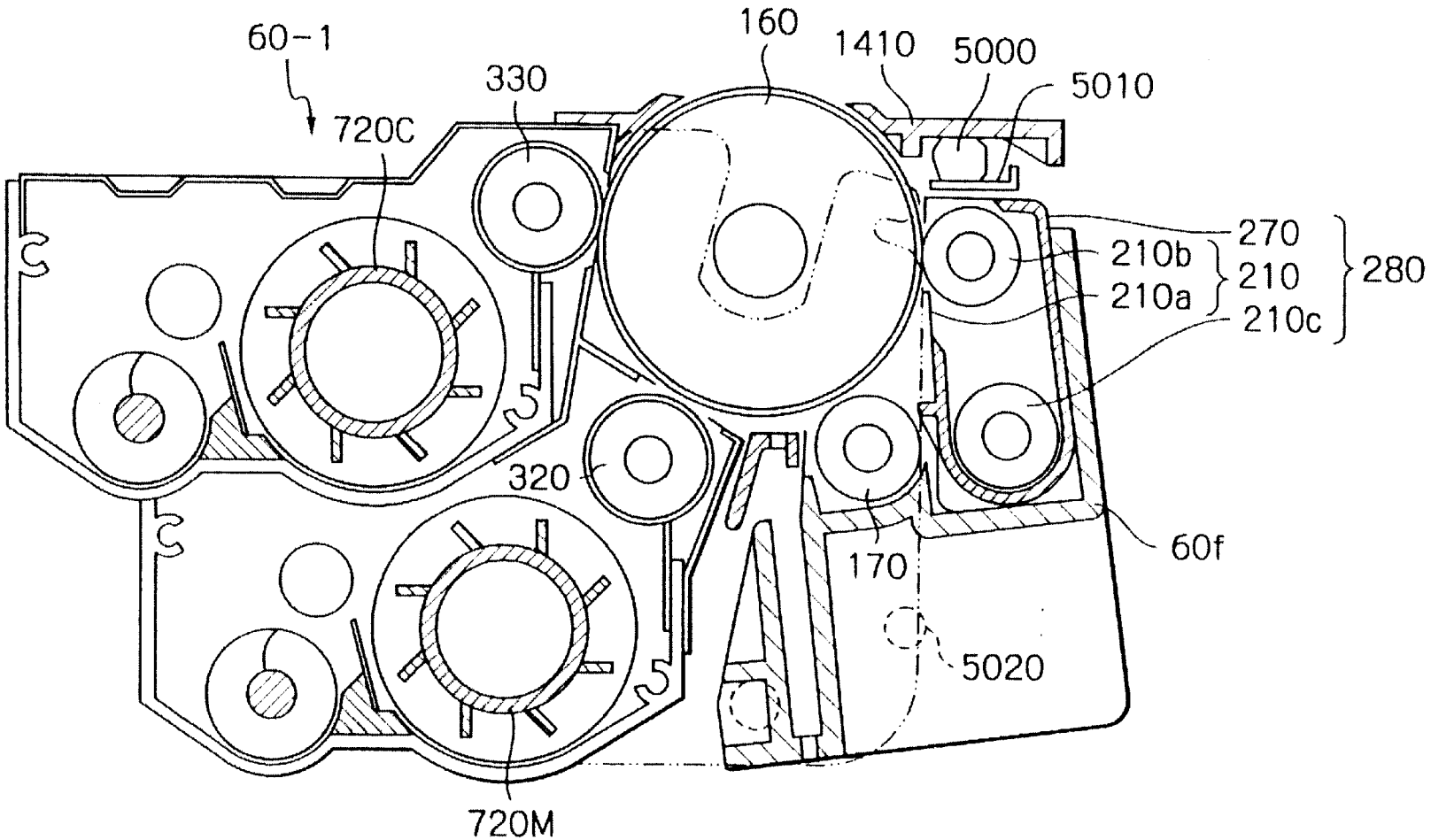
FIG. 48 is a front view showing a developing device of the type having a cleaning cassette not including a waste toner storage, but including a charger.
Figure 49:
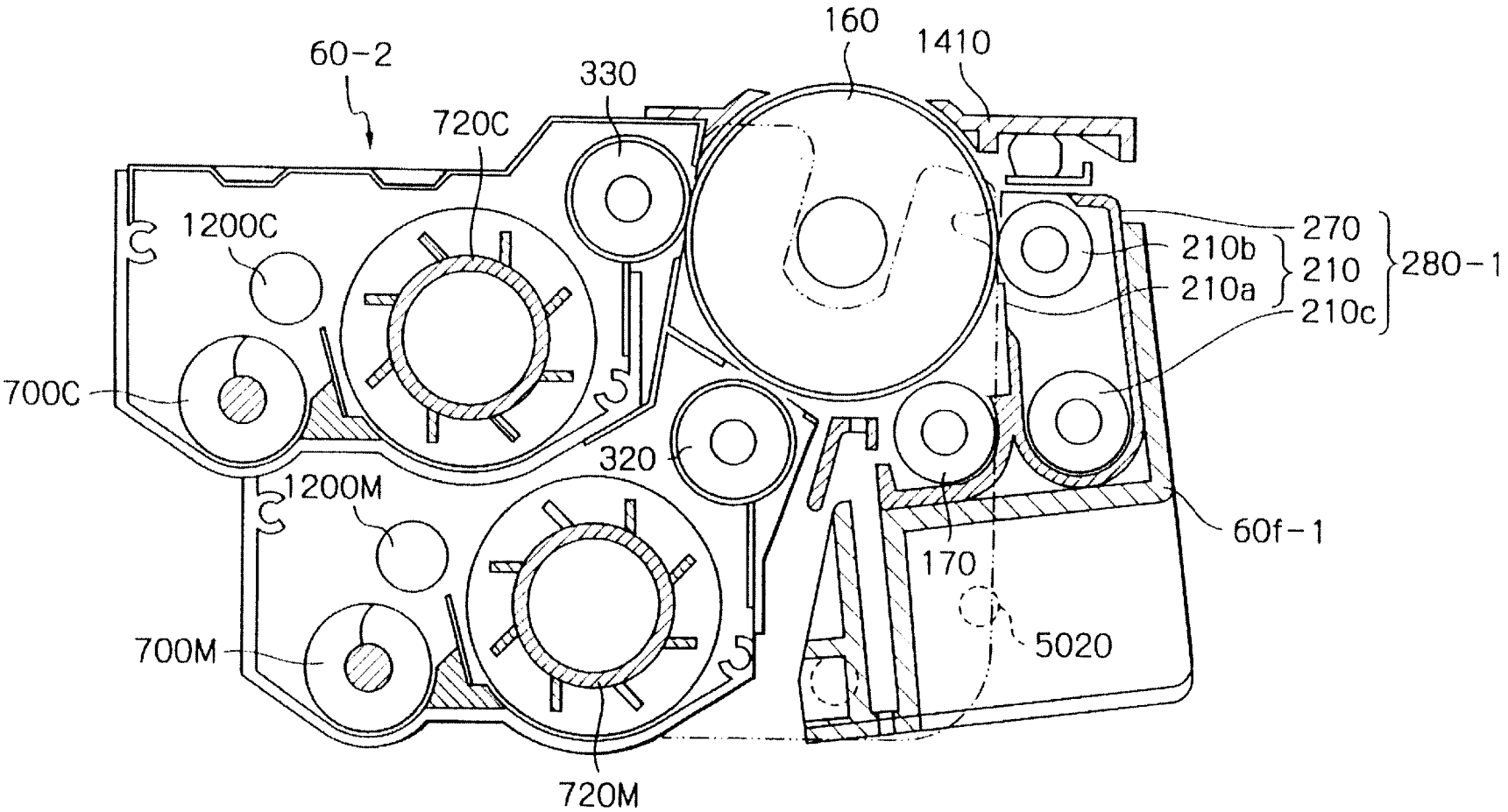
FIG. 49 is a front view showing a developing device of the type having a cleaning cassette not including a waste toner storage, but including a charger in a cleaning case thereof.

FIGS. 48 and 49 each show another specific configuration of the cleaning cassette that does not include the waste toner storage. As shown, cleaning cassettes 280 and 280-1 shown in FIGS. 48 and 49, respectively, each include a screw conveyor 210*c* for conveying the collected toner or waste toner to a waste toner box, not shown, removably mounted to the apparatus body. The cleaning cassettes 280 and 280-1 have the following difference. The cleaning cassette 280 has the cleaning means 210 and screw conveyor 210*c* mounted on the cleaning case 270 together and is mounted to a cassette case 60*f*, which is included in a developing device 60-1 and supports the charger 170. By contrast, the cleaning cassette 280-1 has the charge roller 170 additionally mounted on the cleaning case 270 and mounted to a cassette case 60*f*-1, which is included in a developing device 60-2. The cleaning cassettes 280 and 28-1 both are replaceable in accordance with the life.

Figure 50:
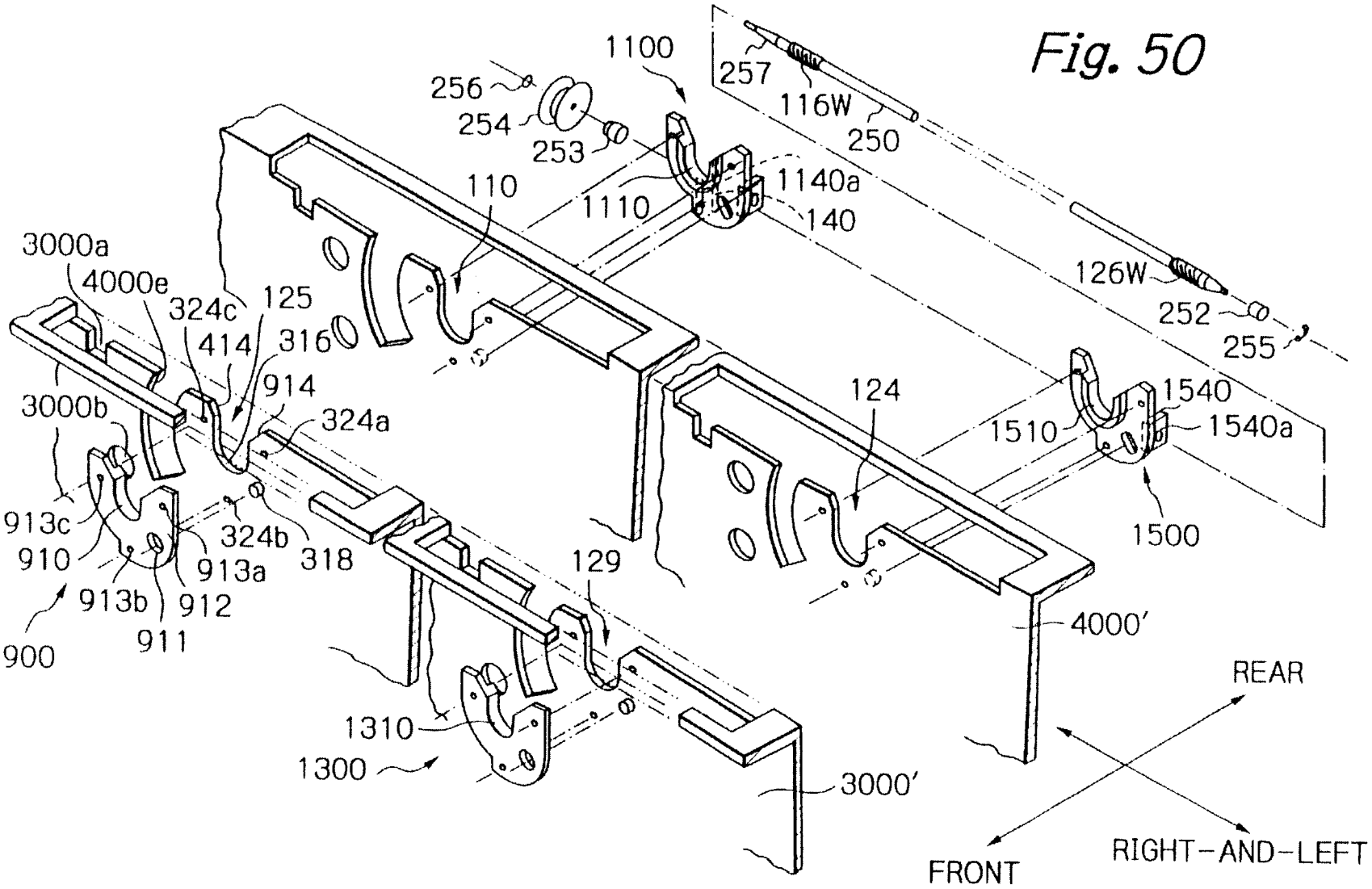
FIG. 50 is an exploded perspective view demonstrating how positioning members are mounted on the side walls of the apparatus body.

Hereinafter will be described another specific configuration of the side wall 3000. In the configuration shown in FIGS. 30 through 40, the semicircular protuberance 60*d*-13 extending from the developing device side wall 60*d* simply rests on the edge of the notch 3000*d* formed in the side wall 3000 of the apparatus body. As shown in FIG. 50 pertaining to the first image station 140 by way of example, a modified side wall 3000' includes a positioning member 900 mounted thereon beforehand. The protuberance 60*d*-13 is selectively locked to or unlocked from the positioning m ember 900. The other side wall 4000' facing the side wall 3000' is identical in configuration with the side wall 3000' and supports a protuberance, not shown, also extending from the developing device side wall 60*d* and identical in configuration and size with the protuberance 60*d*-3. This is also true with the second image station 240.

Figure 51:
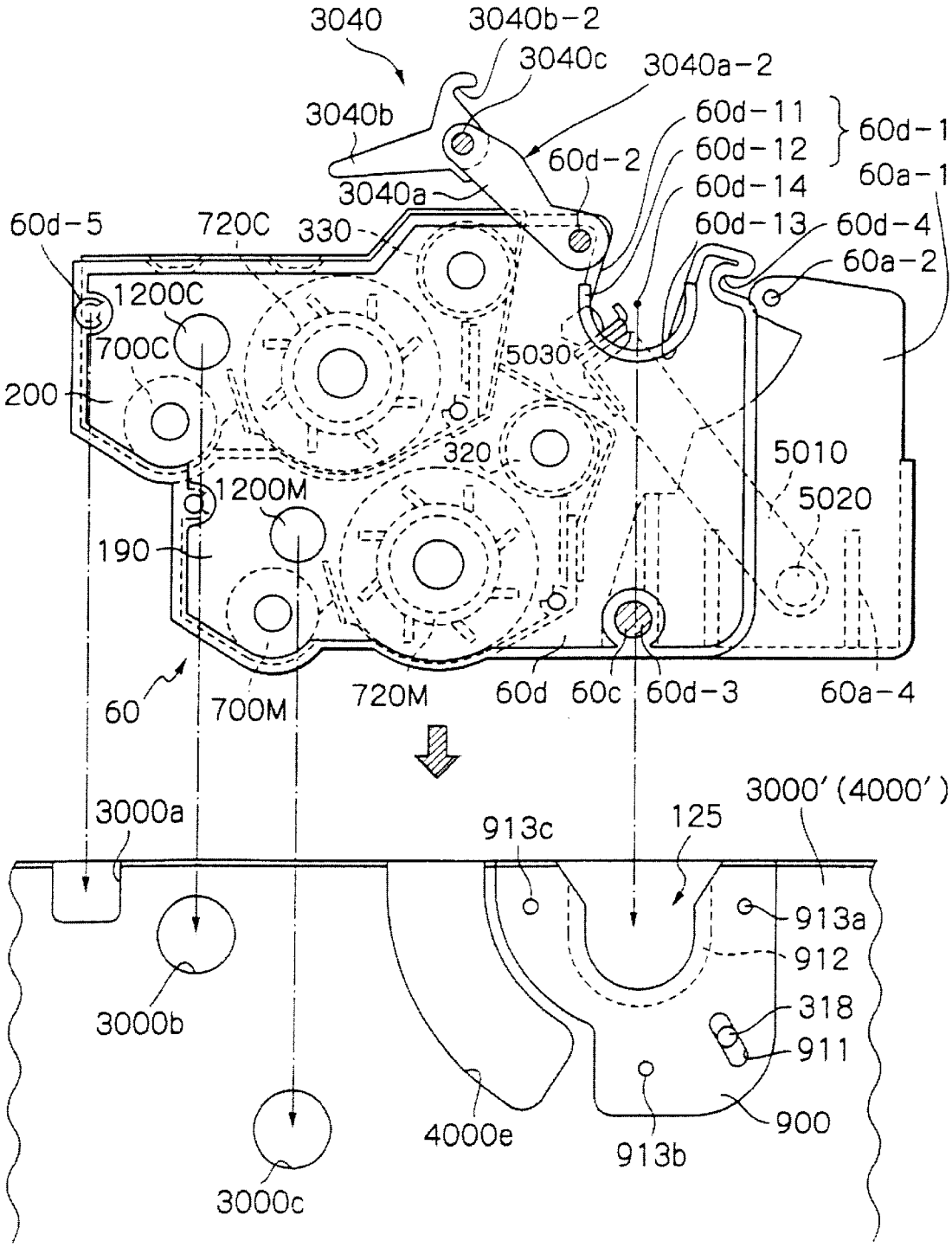
FIG. 51 is a view is a view showing a relation between the side wall and the developing position.

Reference will be made to FIGS. 50 and 51 for describing the positioning member 900 mounted on the side wall 3000' and a positioning member 1100 mounted on the side wall 4000' included in the first image station, and the positioning member 1500 included in the second image station 240. The sidewall 3000' (4000') is identical with the side wall 3000 (4000) of FIG. 30 except for the configuration around a mount portion 125. In the figures, identical portions are designated by identical reference numerals.

The mount portion 125 is formed in part of the upper portion of the side wall 3000' assigned to the first image station 140. The mount portion 125 is implemented as a generally U-shaped notch. A mount portion 110 substantially identical in configuration with the mount portion 125 is formed in the side wall 4000' in alignment with the mount portion 125. Likewise, mount portions 129 and 124 are formed in the side walls 3000' and 4000', respectively, and assigned to the second image station 240.

As for the first image station 140, the positioning member 900 is attached to the mount portion 125 from the front of the side wall 3000 while the positioning member 1100 is attached to the mount portion 110 from the rear of the side wall 4000'. As for the second image station 240, a positioning member 1300 is attached to the mount portion 129 from the front of the side wall 3000' while the positioning member 1500 is attached to the mount portion 124 from the rear of the side wall 4000'.

The positioning member 900 is formed with a support portion 910 for supporting the protuberance 60*d*-3. The other positioning members 910, 1110, 1310 and 1510 are also respectively formed with shaft support portions 910, 1110, 1310 and 1510 each for supporting a particular protuberance not shown. As shown in FIG. 29, the shaft support portions 910, 1110, 1310 and 1510 each support a particular developing device 60, and in this sense constitute a developing device holding portion.

As shown in FIG. 50, the positioning members 1100 and 1500 mounted on the rear side wall 4000' and assigned to the image stations 140 and 240, respectively, are identical in configuration except for the following. The positioning members 1100 and 1500 respectively include drive member support portions 1140 and 1540 for supporting the worm shaft 250. The drive member support portions 1140 and 1540 respectively support the outer portions of worms 116W and 126W formed on the worm shaft 250, i.e., opposite end portions of the worm shaft 250 and are therefore different in position from each other. The drive member support portions 1140 and 1540 are respectively formed with holes 1140*a* and 1540*a* for receiving the worm shaft or drive member 250 that drives the drum or image carrier 160.

As shown in FIG. 50, the positioning member 900 is formed with a slot 911, a step 912 and holes 913*a*, 913*b* and 913*c* in addition to the shaft support portion 910. The upper ends of the edge portions of the shaft support portion 910 that face each other are implemented as slants 914 so as to smoothly guide the protuberance 60*d*-3. The bottom portion of the shaft support portion or notch 910 is implemented as a semicircle having the same radius as the protuberance 60*d*-13. The step 912 has a generally U-shaped contour slightly greater than the shaft support portion 910. The slot 911 is elongate toward the axis of the support portion 910. A pin 318 is studded on the side wall 3000' and protrudes to the front. The pin 318 is received in the slot 911. The side wall 3000' is formed with holes 324*a*, 324*b* and 324*c* around the shaft mount portion 125 for mounting the positioning member 900.

To mount the positioning member 900 to the side wall 3000', the step 912 of the positioning member 900 is put in the shaft support portion 125 while the pin 318 is inserted in the slot 911. In this condition, the axis of the shaft support portion 910 is determined. The pin 318 and slot 911 in combination determine the position of the positioning member 900 in the direction of rotation about the shaft support portion 910. The holes 913*a* through 913*c* align with the holes 324*a* through 324*c* and allow the positioning member 900 to be affixed to the sidewall 3000'. The positioning member 1300 is affixed to the side wall 3000' in the same manner as the positioning member 900. Likewise, the positioning members 1100 and 1500 are affixed to the side wall 4000'.

Subsequently, the worm shaft 250 is inserted into the hole 1540*a* of the drive member support portion 1540 of the positioning member 1100 and then into the hole 1140*a* of the drive member support portion 1140 of the positioning member 1500, the worm 116W heading the worm shaft 250. More specifically, the drive member support portion 1140 supports one end portion of the worm shaft 250 closer to the end than the worm 116W via a bearing 253. A pulley 254 is mounted to the above end of the worm shaft 250 and affixed thereto by a nut 256. The drive member support portion 1540 supports the other end portion of the worm shaft 250 closer to the end than the worm 126W via a bearing 252. A stop member 255 is fitted on this end of the worm shaft 250. In this condition, the worms 116W and 126W are positioned right below the axes of the shaft support portions 1110 and 1510, respectively.

In FIG. 51, the protuberance 60*d*-13 of the developing device 60 is received in the mount portion 125 of the side wall 3000' of the apparatus body, positioning the developing device relative to the side wall in the right-and-left direction and the direction of height. In this condition, the center 60*d*-14 of the protuberance 60*d*-13 (=semicircular portion 60*d*-12) constitutes the reference position of the first image station 1410. Further, the shaft 60*d*-5 of the developing device 60 rests on the horizontal bottom of the notch 3000*a* of the side wall 3000'. This prevents the developing device 60 from rotating and cooperates with the protuberance 60*d*-13 to position the developing device 60 relative to the side wall 3000' in the direction of height, thereby holding the developing device 609 at the preselected position for image formation. Consequently, the developing device 60 is positioned relative to the sidewall 3000' (4000'). The developing device 80 is positioned relative to the side wall 3000' (4000') in the same manner as the developing device 60.

The drum cassette 1400 and cleaning cassette 220 are mounted to or dismounted from the developing device 60 (80) positioned as described above, as shown in FIGS. 33, 37, 46 and 47.

Figure 52:
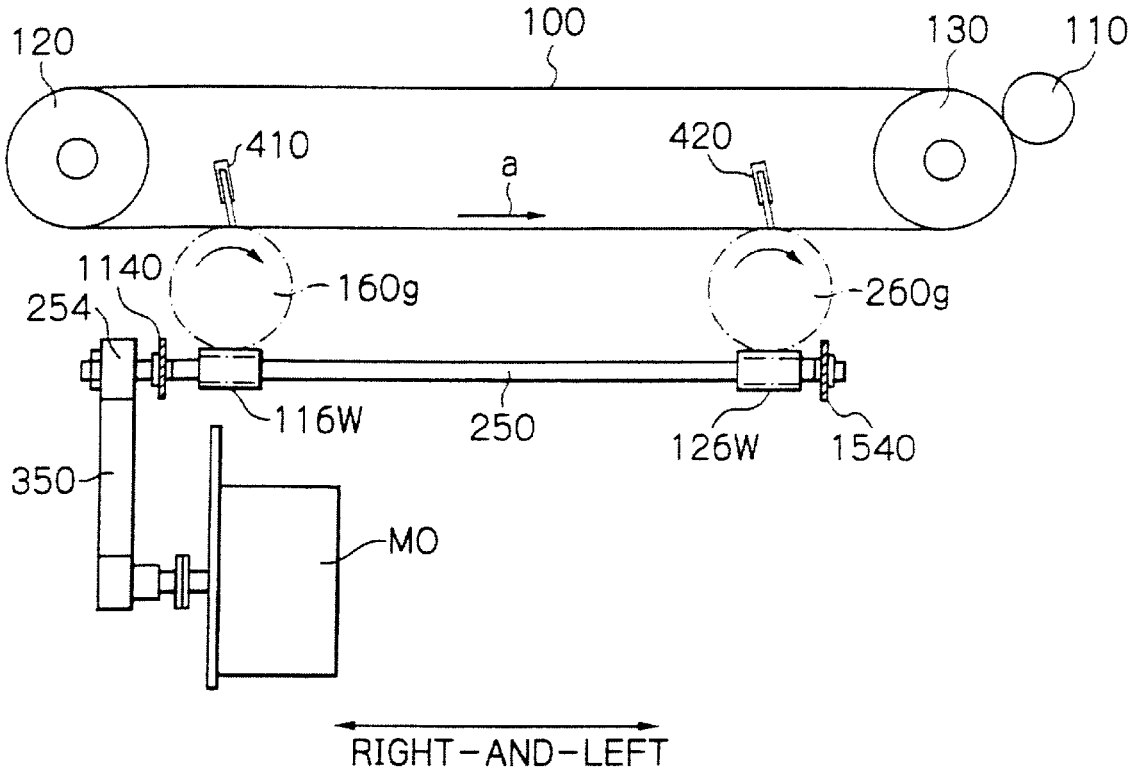
FIG. 52 is a view showing a driveline for driving the photoconductive drum.

As shown in FIG. 52, when the drum cassette 1400 is mounted to the developing device 60 at the first image station 140, the gear 160*g* mounted on the shaft 160*a* of the drum 160 meshes with the worm 116W. Likewise, when the drum cassette is mounted to the developing device 80 at the second image station, the gear 260*g* mounted on the shaft of the drum 260 meshes with the worm 126W. The motor MO causes the drums 160 and 260 to rotate via the pulleys 254, belt, and worm gear 250.

As stated above, the illustrative embodiment selectively locks or unlocks the developing devices to or from the positioning members 900, 1100, 1300 and 1500. The positioning members 1100 and 1510 include the drive member support portions 1140 and 1540, respectively, that cooperate to support the worm shaft 250. Therefore, only if the shaft support portions 910 and 920 and holes 1140*a* and 1540*a* are accurately positioned in the support members 1140 and 1540, the drive gears 160*g* and 260*g* of the drums can be accurately positioned relative to the worm shaft 250.

For example, assume that the side wall 3000 (4000) shown in FIG. 30 directly supports the worm shaft 250. Then, it is necessary to accurately machine the notch 3000*d* expected to receive the worm shaft 250. By contrast, in illustrative embodiment, only if the mount portions 125, 110, 129 and 124 of the side walls 3000' and 4000' are accurately machined, the drive gears 160*g* and 260*g* can accurately mesh with the worm shaft 250 via the developing devices 60 and 80, respectively.

To summarize the arrangements described above, the drum or image carrier 160 belongs to the drum cassette 1400 together with the bearings 160*b*, gear 160*g* and holder 1410. The charge roller or charging means 170 belongs to the cleaning cassette 220. The cassette case 60*a* with the removable cleaning cassette 220 is supported by the developing device side walls 60*d* in such a manner as to be angularly movable about the shaft 60*c*. The drum cassette 1400 and cleaning cassette 220 are removably supported by the developing device side walls 60*d*. The developing device 60 is removably supported by the side walls 3000 and 4000 of the apparatus body.

The cleaning cassette 220 and drum cassette 1400 are mounted to the side walls 3000 and 4000 by way of the developing device 60 without fail, as stated earlier. However, when the cleaning cassette 220 and drum cassette 1400 are mounted to the developing device 60 joined with the side walls 3000 and 4000, it may be said that they are mounted substantially to the side walls 3000 and 4000, i.e., apparatus itself.

As shown in FIGS. 42 through 47, the operator must open the top cover 1060 about a shaft 75 and open the right cover 1070 about a shaft 76 before mounting the developing device 60, cleaning cassette and drum cassette 1400. The top cover 1060 loaded with the fixing device 600 and intermediate image transfer device 500 is balanced in weight such that it cannot open by more than an angle θ of 60° from its closed position. In this condition, when the cleaning cassette 220 or the drum cassette 1400 is present on the developing device 60, the top cover 1060 would interfere with the cleaning cassette 220 or the drum cassette 1400 if intended to be dismounted by the operator. This prevents the operator from mounting the developing device 60 to the side walls 3000 and 4000 when the cleaning cassette 220 or the drum cassette 1400 is present on the developing device 60. Also, the developing device cannot be dismounted from the side walls 3000 and 4000 unless the cleaning cassette 220 and drum cassette 1400 is absent on the developing device 60.

As for the cleaning cassette 220 and drum cassette 1400, assume that the operator intends to mount the drum cassette 1400 to the developing device 1400 before the cleaning cassette 220. Then, as shown in FIG. 29, the operator has to move the holder 5010 out of the notch 60*d*-1 into the cassette case 60*a*. The holder 5010 then prevents the cleaning cassette 220 from being introduced into the cassette case 60*a*. Further, when the drum cassette 1400 is present on the developing device 60, the drum 160 exists in the path assigned to the cleaning cassette 220 and obstructs the cassette 220. For the same reason, the cleaning cassette 220 cannot be dismounted unless the drum cassette 1400 is dismounted first. This implements the mounting order and dismounting order stated earlier.

Assume that the top cover 1060 is a simple cover lacking the intermediate image transfer device 500 and fixing device 500. Then, only if the angle over which the cover can be opened is limited, it also interferes with the cleaning cassette 220 or the drum cassette 1400 intended to be dismounted together with the developing device 60. The indications 1 through 4, for example, surely show the operator the mounting order and dismounting order, obviating mishandling.

Members close to each other as to life belong to the same unit. For example, the bearing 160*b* and holder 1410 close in life to the drum 160 belong to the drum cassette 1400. The developing roller 330, screw 700, paddle roller 720C and carrier (developer) belonging to the developing device 60 are close in life to each other. Further, the quenching lamp 5000, seal roller 210*b* and charge roller 170 belonging to the cleaning cassette 220 are close in life to each other. This prevents members different in life from being replaced together and thereby saves the running cost.

The drum cassette 1400 can be mounted and dismounted from the apparatus independently of the developing device 60 and is mounted and dismounted from the developing device 60, which is locked by the locking means shown in FIG. 32. The drum 160 whose life is short can therefore be replaced alone, further saving the running cost. The locking means prevents the developing device 60 from being dislocated relative to the apparatus when the drum cassette 1400 is mounted to the developing device 60.

Assume that the drum cassette 1400 is dismounted independently of the developing device joined with the apparatus body, i.e., the apparatus body, as shown in FIG. 44, and that the cleaning cassette 220 is dismounted later, as shown in FIG. 45. Then, the developing device 60 can be dismounted alone, as shown in FIG. 46. The drum 160 whose life is short can therefore be dismounted from the apparatus prior to the developing device 60.

Assume that the operator intends to dismount the developing device 60 from the apparatus. Then, as shown in FIG. 32B, the movable members constituting the locking means, i.e., the pipe with a screw 9010, gear shaft 9030 and gear 9050 are protruded into the space between the side walls 3000 and 4000 to thereby lock the developing device 60 to the apparatus body until the operator dismounts the drum cassette 1400. More specifically, the operator manipulates a lever 150 (see FIG. 30) to move the movable members out of the above space (FIG. 32A) or into the same space (FIG. 32B). So long as the drum cassette 1400 is present on the developing device 60, the holder 1410 of the drum cassette 1400 hides the lever 150 and prevents the operator from touching it. In this manner, the developing device 60 cannot be unlocked from the apparatus if the drum cassette 1400 is present on the apparatus, but can be unlocked if otherwise.

When the operator dismounts the drum cassette 140 from the developing device 60 and then turns the lever 150, a cam mechanism interlocked to the lever 150 moves a base loaded with the movable members or locking means. As a result, the movable members are moved to the outside of the side walls 3000 and 4000. For example, assume that the lever 150 sets up the locking state when brought down or sets up the unlocked state when raised. Then, the lever 150 in the unlocked state obstructs the drum cassette 140 and prevents it from being mounted to the developing device mounted on the side walls 3000 and 4000. It follows that the drum cassette 1400 cannot be mounted to the developing device 60 held in the unlocked, unstable position.

As shown in FIG. 40, the first lever 3040*a* urges the drum cassette 1400 against the developing device side wall 60*d* while the second lever 3040*b* and shaft 60*a*-2 affix the cassette case 60*a* to the above sidewall 60*d*. In this sense, the levers 3040*a* and 3040*b* and shaft 60*a*-2 serve as image carrier holding means for surely positioning a new drum cassette 1400 relative to the developing device 60 and side walls 3000 and 4000.

As shown in FIGS. 32A and 32B, the toner replenishing means 9000 replenishes fresh toner to the magenta developing section 190 and cyan developing section 200. The toner replenishing means 9000, which includes a toner hopper, is separate from the developing device 60. The toner replenishing means 9000 therefore makes it needless to dismount the developing device 60 from the apparatus body in the event of toner replenishment, which is frequently performed.

As shown in FIG. 25, every time a toner image is formed, the toner collected from the drum 160 by the cleaning means 210 accumulates in the cleaning case 230. This does not matter at all if the cleaning cassette 230 has a sufficient volume and becomes full in a period of time corresponding to the life of the members that belong to the cleaning cassette 220. However, in the case where the above period of time is shorter than the above life, toner discharging means similar in construction to the pipe 9010 and toner replenishing means 9000, FIGS. 32A and 32B, is used. With the toner discharging means, it is possible to discharge the toner accumulated in the cleaning case 230 to a waste toner box disposed in the apparatus body and therefore to discard the toner simply by emptying the waste toner box.

The brushes 410 and 420 and rollers 390, which constitute drum-to-belt image transferring means, are mounted on the top cover 1060. The image transfer roller 98, which constitutes belt-to-sheet image transferring means, is mounted on the right cover 1070. The brushes 410 and 420 and rollers 390 face the drums 160 and 260 and therefore obstruct the mounting and dismounting of the drum cassette 1400 from the developing device 60. The top cover 1060 is therefore opened at the time of mounting or dismounting of the drum cassette, so that the brushes 410 and 420 and rollers 390 are retracted from the path assigned to the drum cassette 1400.

The image transfer roller 98 is movable into out of contact with the belt 100 at a position above the drum 260. The image transfer roller 98 therefore also obstructs the drum cassette 1400 if held in its operative position. In light of this, the image transfer roller 98 is mounted on the right cover 1070, which is angularly movable about the shaft 76, so as to retract from the operative position, as needed. In FIGS. 42 and 47, solid lines indicate the image transfer roller 98 retracted from the operative position together with the right cover 1070.

The holder 1410 and notch 1410*a*-1 thereof, which are associated with the drum or image carrier 160 or 260, are not essential in the image formation aspect. The holder 1410 simply protects the drum 160 from damage when the drum 160 is temporarily put on, e.g., a floor, as stated earlier. The cassette case 60, i.e., the cleaning cassette 220 and quenching lamp 5000 can be positioned relative to the drum cassette 1400 to an acceptable degree without resorting to the notch 1410*a*-1.

The gear or drive inputting means 160*g* may be mounted to the drum cassette 1400 beforehand or may be mounted thereto after the cassette 1400 has been mounted to the apparatus body, as desired. When the gear 160*g* is mounted to the drum cassette 1400 beforehand, it can automatically mesh with the worm 116W when the cassette 1400 is mounted to the apparatus body.

The cleaning cassette 220 may be mounted to the developing device 60 and then mounted to the side walls 3000 and 4000 as an assembly, if desired. This is also true when use is made of the positioning members 900, 1100, 1300 and 1500, FIGS. 50 and 51. Such a procedure is more efficient and easier to perform than the procedure in which the units are sequentially mounted one by one. In addition, the above procedure promotes flexible maintenance adaptive to the circumstances.

The drum cassette 1400 is mounted to the developing device 60. The cleaning case 230, which forms the framework of the cleaning device, is removably mounted on the cassette case 60*a* that forms part of the developing device 60. In this condition, the cleaning means 210 and drum 160 are positioned relative to each other. The cleaning blade 210*a* included in the cleaning means 210 contacts the drum 160 in the counter direction. The position where the cleaning blade 210*a* contacts the drum 160 and pressure to act on the drum 160 are important in effecting adequate cleaning. Further, the seal roller 210*b* must be accurately positioned relative to the drum 160 in order to exhibit the expected sealing function. The illustrative embodiment meets all of the above requirements. The charge roller 170 is mounted on the cleaning case 230 and can therefore be accurately positioned relative to the drum 160.

Figure 53:
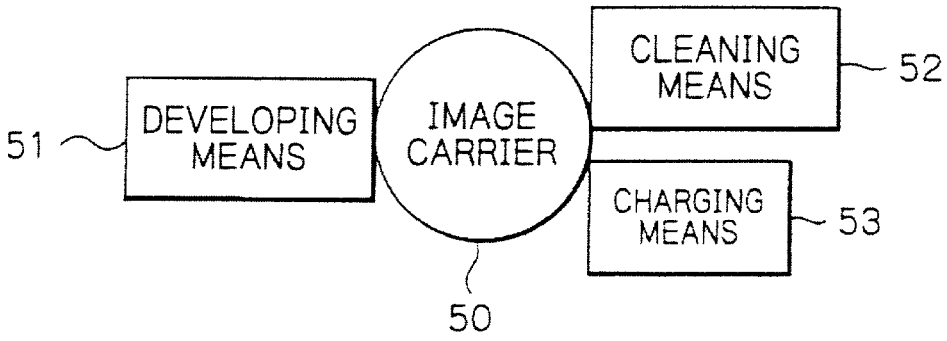
FIG. 53 is a view generally showing some different units capable of being mounted and dismounted from the body of an image forming apparatus representative of another alternative embodiment of the present invention.

Another alternative embodiment of the present invention will be described hereinafter with reference to FIGS. 53 and 54A through 54C. As shown in FIG. 53, the illustrative embodiment differs from the previous embodiments in that it includes developing means 51, cleaning means 52 and a charging means 53 arranged around an image carrier 50. The image carrier 50 and means 51 through 53 each are removably mounted to the body of an image forming apparatus not shown.

Figure 54A:
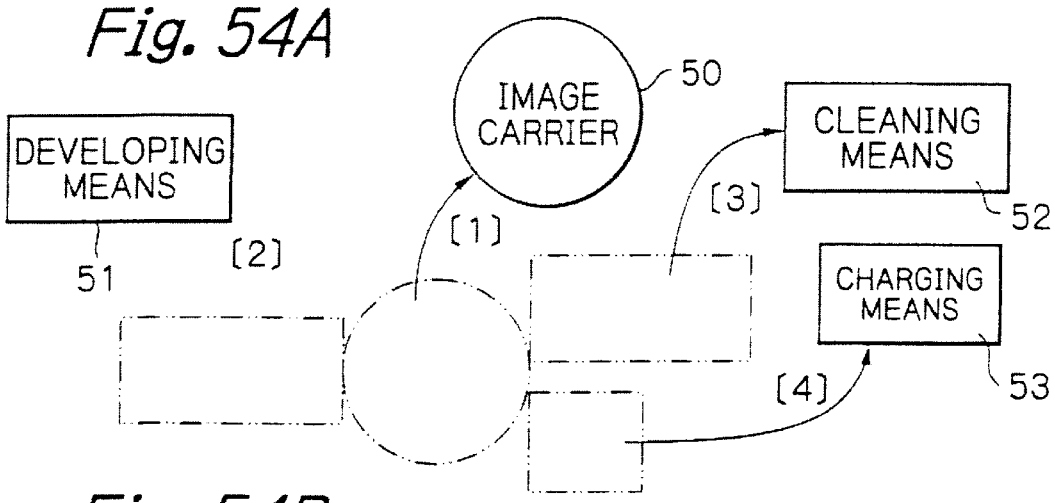
FIGS. 54A through 54C are views each showing a particular order in which the units of FIG. 53 may be dismounted from the apparatus body.
Figure 54B:
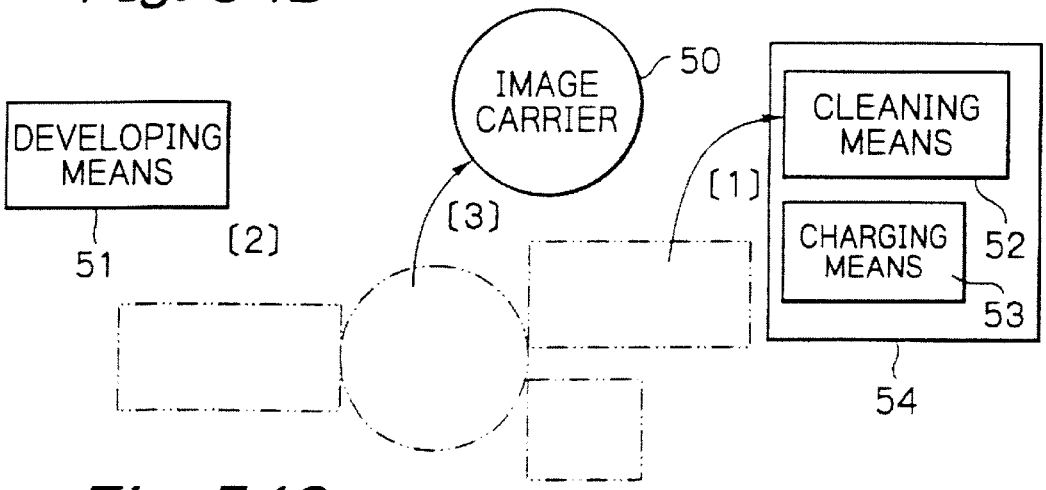
Figure 54C:
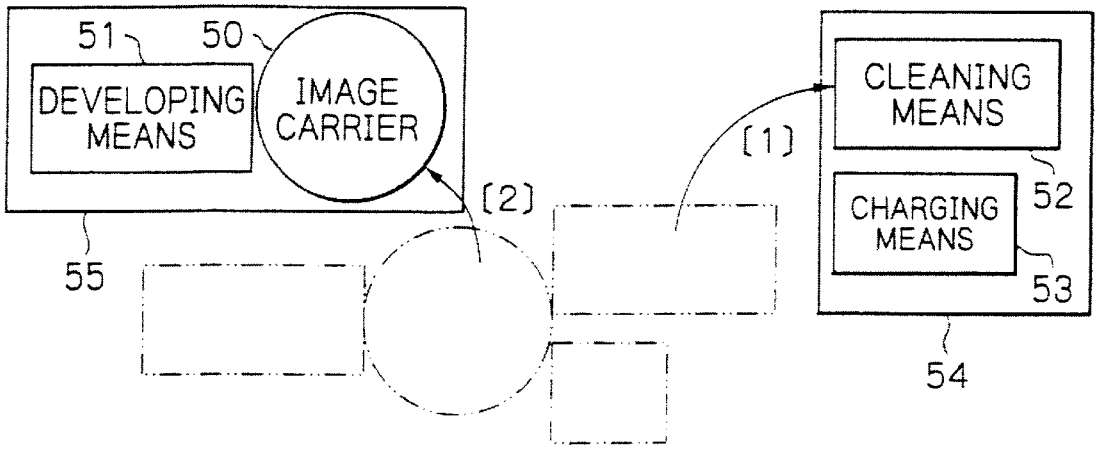

FIGS. 54A through 54C show some specific orders in which the image carrier 50, developing means 51, cleaning means 52 and charging means 53 may be dismounted from the apparatus body in accordance with the most generic concept of the illustrative embodiment. In FIGS. 54A through 54C, numerals 1 through 4 indicate a dismounting order.

In FIG. 54A, the image carrier 50, developing means 51, cleaning means 52 and charging means 53 are sequentially dismounted from the apparatus body in this order. The developing means 51 cannot be dismounted before the image carrier 50 while the cleaning means 52 cannot be dismounted before the developing means 51.

In FIG. 54B, the cleaning means 52 and charging means 53 are constructed into a cleaning/charging unit 54. In this case, the cleaning/charging unit 54, developing means 51 and image carrier 50 are sequentially dismounted from the apparatus body in this order. One unit following the other unit with respect to the dismounting order cannot be dismounted unless the former is dismounted.

In FIG. 54C, the cleaning means 52 and charging means 53 are constructed into a cleaning/charging unit 54 while the image carrier 50 and developing means 51 are constructed into an image carrier/developing means unit 55. The cleaning/charging unit 54 and image carrier/developing means unit 55 are sequentially dismounted in this order. The image carrier/developing unit 55 cannot be dismounted before the cleaning/charging unit 54.

If the image carrier 50 and four means 51 through 53 each are removable from the apparatus body independently of the others, then twenty-four different dismounting orders (=4×3×2×1) are available. If the image carrier 50 and means 51 through 53 are implemented as three units, then six different combinations (=4C2/2) and therefore thirty-six different dismounting orders (6×3!=6×(3×2×1) are available.

Further, assume that the image carrier 50 and means 51 through 53 are implemented as two units. Then, a unit including three of the image carrier 50 and means 51 through 53 and a unit including remaining one of them are available in four different forms. In addition, two units including two of the image carrier 50 and means 51 through 53 each are available in six different forms. The total number of combinations is therefore ten. It follows that twenty different dismounting orders (10×2!=10×(2×1)) are available. Consequently, eighty different dismounting orders in total are available with only four image forming means shown in FIG. 53. The crux is that the user be clearly aware of the dismounting order. However, considering the current trend toward an image carrier having a short life, it is preferable that the image carrier 50 can be dismounted alone prior to the means 51 through 53.

Various modifications will become possible for those skilled in the art after receiving the teachings of the present disclosure without departing from the scope thereof.

What is claimed is:

1. In an image forming apparatus comprising at least an image carrier, charging means, exposing means and developing means, at least one of said charging means, said exposing means and said developing means is inhibited from being unlocked from said image forming apparatus when said image carrier is present on said image forming apparatus or is allowed to be unlocked from said image forming apparatus when said image carrier is absent on said image forming apparatus.

2. The apparatus as claimed in claim 1, wherein indication means indicative of a dismounting order is provided on said charging means, said exposing means and said developing means.

3. The apparatus as claimed in claim 1, wherein said image carrier belongs to a unit independent of a unit to which said charging means, said exposing means and said developing means belong.

4. In an image forming apparatus comprising at least an image carrier, charging means, exposing means and developing means, at least one of said charging means, said exposing means and said developing means is inhibited from being dismounted from said image forming apparatus when said image carrier is present on said image forming apparatus or is allowed to be dismounted from said image forming apparatus when said image carrier is absent on said image forming apparatus.

5. The apparatus as claimed in claim 4, wherein indication means indicative of a dismounting order is provided on said charging means, said exposing means and said developing means.

6. The apparatus as claimed in claim 4, wherein said image carrier belongs to a unit independent of a unit to which said charging means, said exposing means and said developing means belong.

7. In an image forming apparatus comprising at least an image carrier, charging means, exposing means and developing means, at least one of said charging means, said exposing means and said developing means is unlocked from said image forming apparatus after said image carrier has been dismounted from said image forming apparatus.

8. The apparatus as claimed in claim 7, wherein indication means indicative of a dismounting order is provided on said charging means, said exposing means and said developing means.

9. The apparatus as claimed in claim 7, wherein said image carrier belongs to a unit independent of a unit to which said charging means, said exposing means and said developing means belong.

10. In an image forming apparatus comprising at least an image carrier, charging means, exposing means and developing means, at least one of said charging means, said exposing means and said developing means is allowed to be mounted to or dismounted from said image forming apparatus after said image carrier has been dismounted from said image forming apparatus away from said charging means, said exposing means, and said developing means.

11. The apparatus as claimed in claim 10, wherein said image carrier belongs to a unit independent of a unit to which said charging means, said exposing means and said developing means belong.

12. In an image forming apparatus comprising at least an image carrier, charging means, exposing means and developing means, at least one of said charging means, said exposing means and said developing means is allowed to be mounted to or dismounted from said image forming apparatus after said image carrier has been dismounted from said image forming apparatus, wherein indication means indicative of a dismounting order is provided on said charging means, said exposing means and said developing means.

13. In an image forming apparatus comprising at least an image carrier, charging means, exposing means and developing means, said image carrier is allowed to be mounted to said image forming apparatus after said charging means, said exposing means and said developing means each have been mounted to a preselected position of said image forming apparatus.

14. The apparatus as claimed in claim 13, wherein said image carrier belongs to a unit independent of a unit to which said charging means, said exposing means and said developing means belong.

15. In an image forming apparatus comprising at least an image carrier, charging means, exposing means and developing means, said image carrier is allowed to be mounted to said image forming apparatus after at least one of said charging means, said exposing means and said developing means has been mounted to said image forming apparatus, wherein indication means indicative of a dismounting order is provided on said charging means, said exposing means and said developing means.

16. In an image forming apparatus comprising at least an image carrier, charging means, exposing means and developing means, said image carrier is allowed to be mounted to said image forming apparatus after said charging means, said exposing means and said developing means each have been locked to a preselected position of said image forming apparatus.

17. The apparatus as claimed in claim 16, wherein said image carrier belongs to a unit independent of a unit to which said charging means, said exposing means and said developing means belong.

18. In an image forming apparatus forming apparatus comprising at least an image carrier, charging means, exposing means and developing means, said image carrier is allowed to be mounted to said image forming apparatus after at least one of said charging means, said exposing means and said developing means has been locked to said image forming apparatus, wherein indication means indicative of a dismounting order is provided on said charging means, said exposing means and said developing means.

19. In an image forming apparatus for forming an image on an image carrier with a developing device and transferring said image from said image carrier to a recording means, said image carrier is mounted to or dismounted from said image forming apparatus independently of said developing device, and said developing device is locked to said image forming apparatus when said image carrier is mounted to or dismounted from said image forming apparatus.

20. The apparatus as claimed in claim 19, wherein said image carrier is mounted to or dismounted from said developing means.

21. The apparatus as claimed in claim 19, wherein a toner storage for replenishing toner to said developing device is provided independently of said developing means.

22. The apparatus as claimed in claim 19, wherein cleaning means is provided for removing toner left on said image carrier after image transfer, and toner discharging means for discharging said toner removed by said cleaning means is provided in dependently of said cleaning means.

23. The apparatus as claimed in claim 19, wherein transferring means for transferring the image retracts when said image carrier is mounted or dismounted so as not to interfere with said image carrier.

24. The apparatus as claimed in claim 19, wherein said image carrier is mounted or dismounted in a direction in which said image carrier leaves an axis of said image carrier held in a preselected operative position.

25. In an image forming apparatus for forming an image on an image carrier with a developing device and transferring said image from said image carrier to a recording means, said image carrier and said developing device are mounted to or dismounted from said image forming apparatus independently of each other, and said developing device is unable to be dismounted from said image forming apparatus before said image carrier.

26. The apparatus as claimed in claim 25, wherein locking means is provided for locking said developing device to said apparatus and inhibited from being unlocked before said image carrier is dismounted.

27. The apparatus as claimed in claim 26, wherein when said locking means is unlocked, said image carrier is inhibited from being mounted to said apparatus.

28. The apparatus as claimed in claim 25, wherein said image carrier is mounted to or dismounted from said developing means.

29. The apparatus as claimed in claim 25, wherein a toner storage for replenishing toner to said developing device is provided independently of said developing means.

30. The apparatus as claimed in claim 25, comprising: cleaning means for removing toner left on said image carrier after image transfer; and toner discharging means independent of said cleaning means for discharging the toner removed by said cleaning means.

31. The apparatus as claimed in claim 25, wherein transferring means for transferring the image retracts when said image carrier is mounted or dismounted so as not to interfere with said image carrier.

32. The apparatus as claimed in claim 25, wherein said image carrier is mounted or dismounted in a direction in which said image carrier leaves an axis of said image carrier held in a preselected operative position.

33. A method of dismounting an image carrier and a developing device from an image forming apparatus, said method comprising the steps of:

dismounting the image carrier from the image forming apparatus to thereby unlock said developing device from said image forming apparatus; and dismounting the developing device from the image forming apparatus.

34. A method of mounting an image carrier and a developing device to an image forming apparatus, said method comprising the steps of:

mounting the developing device to the image forming apparatus and locking said developing device to said image forming apparatus; and mounting the image carrier to the developing device locked to the image forming apparatus.

35. In an image forming apparatus comprising image forming means for forming an image on an image carrier, at least one of means constituting said image forming means is locked to said image forming apparatus when said image carrier is present on said image carrier or allowed to be unlocked from said image forming apparatus when said image carrier is absent on said image forming means, and said image forming means is positioned around said image carrier at a side opposite to a side where said image carrier is to be dismounted.

36. The apparatus as claimed in claim 35, wherein said image forming means comprises at least a charger, a developing device, discharging means, and cleaning means.

37. The apparatus as claimed in claim 36, wherein said image carrier comprises an image carrier cassette constructed integrally with associated members including a support member that rotatably supports said image carrier.

38. The apparatus as claimed in claim 36, wherein said developing device is locked to said apparatus via said body when said image carrier is mounted to or dismounted from said apparatus, and said image carrier is mounted to said apparatus via said body.

39. The apparatus as claimed in claim 38, wherein said developing device is able to be mounted to or dismounted from said apparatus together with said body that holds said developing device.

40. The apparatus as claimed in claim 38, wherein said body holding said developing device comprises developing device holding means including a handle portion to be held by hand when said body is mounted to or dismounted from said apparatus and a lock portion for locking said body to said apparatus.

41. The apparatus as claimed in claim 40, wherein said handle portion is angularly movable relative to said body to which said developing device is mounted and causes, when angularly moved, said lock portion to engage with a lug protruding from said image forming apparatus to thereby lock said body to said image forming apparatus.

42. The apparatus as claimed in claim 36, wherein said developing device is removable from said apparatus, and connecting/disconnecting means is provided for disconnecting, when said developing device is dismounted from said apparatus, a developer path connecting said apparatus and said developing device at a joint between said apparatus and said developing device or connecting said developer path when said developing device is mounted to said apparatus.

43. The apparatus as claimed in claim 36, wherein said connecting/disconnecting means comprises:

a developer conveying screw selectively movable toward or away from a developer conveying screw included in said developing device to be connected to or disconnected from said developer conveyor screw of said developing device; and moving means for causing said developer conveying screw of said connecting/disconnecting means toward or away from said developer conveying screw of said developing device in interlocked relation to an angular movement of said lock portion.

44. The apparatus as claimed in claim 43, wherein said moving means comprises:

biasing means for constantly biasing said developer conveying screw of said apparatus away from said developer conveying screw of said developing device; and a coupling/uncoupling member rotated by an angular movement of said lock portion in a locking direction for coupling said developer conveying screw of said apparatus and said developer conveying screw of said developing device against an action of said biasing means or rotated by an angular movement of said lock portion in an unlocking direction for uncoupling said developing conveying screws.

45. The apparatus as claimed in claim 36, further comprising:

a cleaning device for removing a developer left on an image carrier after image transfer; and connecting/disconnecting means for disconnecting, when said cleaning device is dismounted from said apparatus, a developer path connecting said apparatus and said cleaning device to convey the developer removed by said cleaning device toward said apparatus at a joint between said apparatus and said cleaning device or connecting, when said developing device is mounted to said apparatus, said developer path at said joint.

46. The apparatus as claimed in claim 35, wherein assuming that said image carrier comprises a photoconductive drum, the side opposite to the side where said image carrier is to be dismounted is a region adjoining said photoconductive drum and downstream of said side where said image carrier is to be dismounted with respect to a plane that is perpendicular to a dismounting direction of said photoconductive drum and contains an axis of said photoconductive drum.

47. The apparatus as claimed in claim 35, wherein said image forming means is constructed into a unit constituting a body, and said image carrier is mounted to or dismounted from said body as an image carrier unit including members associated therewith.

48. The apparatus as claimed in claim 47, wherein said image carrier is removable from said apparatus independently of said developing device, and said apparatus further comprises image carrier holding means including image carrier locking means for locking said image carrier to said body by engaging with a lug included in said body.

49. The apparatus as claimed in claim 48, wherein said image carrier holding means is angularly movable relative to said image carrier, and said image carrier is locked to said apparatus when said image carrier locking means, which is mounted on a shaft of said image carrier holding means, is engaged with said lug of said body.

50. The apparatus as claimed in claim 35, wherein, an image transferring device faces said image carrier at a side opposite to a side where said image forming means is positioned with respect to said image carrier, and said image transferring device is constructed integrally with a roller, which feeds a recording medium to said image transferring device, and angularly movable about an axis of said roller to thereby retract from a position above a dismounting direction of said image carrier.

51. The apparatus as claimed in claim 50, wherein said image carrier comprises image carrier holding means including a handle portion to be held by hand and a lock portion for locking said image transferring device to a body of an image forming section.

52. The apparatus as claimed in claim 51, wherein said image carrier holding means positions said image transferring means relative to said image carrier when angularly moved to lock said image carrier to said body.

53. The apparatus as claimed in claim 52, wherein said image carrier is removable from said apparatus independently of said developing means, and said apparatus further comprises image carrier holding means including image carrier locking means for locking said image carrier to said body by engaging with a lug included in said body.

54. The apparatus as claimed in claim 53, wherein said image carrier holding means is angularly movable relative to said image carrier, and said image carrier is locked to said apparatus when said image carrier locking means, which is mounted on a shaft of said image carrier holding means, is engaged with said lug of said body.

55. In an image forming apparatus comprising image forming means for forming an image on an image carrier, at least one of means constituting said image forming means is inhibited from being dismounted from said image forming apparatus when said image carrier is present on said image forming apparatus or allowed to be dismounted when said image carrier is absent on said image forming apparatus, and said image forming means is positioned at a side around said image carrier opposite to a side where said image carrier is to be dismounted.

56. The apparatus as claimed in claim 55, wherein said image forming means comprises at least a charger, a developing device, discharging means, and cleaning means.

57. The apparatus as claimed in claim 56, wherein said image carrier comprises an image carrier cassette constructed integrally with associated members including a support member that rotatably supports said image carrier.

58. The apparatus as claimed in claim 56, wherein said developing device is locked to said apparatus via said body when said image carrier is mounted to or dismounted from said apparatus, and said image carrier is mounted to said apparatus via said body.

59. The apparatus as claimed in claim 58, wherein said developing device is able to be mounted to or dismounted from said apparatus together with said body that holds said developing device.

60. The apparatus as claimed in claim 58, wherein said body holding said developing device comprises developing device holding means including a handle portion to be held by hand when said body is mounted to or dismounted from said apparatus and a lock portion for locking said body to said apparatus.

61. The apparatus as claimed in claim 56, wherein said handle portion is angularly movable relative to said body to which said developing device is mounted and causes, when angularly moved, said lock portion to engage with a lug protruding from said image forming apparatus to thereby lock said body to said image forming apparatus.

62. The apparatus as claimed in claim 56, wherein said developing device is removable from said apparatus, and connecting/disconnecting means is provided for disconnecting, when said developing device is dismounted from said apparatus, a developer path connecting said apparatus and said developing device at a joint between said apparatus and said developing device or connecting said developer path when said developing device is mounted to said apparatus.

63. The apparatus as claimed in claim 56, wherein said connecting/disconnecting means comprises:

a developer conveying screw selectively movable toward or away from a developer conveying screw included in said developing device to be connected to or disconnected from said developer conveyor screw of said developing device; and moving means for causing said developer conveying screw of said connecting/disconnecting means toward or away from said developer conveying screw of said developing device in interlocked relation to an angular movement of said lock portion.

64. The apparatus as claimed in claim 56, wherein said moving means comprises:

biasing means for constantly biasing said developer conveying screw of said apparatus away from said developer conveying screw of said developing device; and a coupling/uncoupling member rotated by an angular movement of said lock portion in a locking direction for coupling said developer conveying screw of said apparatus and said developer conveying screw of said developing device against an action of said biasing means or rotated by an angular movement of said lock portion in an unlocking direction for uncoupling said developing conveying screws.

65. The apparatus as claimed in claim 56, further comprising:

a cleaning device for removing a developer left on an image carrier after image transfer; and connecting/disconnecting means for disconnecting, when said cleaning device is dismounted from said apparatus, a developer path connecting said apparatus and said cleaning device to convey the developer removed by said cleaning device toward said apparatus at a joint between said apparatus and said cleaning device or connecting, when said developing device is mounted to said apparatus, said developer path at said joint.

66. The apparatus as claimed in claim 55, wherein assuming that said image carrier comprises a photoconductive drum, the side opposite to the side where said image carrier is to be dismounted is a region adjoining said photoconductive drum and downstream of said side where said image carrier is to be dismounted with respect to a plane that is perpendicular to a dismounting direction of said photoconductive drum and contains an axis of said photoconductive drum.

67. The apparatus as claimed in claim 55, wherein said image forming means is constructed into a unit constituting a body, and said image carrier is mounted to or dismounted from said body as an image carrier unit including members associated therewith.

68. The apparatus as claimed in claim 67, wherein said image carrier is removable from said apparatus independently of said developing device, and said apparatus further comprises image carrier holding means including image carrier locking means for locking said image carrier to said body by engaging with a lug included in said body.

69. The apparatus as claimed in claim 68, wherein said image carrier holding means is angularly movable relative to said image carrier, and said image carrier is locked to said apparatus when said image carrier locking means, which is mounted on a shaft of said image carrier holding means, is engaged with said lug of said body.

70. The apparatus as claimed in claim 55, wherein an image transferring device faces said image carrier at a side opposite to a side where said image forming means is positioned with respect to said image carrier, and said image transferring device is constructed integrally with a roller, which feeds a recording medium to said image transferring device, and angularly movable about an axis of said roller to thereby retract from a position above a dismounting direction of said image carrier.

71. The apparatus as claimed in claim 70, wherein said image carrier comprises image carrier holding means including a handle portion to be held by hand and a lock portion for locking said image transferring device to a body of an image forming section.

72. The apparatus as claimed in claim 71, wherein said image carrier holding means positions said image transferring means relative to said image carrier when angularly moved to lock said image carrier to said body.

73. The apparatus as claimed in claim 72, wherein said image carrier is removable from said apparatus independently of said developing means, and said apparatus further comprises image carrier holding means including image carrier locking means for locking said image carrier to said body by engaging with a lug included in said body.

74. The apparatus as claimed in claim 73, wherein said image carrier holding means is angularly movable relative to said image carrier, and said image carrier is locked to said apparatus when said image carrier locking means, which is mounted on a shaft of said image carrier holding means, is engaged with said lug of said body.

75. In an image forming apparatus comprising image forming means for forming an image on an image carrier, at least one of means constituting said image forming means is unlocked from said image forming apparatus after said image carrier has been unlocked from said image forming apparatus or unlockable from said image forming apparatus when said image carrier is absent on said image forming apparatus, and said image forming means is positioned at a side around said image carrier opposite to a side where said image carrier is to be dismounted.

76. The apparatus as claimed in claim 75, wherein said image forming means comprises at least a charger, a developing device, discharging means, and cleaning means.

77. The apparatus as claimed in claim 76, wherein said image carrier comprises an image carrier cassette constructed integrally with associated members including a support member that rotatably supports said image carrier.

78. The apparatus as claimed in claim 76, wherein said developing device is locked to said apparatus via said body when said image carrier is mounted to or dismounted from said apparatus, said image carrier being mounted to said apparatus via said body.

79. The apparatus as claimed in claim 78, wherein said developing device is able to be mounted to or dismounted from said apparatus together with said body that holds said developing device.

80. The apparatus as claimed in claim 78, wherein said body holding said developing device comprises developing device holding means including a handle portion to be held by hand when said body is mounted to or dismounted from said apparatus and a lock portion for locking said body to said apparatus.

81. The apparatus as claimed in claim 80, wherein said handle portion is angularly movable relative to said body to which said developing device is mounted and causes, when angularly moved, said lock portion to engage with a lug protruding from said image forming apparatus to thereby lock said body to said image forming apparatus.

82. The apparatus as claimed in claim 76, wherein said developing device is removable from said apparatus, and connecting/disconnecting means is provided for disconnecting, when said developing device is dismounted from said apparatus, a developer path connecting said apparatus and said developing device at a joint between said apparatus and said developing device or connecting said developer path when said developing device is mounted to said apparatus.

83. The apparatus as claimed in claim 76, wherein said connecting/disconnecting means comprises:

a developer conveying screw selectively movable toward or away from a developer conveying screw included in said developing device to be connected to or disconnected from said developer conveyor screw of said developing device; and moving means for causing said developer conveying screw of said connecting/disconnecting means toward or away from said developer conveying screw of said developing device in interlocked relation to an angular movement of said lock portion.

84. The apparatus as claimed in claim 76, wherein said moving means comprises:

biasing means for constantly biasing said developer conveying screw of said apparatus away from said developer conveying screw of said developing device; and a coupling/uncoupling member rotated by an angular movement of said lock portion in a locking direction for coupling said developer conveying screw of said apparatus and said developer conveying screw of said developing device against an action of said biasing means or rotated by an angular movement of said lock portion in an unlocking direction for uncoupling said developing conveying screws.

85. The apparatus as claimed in claim 76, further comprising:

a cleaning device for removing a developer left on an image carrier after image transfer; and connecting/disconnecting means for disconnecting, when said cleaning device is dismounted from said apparatus, a developer path connecting said apparatus and said cleaning device to convey the developer removed by said cleaning device toward said apparatus at a joint between said apparatus and said cleaning device or connecting, when said developing device is mounted to said apparatus, said developer path at said joint.

86. The apparatus as claimed in claim 75, wherein assuming that said image carrier comprises a photoconductive drum, the side opposite to the side where said image carrier is to be dismounted is a region adjoining said photoconductive drum and downstream of said side where said image carrier is to be dismounted with respect to a plane that is perpendicular to a dismounting direction of said photoconductive drum and contains an axis of said photoconductive drum.

87. The apparatus as claimed in claim 75, wherein said image forming means is constructed into a unit constituting a body, and said image carrier is mounted to or dismounted from said body as an image carrier unit including members associated therewith.

88. The apparatus as claimed in claim 87, wherein said image carrier is removable from said apparatus independently of said developing device, and said apparatus further comprises image carrier holding means including image carrier locking means for locking said image carrier to said body by engaging with a lug included in said body.

89. The apparatus as claimed in claim 88, wherein said image carrier holding means is angularly movable relative to said image carrier, and said image carrier is locked to said apparatus when said image carrier locking means, which is mounted on a shaft of said image carrier holding means, is engaged with said lug of said body.

90. The apparatus as claimed in claim 75, wherein an image transferring device faces said image carrier at a side opposite to a side where said image forming means is positioned with respect to said image carrier, and said image transferring device is constructed integrally with a roller, which feeds a recording medium to said image transferring device, and angularly movable about an axis of said roller to thereby retract from a position above a dismounting direction of said image carrier.

91. The apparatus as claimed in claim 90, wherein said image carrier comprises image carrier holding means including a handle portion to be held by hand and a lock portion for locking said image transferring device to a body of an image forming section.

92. The apparatus as claimed in claim 91, wherein said image carrier holding means positions said image transferring means relative to said image carrier when angularly moved to lock said image carrier to said body.

93. The apparatus as claimed in claim 92, wherein said image carrier is removable from said apparatus independently of said developing means, and said apparatus further comprises image carrier holding means including image carrier locking means for locking said image carrier to said body by engaging with a lug included in said body.

94. The apparatus as claimed in claim 93, wherein said image carrier holding means is angularly movable relative to said image carrier, and said image carrier is locked to said apparatus when said image carrier locking means, which is mounted on a shaft of said image carrier holding means, is engaged with said lug of said body.

95. In an image forming apparatus comprising image forming means for forming an image on an image carrier, at least one of means constituting said image forming means is unlocked from said image forming apparatus after said image carrier has been dismounted from said image forming apparatus or unlockable from said image forming apparatus when said image carrier is absent on said image forming apparatus, and said image forming means is positioned at a side around said image carrier opposite to a side where said image carrier is to be dismounted.

96. The apparatus as claimed in claim 95, wherein said image forming means comprises at least a charger, a developing device, discharging means, and cleaning means.

97. The apparatus as claimed in claim 96, wherein said image carrier comprises an image carrier cassette constructed integrally with associated members including a support member that rotatably supports said image carrier.

98. The apparatus as claimed in claim 96, wherein said developing device is locked to said apparatus via said body when said image carrier is mounted to or dismounted from said apparatus, said image carrier being mounted to said apparatus via said body.

99. The apparatus as claimed in claim 98, wherein said developing device is able to be mounted to or dismounted from said apparatus together with said body that holds said developing device.

100. The apparatus as claimed in claim 98, wherein said body holding said developing device comprises developing device holding means including a handle portion to be held by hand when said body is mounted to or dismounted from said apparatus and a lock portion for locking said body to said apparatus.

101. The apparatus as claimed in claim 100, wherein said handle portion is angularly movable relative to said body to which said developing device is mounted and causes, when angularly moved, said lock portion to engage with a lug protruding from said image forming apparatus to thereby lock said body to said image forming apparatus.

102. The apparatus as claimed in claim 96, wherein said developing device is removable from said apparatus, and connecting/disconnecting means is provided for disconnecting, when said developing device is dismounted from said apparatus, a developer path connecting said apparatus and said developing device at a joint between said apparatus and said developing device or connecting said developer path when said developing device is mounted to said apparatus.

103. The apparatus as claimed in claim 96, wherein said connecting/disconnecting means comprises:

a developer conveying screw, selectively movable toward or away from a developer conveying screw included in said developing device to be connected to or disconnected from said developer conveyor screw of said developing device; and moving means for causing said developer conveying screw of said connecting/disconnecting means toward or away from said developer conveying screw of said developing device in interlocked relation to an angular movement of said lock portion.

104. The apparatus as claimed in claim 96, wherein said moving means comprises:

biasing means for constantly biasing said developer conveying screw of said apparatus away from said developer conveying screw of said developing device; and a coupling/uncoupling member rotated by an angular movement of said lock portion in a locking direction for coupling said developer conveying screw of said apparatus and said developer conveying screw of said developing device against an action of said biasing means or rotated by an angular movement of said lock portion in an unlocking direction for uncoupling said developing conveying screws.

105. The apparatus as claimed in claim 96, further comprising:

a cleaning device fop removing a developer left on an image carrier after image transfer; and connecting/disconnecting means for disconnecting, when said cleaning device is dismounted from said apparatus, a developer path connecting said apparatus and said cleaning device to convey the developer removed by said cleaning device toward said apparatus at a joint between said apparatus and said cleaning device or connecting, when said developing device is mounted to said apparatus, said developer path at said joint.

106. The apparatus as claimed in claim 95, wherein assuming that said image carrier comprises, a photoconductive drum, the side opposite to the side where said image carrier is to be dismounted is a region adjoining said photoconductive drum and downstream of said side where said image carrier is to be dismounted with respect to a plane that is perpendicular to a dismounting direction of said photoconductive drum and contains an axis of said photoconductive drum.

107. The apparatus as claimed in claim 95, wherein said image forming means is constructed into a unit constituting a body, and said image carrier is mounted to or dismounted from said body as an image carrier unit including members associated therewith.

108. The apparatus as claimed in claim 107, wherein said image carrier is removable from said apparatus independently of said developing device, and said apparatus further comprises image carrier holding means including image carrier locking means for locking said image carrier to said body by engaging with a lug included in said body.

109. The apparatus as claimed in claim 108, wherein said image carrier holding means is angularly movable relative to said image carrier, and said image carrier is locked to said apparatus when said image carrier locking means, which is mounted on a shaft of said image carrier holding means, is engaged with said lug of said body.

110. The apparatus as claimed in claim 95, wherein an image transferring device faces said image carrier at a side opposite to a side where said image forming means is positioned with respect to said image carrier, and said image transferring device is constructed integrally with a roller, which feeds a recording medium to said image transferring device, and angularly movable about an axis of said roller to thereby retract from a position above a dismounting direction of said image carrier.

111. The apparatus as claimed in claim 110, wherein said image carrier comprises image carrier holding means including a handle portion to be held by hand and a lock portion for locking said image transferring device to a body of an image forming section.

112. The apparatus as claimed in claim 111, wherein said image carrier holding means positions said image transferring means relative to said image carrier when angularly moved to lock said image carrier to said body.

113. The apparatus as claimed in claim 112, wherein said image carrier is removable from said apparatus independently of said developing means, and said apparatus further comprises image carrier holding means including image carrier locking means for locking said image carrier to said body by engaging with a lug included in said body.

114. The apparatus as claimed in claim 113, wherein said image carrier holding means is angularly movable relative to said image carrier, and said image carrier is locked to said apparatus when said image carrier locking means, which is mounted on a shaft of said image carrier holding means, is engaged with said lug of said body.

115. In an image forming apparatus comprising image forming means for forming an image on an image carrier, said image forming means is positioned at a side around said image carrier opposite to a side where said image carrier is to be dismounted, and at least one of said image forming means is removable from said image forming apparatus after said image carrier has been dismounted from said image forming apparatus away from all of said image forming means.

116. The apparatus as claimed in claim 115, wherein said image forming means comprises at least a charger, a developing device, discharging means, and cleaning means.

117. The apparatus as claimed in claim 116, wherein said image carrier comprises an image carrier cassette constructed integrally with associated members including a support member that rotatably supports said image carrier.

118. In an image forming apparatus comprising image forming means for forming an image on an image carrier, said image forming means is positioned at a side around said image carrier opposite to a side where said image carrier is to be dismounted, and at least one of means constituting said image forming means is removable from said image forming apparatus after said image carrier has been dismounted from said image forming apparatus, wherein said image forming means comprises at least a charger and a developing device, and wherein said developing device is mounted to said apparatus via a body when said image carrier is mounted to or dismounted from said apparatus, said image carrier being mounted to said apparatus via said body.

119. The apparatus as claimed in claim 118, wherein said developing device is able to be mounted to or dismounted from said apparatus together with said body that holds said developing device.

120. The apparatus as claimed in claim 118, wherein said body holding said developing device comprises developing device holding means including a handle portion to be held by hand when said body is mounted to or dismounted from said apparatus and a lock portion for locking said body to said apparatus.

121. The apparatus as claimed in claim 120, wherein said handle portion is angularly movable relative to said body to which said developing device is mounted and causes, when angularly moved, said lock portion to engage with a lug protruding from said image forming apparatus to thereby lock said body to said image forming apparatus.

122. In an image forming apparatus comprising image forming means for forming an image on an image carrier, said image forming means is positioned at a side around said image carrier opposite to a side where said image carrier is to be dismounted, and at least one of means constituting said image forming means is removable from said image forming apparatus after said image carrier has been dismounted from said image forming apparatus, wherein said image forming means comprises at least a charger, a developing device, discharging means, and cleaning means, and wherein said developing device is removable from said apparatus, and connecting/disconnecting means is provided for disconnecting, when said developing device is dismounted from said apparatus, a developer path connecting said apparatus and said developing device at a joint between said apparatus and said developing device or connecting said developer path when said developing device is mounted to said apparatus.

123. In an image forming apparatus comprising image forming means for forming an image on an image carrier, said image forming means is positioned at a side around said image carrier opposite to a side where said image carrier is to be dismounted, at least one of means constituting said image forming means is removable from said image forming apparatus after said image carrier has been dismounted from said image forming apparatus, and a connecting/disconnecting means that comprises:

a developer conveying screw selectively movable toward or away from a developer conveying screw included in said developing device to be connected to or disconnected from said developer conveyor screw of said developing device; and moving means for causing said develop conveying screw of said connecting/disconnecting means toward or away from said developer conveying screw of said developing device in interlocked relation to an angular movement of said lock portion, wherein said image forming means comprises at least a charger, a developing device, discharging means, and cleaning means.

124. In an image forming apparatus comprising image forming means for forming an image on an image carrier, said image forming means is positioned at a side around said image carrier opposite to a side where said image carrier is to be dismounted, at least one of means constituting said image forming means is removable from said image forming apparatus after said image carrier has been dismounted from said image forming apparatus, and a moving means that comprises:

biasing means for constantly biasing said developer conveying screw of said apparatus away from said developer conveying screw of said developing device; and a coupling/uncoupling member rotated by an angular movement of said lock portion in a locking direction for coupling said developer conveying screw of said apparatus and said developer conveying screw of said developing device against an action of said biasing means or rotated by an angular movement of said lock portion in an unlocking direction for uncoupling said developing conveying screws, wherein said image forming means comprises at least a charger, a developing device, discharging means, and cleaning means.

125. In an image forming apparatus comprising image forming means for forming an image on an image carrier, said image forming means is positioned at a side around said image carrier opposite to a side where said image carrier is to be dismounted, at least one of means constituting said image forming means is removable from said image forming apparatus after said image carrier has been dismounted from said image forming apparatus, a cleaning device for removing a developer left on an image carrier after image transfer, and connecting/disconnecting means for disconnecting, when said cleaning device is dismounted from said apparatus, a developer path connecting said apparatus and said cleaning device to convey the developer removed by said cleaning device toward said apparatus at a joint between said apparatus and said cleaning device or connecting, when said developing device is mounted to said apparatus, said developer path at said joint, wherein said image forming means comprises at least a charger, a developing device, discharging means, and cleaning means.

126. In an image forming apparatus comprising image forming means for forming an image on an image carrier, said image forming means is positioned at a side around said image carrier opposite to a side where said image carrier is to be dismounted, and at least one of means constituting said image forming means is removable from said image forming apparatus after said image carrier has been dismounted from said image forming apparatus, wherein assuming that said image carrier comprises a photoconductive drum, the side opposite to the side where said image carrier is to be dismounted is a region adjoining said photoconductive drum and downstream of said side where said image carrier is to be dismounted with respect to a plane that is perpendicular to a dismounting direction of said photoconductive drum and contains an axis of said photoconductive drum.

127. The apparatus as claimed in claim 115, wherein said image forming means is constructed into a unit constituting a body, and said image carrier is mounted to or dismounted from said body as an image carrier unit including members associated therewith.

128. The apparatus as claimed in claim 127, wherein said image carrier is removable from said apparatus independently of said developing device, and said apparatus further comprises image carrier holding means including image carrier locking means for locking said image carrier to said body by engaging with a lug included in said body.

129. In an image forming apparatus comprising image forming means for forming an image on an image carrier, said image forming means is positioned at a side around said image carrier opposite to a side where said image carrier is to be dismounted, and at least one of means constituting said image forming means is removable from said image forming apparatus after said image carrier has been dismounted from said image forming apparatus, and image carrier holding means including image carrier locking means for locking said image carrier to said body by engaging with a lug included in said body, wherein said image forming means is constructed into a unit constituting a body, and said image carrier is mounted to or dismounted from said body as an image carrier unit including members associated therewith, wherein said image carrier is removable from said apparatus independently of said developing device, and wherein said image carrier holding means is angularly movable relative to said image carrier, and said image carrier is locked to said apparatus when said image carrier locking means, which is mounted on a shaft of said image carrier holding means, engaged with said lug of said body.

130. In an image forming apparatus comprising image forming means for forming an image on an image carrier, said image forming means is positioned at a side around said image carrier opposite to a side where said image carrier is to be dismounted, and at least one of means constituting said image forming means is removable from said image forming apparatus after said image carrier has been dismounted from said image forming apparatus, wherein an image transferring device faces said image carrier at a side opposite to a side where said image forming means is positioned with respect to said image carrier, and said image transferring device is constructed integrally with a roller, which feeds a recording medium to said image transferring device, and angularly movable about an axis of said roller to thereby retract from a position above a dismounted direction of said image carrier.

131. The apparatus as claimed in claim 130, wherein said image carrier comprises image carrier holding means including a handle portion to be held by hand and a lock portion for locking said image transferring device to a body of an image forming section.

132. The apparatus as claimed in claim 131, wherein said image carrier holding means positions said image transferring means relative to said image carrier when angularly moved to lock said image carrier to said body.

133. The apparatus as claimed in claim 132, wherein said image carrier is removable from said apparatus independently of said developing means, and said apparatus further comprises image carrier holding means including image carrier locking means for locking said image carrier to said body by engaging with a lug included in said body.

134. The apparatus as claimed in claim 133, wherein said image carrier holding means is angularly movable relative to said image carrier, and said image carrier is locked to said apparatus when said image carrier locking means, which is mounted on a shaft of said image carrier holding means, engaged with said lug of said body.

135. In an image forming apparatus comprising image forming means whose components are at least an image carrier and a developing device, a cleaning device and an image transferring device arranged around said image carrier, part of said components is removable from said image forming apparatus by being moved upward in a preselected direction in a preselected order, any one of said components is unable to be dismounted from said image forming apparatus until the other component having priority with respect to the preselected order has been dismounted from said image forming apparatus, and the components unremovable from said image forming apparatus and arranged at a position above the components removable in the preselected direction each are retractable from said position.

136. The apparatus as claimed in claim 135, wherein said image carrier is dismounted from said apparatus before the other components.

137. The apparatus as claimed in claim 135, wherein said image transferring device is retractable.

138. The apparatus as claimed in claim 137, wherein, said image transferring device forms at least part of means contributing to image transfer and is mounted on an openable member, and when said openable member is opened, said image transferring device retracts from said position to thereby form a space for mounting or dismounting said image transferring device.

139. The apparatus as claimed in claim 135, the components are mounted on a body of said apparatus and an openable member openably mounted on said body, and a position for mounting said image carrier is closest to a space to be formed above said body when said openable member is opened.

140. The apparatus as claimed in claim 139, wherein the preselected direction is upward, and when said openable member is angularly mode, at least a position above said body is open and allows said image transferring device to be mounted or dismounted.

141. The apparatus as claimed in claim 135, wherein said image transferring device comprises image transferring means for transferring a toner image from said image carrier to an intermediate image transfer body and said intermediate image transfer body.

142. The apparatus as claimed in claim 135, wherein indication means is provided on at least components of said image forming means for indicating an order in which said component should be mounted or dismounted from a body of said apparatus.

143. The apparatus as claimed in claim 135, comprising a developing device support portion for supporting said developing device, and drive means support portion for supporting drive means that drives said image carrier, wherein said developing device and said drive means are positioned relative to each other by positioning members mounted on an unmovable portion of a body of said apparatus.

144. The apparatus as claimed in claim 135, wherein said developing device is lockable and unlockable, either singly or together with process means other than said image carrier, from a body of said apparatus or from positioning members mounted on said body.

145. The apparatus as claimed in claim 144, wherein said process means other than said image carrier comprises said cleaning device.

146. The apparatus as claimed in claim 135, wherein said image carrier is mounted to or dismounted from said apparatus either singly or together with a member associated therewith.

147. The apparatus as claimed in claim 135, wherein said cleaning device comprises at least cleaning means for cleaning said image carrier and removably mounted to said apparatus singly to be thereby positioned relative to said image carrier.

148. The apparatus as claimed in claim 135, wherein said cleaning device comprises at least cleaning means for cleaning said image carrier, which is included in an image carrier unit, and charging means for uniformly charging a surface of said image carrier, said cleaning device is removably mounted to said developing device singly to thereby position said charging means and said image carrier relative to each other.

149. The apparatus as claimed in claim 148, wherein said cleaning device is constructed integrally with a waste developer storage that stores a developer removed from said image carrier, and is removably mounted to said developing device.

150. The apparatus as claimed in claim 135, wherein said cleaning device is partly movable toward and away from said image carrier.

151. The apparatus as claimed in claim 150, wherein said cleaning device is removably accommodated in a cleaning case that is angularly movably mounted on said developing device, and said cleaning case causes said cleaning device to move toward or away from said image carrier when angularly moved.

152. The apparatus as claimed in claim 151, wherein said cleaning case includes a locking mechanism for selectively locking or unlocking said cleaning device, and said cleaning device is removably mounted to said cleaning case alone.

153. The apparatus as claimed in claim 152, wherein said locking mechanism adjoins said image carrier, and when said image carrier is present on said body, said image carrier is located, in a range for operating said locking mechanism, at a position where said locking mechanism is unable to be operated.

154. The apparatus as claimed in claim 152, wherein said locking mechanism includes discharging means for discharging a surface of said image carrier.

155. The apparatus as claimed in claim 154, wherein said discharging means is movable toward or away from said image carrier when said cleaning device is moved toward or away from said image carrier.

156. The apparatus as claimed in claim 135, wherein discharging means for discharging a surface of said image carrier is constructed integrally with said image carrier.

157. The apparatus as claimed in claim 135, wherein said cleaning device is removable from a body of said apparatus only after said image carrier has been removed from said body.

158. The apparatus as claimed in claim 157, wherein said cleaning device is allowed to be removed from said body only after part of said cleaning device has been spaced from said image carrier to thereby allow said image carrier to be removed.

159. The apparatus as claimed in claim 135, wherein said developing device comprises a locking mechanism for selectively locking or unlocking said image carrier to or from said developing device, and an image carrier unit including said image carrier is removably mounted to said developing device alone.

160. The apparatus as claimed in claim 135, wherein said developing device comprises a locking mechanism for selectively locking or unlocking an image carrier unit, which includes aid image carrier, and said cleaning device to or from said developing device at the same time, and said image carrier and said cleaning device are individually mounted to or dismounted from said developing device after said locking mechanism has been unlocked.

161. The apparatus as claimed in claim 135, wherein said developing device is allowed to be dismounted from a body of said apparatus only after said image carrier has been dismounted from said body.

162. The apparatus as claimed in claim 135, wherein said image forming means comprises a plurality of image forming means arranged around said image transferring device.

163. In an image forming apparatus comprising image forming means whose components are at least an image carrier and a developing device, a cleaning device and an image transferring device arranged around said image carrier, part of said components is mountable to said image forming apparatus by being moved in a preselected direction in a preselected order, any one of said components is unable to be mounted to said image forming apparatus until the other component having priority with respect to the preselected order has been mounted to said image forming apparatus, and the components unremovable from said image forming apparatus and arranged at a position above the components removable in the preselected direction each are retractable from said position.

164. The apparatus as claimed in claim 163, wherein said image carrier is mounted to said apparatus after the other components.

165. The apparatus as claimed in claim 163, wherein said image transferring device is retractable.

166. The apparatus as claimed in claim 163, wherein the components are mounted on a body of said apparatus and an openable member openably mounted on said body, and a position for mounting said image carrier is closest to a space to be formed above said body when said openable member is opened.

167. The apparatus as claimed in claim 166, wherein, said image transferring device forms at least part of means contributing to image transfer and is mounted on an openable member, and when said openable member is opened, said image transferring device retracts from said position to thereby form a space for mounting or dismounting said image transferring device.

168. The apparatus as claimed in claim 166, wherein the preselected direction is upward, and when said openable member is angularly mode, at least a position above said body is open and allows said image transferring device to be mounted or dismounted.

169. The apparatus as claimed in claim 163, wherein said image transferring device comprises image transferring means for transferring a toner image from said image carrier to an intermediate image transfer body and said intermediate image transfer body.

170. The apparatus as claimed in claim 163, wherein indication means is provided on at least components of said image forming means for indicating an order in which said component should be mounted or dismounted from a body of said apparatus.

171. The apparatus as claimed in claim 163, comprising a developing device support portion for supporting said developing device, and drive means support portion for supporting drive means that drives said image carrier, wherein said developing device and said drive means are positioned relative to each other by positioning members mounted on an unmovable portion of a body of said apparatus.

172. The apparatus as claimed in claim 163, wherein said developing device is lockable and unlockable, either singly or together with process means other than said image carrier, from a body of said apparatus or from positioning members mounted on said body.

173. The apparatus as claimed in claim 172, wherein said process means other than said image carrier comprises said cleaning device.

174. The apparatus as claimed in claim 163, wherein said image carrier is mounted to or dismounted from said apparatus either singly or together with a member associated therewith.

175. The apparatus as claimed in claim 163, wherein said cleaning device comprises at least cleaning means for cleaning said image carrier and removably mounted to said apparatus singly to be thereby positioned relative to said image carrier.

176. The apparatus as claimed in claim 163, wherein said cleaning device comprises at least cleaning means for cleaning said image carrier, which is included in an image carrier unit, and charging means for uniformly charging a surface of said image carrier, said cleaning device is removably mounted to said developing device singly to thereby position said charging means and said image carrier relative to each other.

177. The apparatus as claimed in claim 176, wherein said cleaning device is constructed integrally with a waste developer storage that stores a developer removed from said image carrier, and is removably mounted to said developing device.

178. The apparatus as claimed in claim 163, wherein said cleaning device is partly movable toward and away from said image carrier.

179. The apparatus as claimed in claim 178, wherein said cleaning device is removably accommodated in a cleaning case that is angularly movably mounted on said developing device, and said cleaning case causes said cleaning device to move toward or away from said image carrier when angularly moved.

180. The apparatus as claimed in claim 179, wherein said cleaning case includes a locking mechanism for selectively locking or unlocking said cleaning device, and said cleaning device is removably mounted to said cleaning case alone.

181. The apparatus as claimed in claim 180, wherein said locking mechanism adjoins said image carrier, and when said image carrier is present on said body, said image carrier is located, in a range for operating said locking mechanism, at a position where said locking mechanism is unable to be operated.

182. The apparatus as claimed in claim 180, wherein said locking mechanism includes discharging means for discharging a surface of said image carrier.

183. The apparatus as claimed in claim 182, wherein said discharging means is movable toward or away from said image carrier when said cleaning device is moved toward or away from said image carrier.

184. The apparatus as claimed in claim 163, wherein discharging means for discharging a surface of said image carrier is constructed integrally with said image carrier.

185. The apparatus as claimed in claim 163, wherein said cleaning device is removable from a body of said apparatus only after said image carrier has been removed from said body.

186. The apparatus as claimed in claim 185, wherein said cleaning device is allowed to be removed from said body only after part of said cleaning device has been spaced from said image carrier to thereby allow said image carrier to be removed.

187. The apparatus as claimed in claim 163, wherein said developing device comprises a locking mechanism for selectively locking or unlocking said image carrier to or from said developing device, and an image carrier unit including said image carrier is removably mounted to said developing device alone.

188. The apparatus as claimed in claim 163, wherein said developing device comprises a locking mechanism for selectively locking or unlocking an image carrier unit, which includes aid image carrier, and said cleaning device to or from said developing device at the same time, and said image carrier and said cleaning device are individually mounted to or dismounted from said developing device after said locking mechanism has been unlocked.

189. The apparatus as claimed in claim 163, wherein said developing device is allowed to be dismounted from a body of said apparatus only after said image carrier has been dismounted from said body.

190. The apparatus as claimed in claim 163, wherein said image forming means comprises a plurality of image forming means arranged around said image transferring device.

191. An image carrier unit comprising:

an image carrier around which a developing device, a cleaning device and an image transferring device are arranged as components of an image forming apparatus; and a holder protruding from a surface portion of said image carrier unit; and inputting means for inputting power for driving said image carrier, wherein part of said components is removable from said image forming apparatus by being moved upward in a preselected direction in a preselected order, any one of said components is unable to be dismounted from said image forming apparatus until the other component having priority with respect to the preselected order has been dismounted from said image forming apparatus, and the components unremovable from said image forming apparatus and arranged at a position above the components removable in the preselected direction each are retractable from said position.

192. An image carrier unit comprising:

an image carrier around which a developing device, a cleaning device and an image transferring device are arranged as components of an image forming apparatus; and a holder protruding from a surface portion of said image carrier unit; and inputting means for inputting power for driving said image carrier, wherein part of said components is mountable to said image forming apparatus by being moved in a preselected direction in a preselected order, any one of said components is unable to be mounted to said image forming apparatus until the other component having priority with respect to the preselected order has been mounted to said image forming apparatus, and the components unremovable from said image forming apparatus and arranged at a position above the components removable in the preselected direction each are retractable from said position.

193. In a method of assembling an image forming apparatus, a developing device is mounted to a body of said image forming apparatus, a cleaning device is mounted to said developing device mounted to said body, and an image carrier unit is mounted to said developing device, wherein said image carrier unit cannot be mounted to said developing device unless said cleaning device is previously mounted to said developing device.

194. The method as claimed in claim 193, wherein said cleaning device is mounted to said developing device beforehand to thereby constitute a subassembly, said subassembly is mounted to a body of said image forming apparatus or positioning members, and then said image carrier unit is mounted.

195. In a method of assembling an image forming apparatus, positioning members each including a support portion for supporting a developing device and a support portion for supporting drive means, which drives an image carrier, are mounted to a body of said image forming apparatus, said developing device is mounted to said positioning members, and then an image carrier unit is mounted.

196. The apparatus as claimed in claim 195, wherein said cleaning device is mounted to said developing device beforehand to thereby constitute a subassembly, said subassembly is mounted to a body of said image forming apparatus or positioning members, and then said image carrier unit is mounted.

* * * * *